US010910728B2

(12) United States Patent
Uchimura et al.

(10) Patent No.: US 10,910,728 B2
(45) Date of Patent: Feb. 2, 2021

(54) STRUCTURE, ANTENNA, WIRELESS COMMUNICATION MODULE, AND WIRELESS COMMUNICATION DEVICE

(71) Applicant: KYOCERA Corporation, Kyoto (JP)

(72) Inventors: Hiroshi Uchimura, Kagoshima (JP); Nobuki Hiramatsu, Yokohama (JP); Hiromichi Yoshikawa, Yokohama (JP); Katsuro Nakamata, Kirishima (JP); Shinji Isoyama, Yokohama (JP); Masamichi Yonehara, Yokohama (JP); Sunao Hashimoto, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/544,919

(22) Filed: Aug. 20, 2019

(65) Prior Publication Data

US 2020/0044351 A1 Feb. 6, 2020

Related U.S. Application Data

(63) Continuation of application No. 16/458,186, filed on Jun. 30, 2019, which is a continuation of application No. PCT/JP2018/010895, filed on Mar. 19, 2018.

(30) Foreign Application Priority Data

Mar. 21, 2017 (JP) ..... 2017-054719
Jul. 21, 2017 (JP) ..... 2017-141558
(Continued)

(51) Int. Cl.
*H01Q 15/02* (2006.01)
*H01Q 13/10* (2006.01)
(Continued)

(52) U.S. Cl.
CPC ..... *H01Q 13/106* (2013.01); *H01P 3/08* (2013.01); *H01Q 9/0414* (2013.01); *H01Q 21/0043* (2013.01); *H01Q 21/065* (2013.01)

(58) Field of Classification Search
CPC ..... H01Q 13/106; H01Q 9/0414; H01Q 21/0043; H01Q 21/065; H01P 3/08
See application file for complete search history.

(56) References Cited

U.S. PATENT DOCUMENTS 6,567,053 B1 5/2003 Yablonovitch et al.
6,677,915 B1 1/2004 Yablonovitch et al.
(Continued)

FOREIGN PATENT DOCUMENTS

JP 2005-68233 A 3/2005
JP 2005-110273 A 4/2005
(Continued)

OTHER PUBLICATIONS

Wei Liu et al., Metamaterial-Based Wideband Shorting-Wall Loaded Mushroom Array Antenna, Apr. 13-17, 2015, The 2015 9th European Conference on Antennas and Propagation (EuCAP), Portugal, 5pp.

(Continued)

*Primary Examiner* — Dieu Hien T Duong
(74) *Attorney, Agent, or Firm* — Hauptman Ham, LLP

(57) ABSTRACT

ABSTRACT
One example of embodiments of the present disclosure includes a structure. The structure includes first pair conductors and at least one unit structure. The first pair conductors are separated from each other in a first direction. The unit structure is positioned between the first pair conductors. The unit structure includes a second conductor and a third conductor. The unit structure includes at least one unit resonator. The third conductor extends in an xy plane
(Continued)

including an x direction. The third conductor is electrically connected to the first pair conductors. The third conductor is configured as a reference potential of the structure. The unit resonator overlaps with the third conductor in a z direction intersecting with the xy plane. The unit resonator is configured to uses the third conductor as the reference potential.

20 Claims, 69 Drawing Sheets

(30) Foreign Application Priority Data

| | | |
|---|---|---|
| Jul. 21, 2017 | (JP) | 2017-141559 |
| Oct. 6, 2017 | (JP) | 2017-196071 |
| Oct. 6, 2017 | (JP) | 2017-196072 |
| Oct. 6, 2017 | (JP) | 2017-196073 |
| Dec. 22, 2017 | (JP) | 2017-246894 |
| Dec. 22, 2017 | (JP) | 2017-246895 |
| Dec. 22, 2017 | (JP) | 2017-246896 |
| Dec. 22, 2017 | (JP) | 2017-246897 |
| Jan. 19, 2018 | (JP) | 2018-007246 |
| Jan. 19, 2018 | (JP) | 2018-007247 |
| Jan. 19, 2018 | (JP) | 2018-007248 |
| Feb. 16, 2018 | (JP) | 2018-025715 |

(51) Int. Cl.

| | |
|---|---|
| ***H01Q 9/04*** | (2006.01) |
| ***H01P 3/08*** | (2006.01) |
| ***H01Q 21/00*** | (2006.01) |
| ***H01Q 21/06*** | (2006.01) |

(56) References Cited

U.S. PATENT DOCUMENTS

| | | | | |
|---|---|---|---|---|
| 7,145,518 | B2 | 12/2006 | Tanaka et al. | |
| 7,330,161 | B2 | 2/2008 | Matsugatani et al. | |
| 8,026,854 | B2 | 9/2011 | Sanada | |
| 8,537,070 | B2 | 9/2013 | Kai et al. | |
| 9,013,068 | B2 | 4/2015 | Ryu et al. | |
| 9,385,428 | B2 | 7/2016 | Toyao et al. | |
| 9,502,761 | B2 | 11/2016 | Itoh et al. | |
| 10,089,573 | B2 | 10/2018 | Sugimura et al. | |
| 10,243,253 | B2 | 3/2019 | Kasahara | |
| 10,339,437 | B2 | 7/2019 | Sugimura et al. | |
| 2002/0008665 | A1 | 1/2002 | Takenoshita | |
| 2005/0068233 | A1 | 3/2005 | Tanaka et al. | |
| 2007/0075903 | A1 | 4/2007 | Matsugatani et al. | |
| 2007/0273588 | A1* | 11/2007 | Kim | H01Q 9/0407 343/700 MS |
| 2008/0158069 | A1* | 7/2008 | Mateus Mendes | H01Q 1/38 343/700 MS |
| 2009/0174609 | A1 | 7/2009 | Sanada | |
| 2010/0159857 | A1* | 6/2010 | Kling | H01Q 1/243 455/127.1 |
| 2010/0277374 | A1 | 11/2010 | Ju et al. | |
| 2011/0156492 | A1 | 6/2011 | Ryu et al. | |
| 2012/0013469 | A1 | 1/2012 | Kai et al. | |
| 2012/0056787 | A1 | 3/2012 | Tatarnikov et al. | |
| 2013/0002377 | A1 | 1/2013 | Toyao et al. | |
| 2016/0190704 | A1* | 6/2016 | Celik | H01Q 15/0086 343/700 MS |
| 2016/0276733 | A1 | 9/2016 | Kasahara | |
| 2016/0276751 | A1 | 9/2016 | Ueda | |
| 2018/0032853 | A1 | 2/2018 | Sugimura et al. | |
| 2018/0159203 | A1* | 6/2018 | Baks | H01Q 1/2283 |
| 2018/0357524 | A1 | 12/2018 | Sugimura et al. | |

FOREIGN PATENT DOCUMENTS

| | | | |
|---|---|---|---|
| JP | 200759966 | A | 3/2007 |
| JP | 2007-104211 | A | 4/2007 |
| JP | 2010-183547 | A | 8/2010 |
| JP | 2013-516830 | A | 5/2013 |
| JP | 5459126 | B2 | 4/2014 |
| WO | 2008/007545 | A1 | 1/2008 |
| WO | 2011/081466 | A2 | 7/2011 |
| WO | 2011/114746 | A1 | 9/2011 |
| WO | 2012/177946 | A2 | 12/2012 |
| WO | 2015/068430 | A1 | 5/2015 |
| WO | 2016/129542 | A1 | 8/2016 |

OTHER PUBLICATIONS

Wei Liu et al., Mode Analysis and Experimental Verification of Shorting-Wall Loaded Mashroom Antenna, Dec. 5-9, 2016, Proceedings of the Asia-Pacific Microwave Conference 2016, India, 5pp.

Zhi Ning Chen et al., Low-Profile Broadband Mushroom and Metasurface Antennas, Mar. 1-3, 2017, 2017 International Workshop on Antenna Technology: Small Antennas, Innovative Structures, and Applications (iWAT), Greece, 6pp.

Yasutaka Murakami et al., Low-Profile Design and Bandwidth Characteristics of Artificial Magnetic Conductor with Dielectric Substrate, 2015, 172-179, vol. J98-B No. 2, IEEE, Japan, 8pp.

Yasutaka Murakami et al., Optimum Configuration of Reflector for Dipole Antenna with AMC Reflector, 2015, 1212-1220, vol. 98-B No. 11, IEEE, 9pp.

Jae-Gon Lee et al., "SAR Reduction Using Integration of PIFA and AMC Structure for Pentaband Mobile Terminals", International Journal of Antennas and Propagation, p. 1-7, vol. 2017, Article ID 6196721, 7pp.

* cited by examiner

FIG. 30
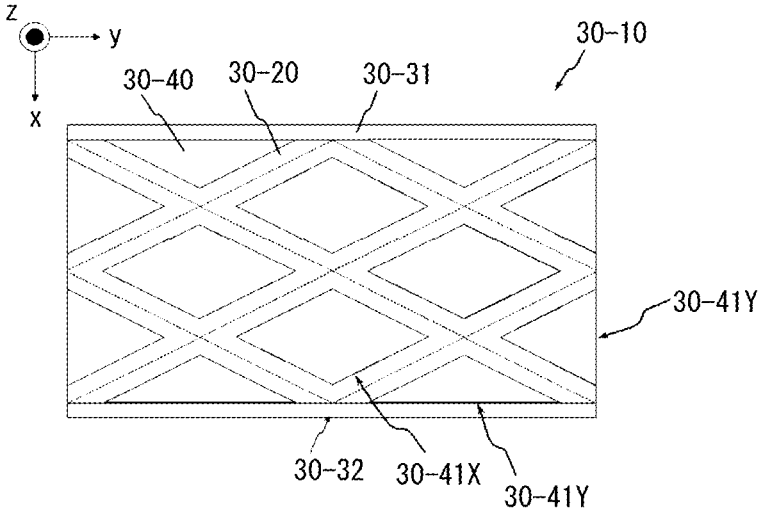
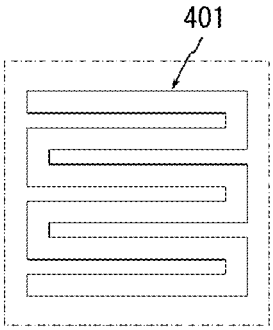
FIG. 31A
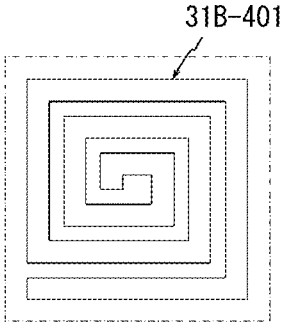
FIG. 31B

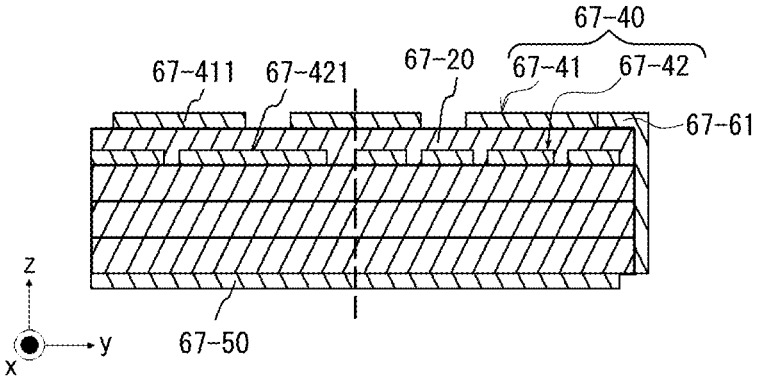
FIG. 68
FIG. 69
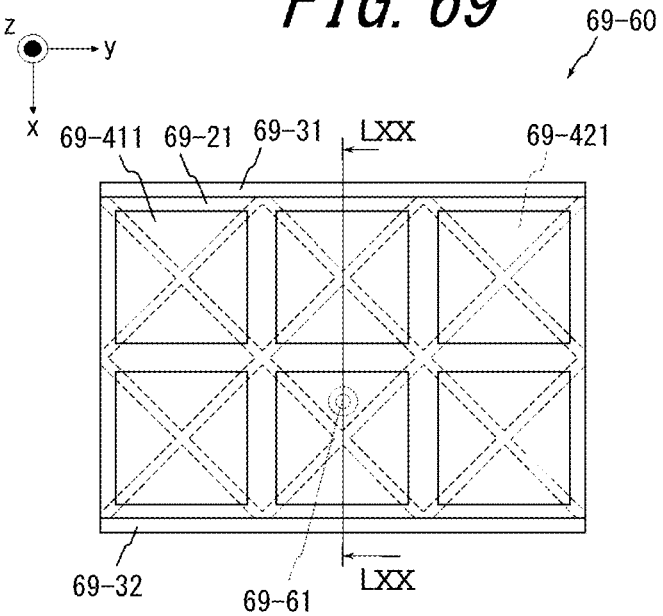
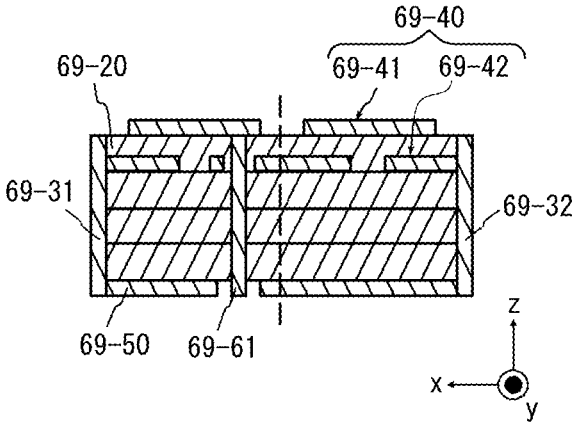
FIG. 70

STRUCTURE, ANTENNA, WIRELESS COMMUNICATION MODULE, AND WIRELESS COMMUNICATION DEVICE

CROSS REFERENCE TO RELATED APPLICATIONS

This is a continuation application of U.S. patent application Ser. No. 16/458,186, filed on Jun. 30, 2019, which claims priority to and the benefit of Japanese Patent Applications No. 2017-054719 (filed on Mar. 21, 2017), No. 2017-141558 (filed on Jul. 21, 2017), No. 2017-141559 (filed on Jul. 21, 2017), No. 2017-196071 (filed on Oct. 6, 2017), No. 2017-196073 (filed on Oct. 6, 2017), No. 2017-196072 (filed on Oct. 6, 2017), No. 2017-246897 (filed on Dec. 22, 2017), No. 2017-246896 (filed on Dec. 22, 2017), No. 2017-246895 (filed on Dec. 22, 2017), No. 2017-246894 (filed on Dec. 22, 2017), No. 2018-007246 (filed on Jan. 19, 2018), No. 2018-007247 (filed on Jan. 19, 2018), No. 2018-007248 (filed on Jan. 19, 2018), and No. 2018-025715 (filed on Feb. 16, 2018), the entire contents of which are incorporated herein by reference.

TECHNICAL FIELD

The present disclosure relates to a structure configured to resonate at a certain frequency, an antenna that includes the structure, a wireless communication module, and a wireless communication device.

BACKGROUND

Electromagnetic waves radiated from an antenna are reflected by a metal conductor. The electromagnetic waves reflected by the metal conductor generate a phase shift of 180°. The reflected waves are synthetized with electromagnetic waves radiated from the antenna. The electromagnetic waves radiated from the antenna may reduce in amplitude when synthetized with a phase shifted electromagnetic waves. As a result, the amplitude of the electromagnetic waves radiated from the antenna decreases. By setting a distance between the antenna and the metal conductor to ¼ of a wavelength λ of the electromagnetic waves to be radiated, the influence of the reflected waves is reduced.

On the other hand, technologies to reduce the influence of the reflected waves by using an artificial magnetic conductor are suggested. Such technologies are described in, for example, Non-Patent Documents 1 and 2.

CITATION LIST

Patent Literature

Non-Patent Document 1: Murakami et al., "Low-profile design and bandwidth characteristics of artificial magnetic conductor using dielectric substrate" IEICE (B), Vol. J98-B No. 2, pp. 172-179

Non-Patent Document 2: Murakami et al., "Optimized configuration of reflector for dipole antenna with AMC reflection board" IEICE (B), Vol. J98-B No. 11, pp. 1212-1220

SUMMARY

A structure according to an embodiment of the present disclosure includes a pair conductors and at least one unit structure. The pair conductors are separated from each other in a first direction. The unit structure is positioned between the pair conductors. The unit structure includes a ground conductor and at least one part of a resonator. The ground conductor extends in a first plane including the first direction. The ground conductor is electrically connected to the pair conductors. The ground conductor is an electric potential standard of the structure. The resonator overlaps with the ground conductor in a second direction intersecting with the first plane. The resonator is configured to use the ground conductor as the electric potential standard.

An antenna according to an embodiment of the present disclosure includes the structure described above and a feeding line. The feeding line is electrically connected to at least one resonator.

An antenna according to an embodiment of the present disclosure includes the structure described above and a feeding layer. The feeding layer overlaps with the resonator.

A structure according to an embodiment of the present disclosure includes a unit structure and a pair conductors. The unit structure is configured to resonate at a first frequency. The pair conductors are positioned on both sides of group of the unit structures in a first direction. The pair conductors are configured as electric conductors as viewed from the structure.

An antenna according to an embodiment of the present disclosure includes an antenna element, at least one unit structure, and a pair conductors. The antenna element is configured to radiate electromagnetic waves of a first frequency. The unit structure is positioned overlapping with the antenna element. The unit structure is configured to demonstrate a magnetic conductor character to the first frequency. The pair conductors are positioned on both sides of group of the unit structures in a first direction.

A wireless communication module according to an embodiment of the present disclosure includes the antenna element described above and an RF module. The RF module is electrically connected to the antenna element.

A wireless communication device according to an embodiment of the present disclosure includes the wireless communication module described above and a battery. The battery is configured to supply power to the wireless communication module.

BRIEF DESCRIPTION OF THE DRAWINGS

In the accompanying drawings:

FIG. 30 is a plan view illustrating an embodiment of a resonator;

FIG. 31A is a schematic diagram illustrating an example of a resonator;

FIG. 31B is a schematic diagram illustrating an example of a resonator;

FIG. 68 is a cross-sectional diagram of the antenna illustrated in FIG. 67;

FIG. 69 is a plan view illustrating an embodiment of an antenna;

FIG. 70 is a cross-sectional diagram of the antenna illustrated in FIG. 69;

FIG. 96 is a perspective view illustrating an embodiment of a wireless communication device;

FIG. 97A is a side view of the wireless communication device illustrated in FIG. 96;

FIG. 97B is a cross-sectional diagram of the wireless communication device illustrated in FIG. 97A;

FIG. 98 is a perspective view illustrating an embodiment of a wireless communication device;

FIG. 99 is a cross-sectional diagram of the wireless communication device illustrated in FIG. 98;

FIG. 100 is a perspective view illustrating an embodiment of a wireless communication device;

FIG. 101 is a cross-sectional diagram illustrating an embodiment of a resonator;

FIG. 102 is a plan view illustrating an embodiment of a resonator;

FIG. 103 is a plan view illustrating an embodiment of a resonator;

FIG. 104 is a cross-sectional diagram of the resonator illustrated in FIG. 103;

FIG. 105 is a plan view illustrating an embodiment of a resonator;

FIG. 106 is a plan view illustrating an embodiment of a resonator;

Figure 106:
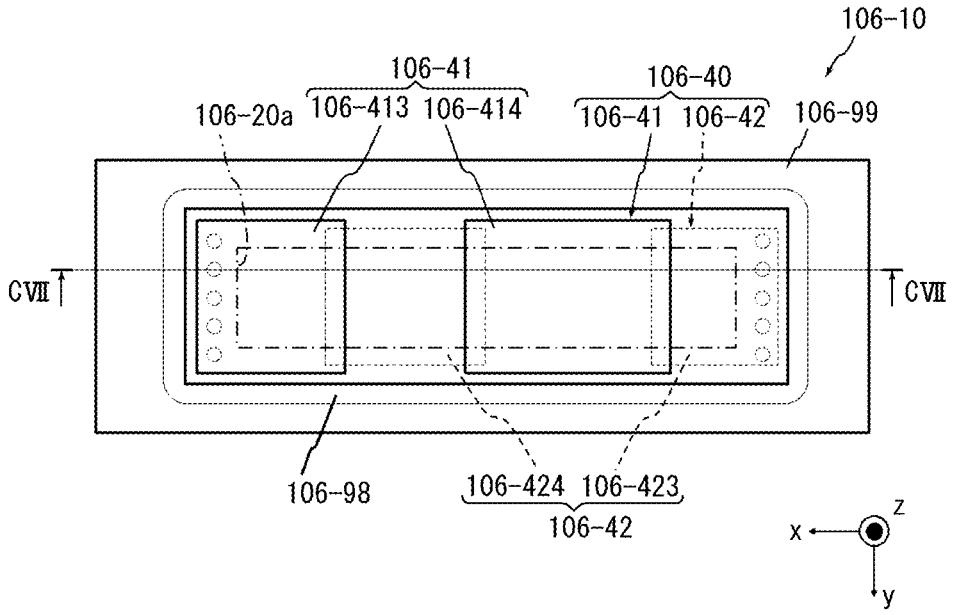
Figure 107:
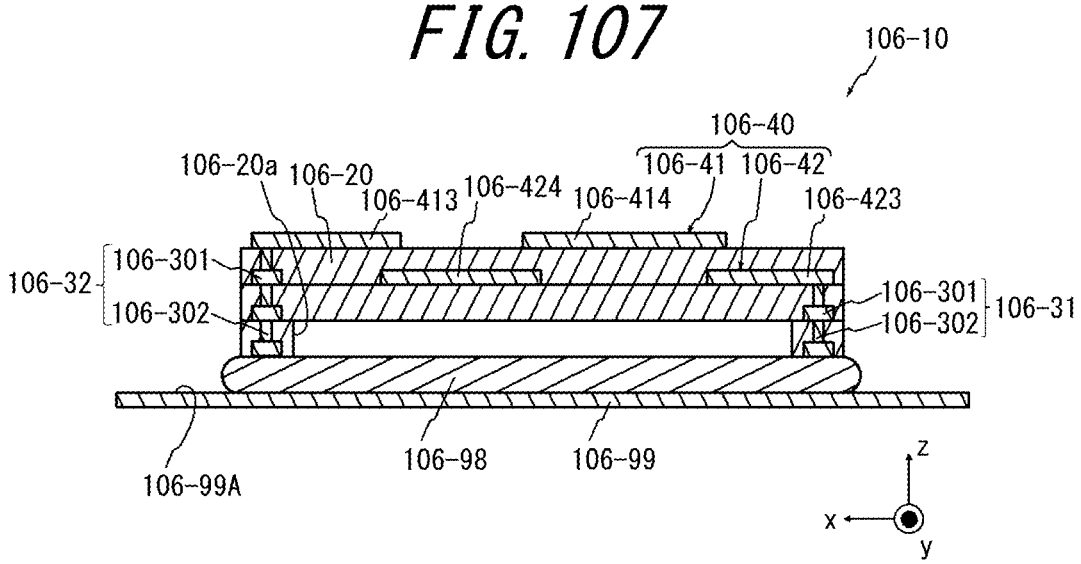
Figure 108:
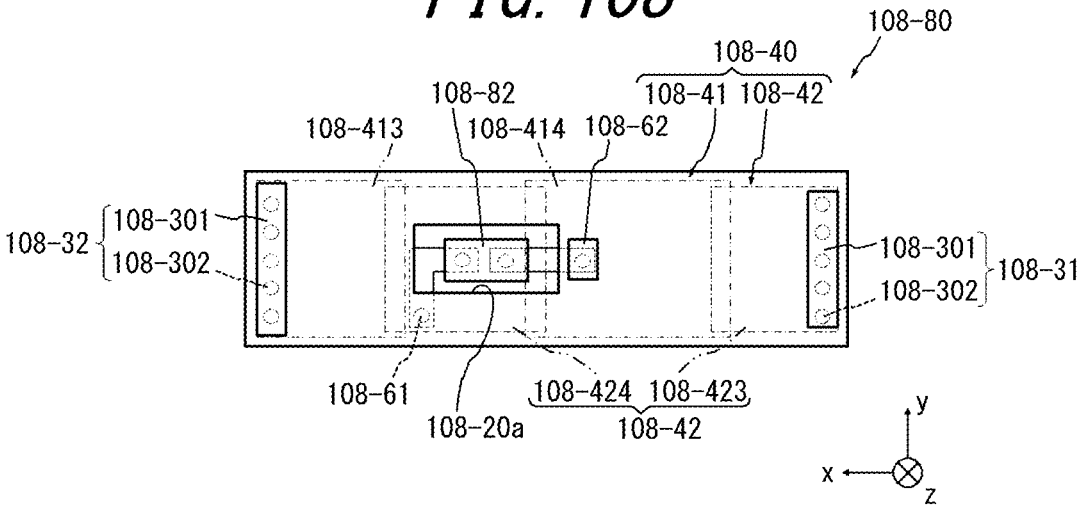
Figure 109:
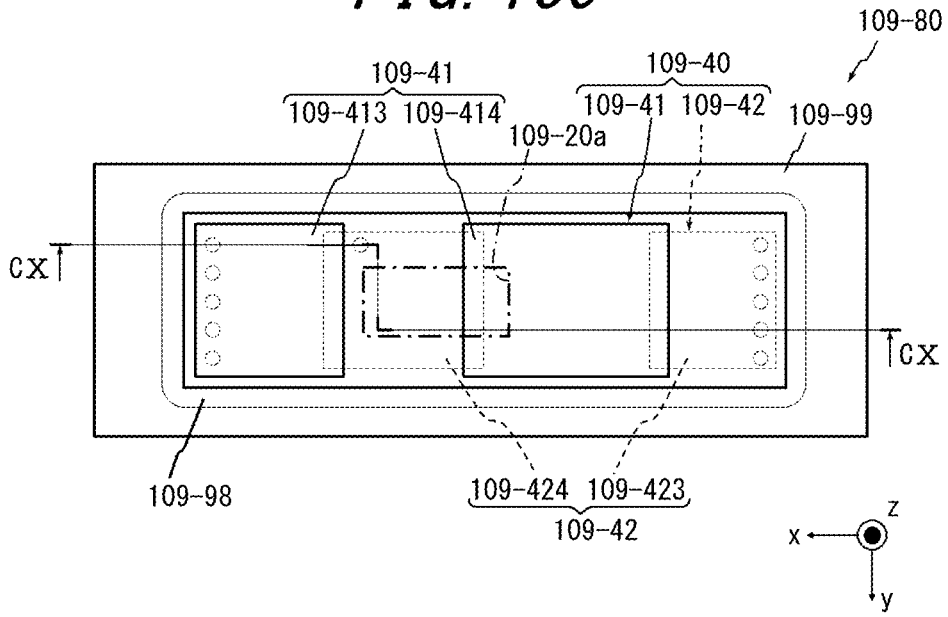
Figure 110:
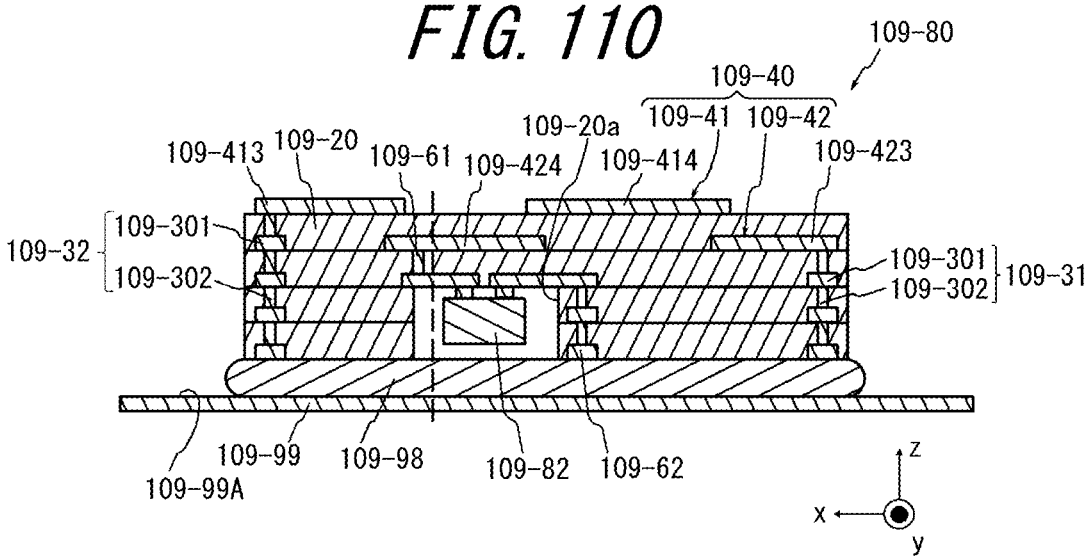
Figure 111:
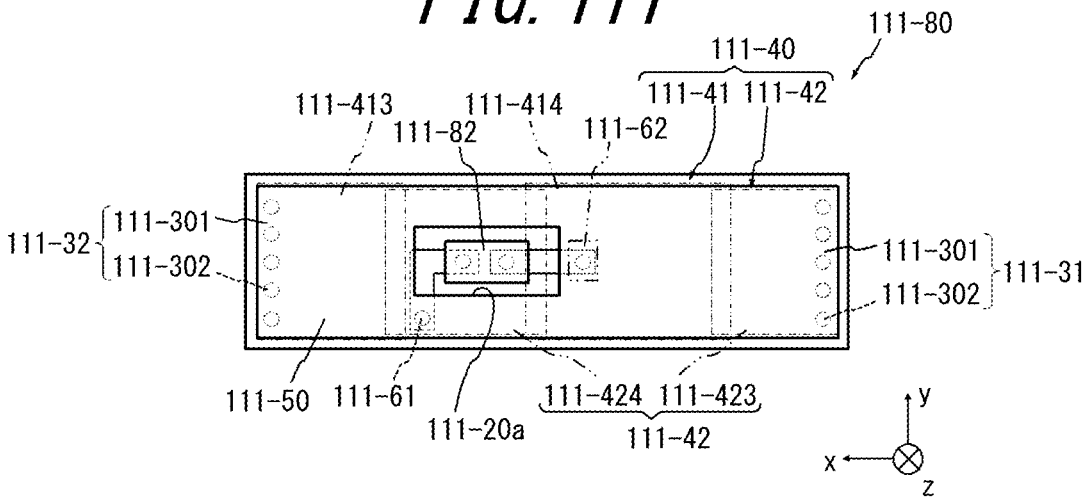
Figure 112:
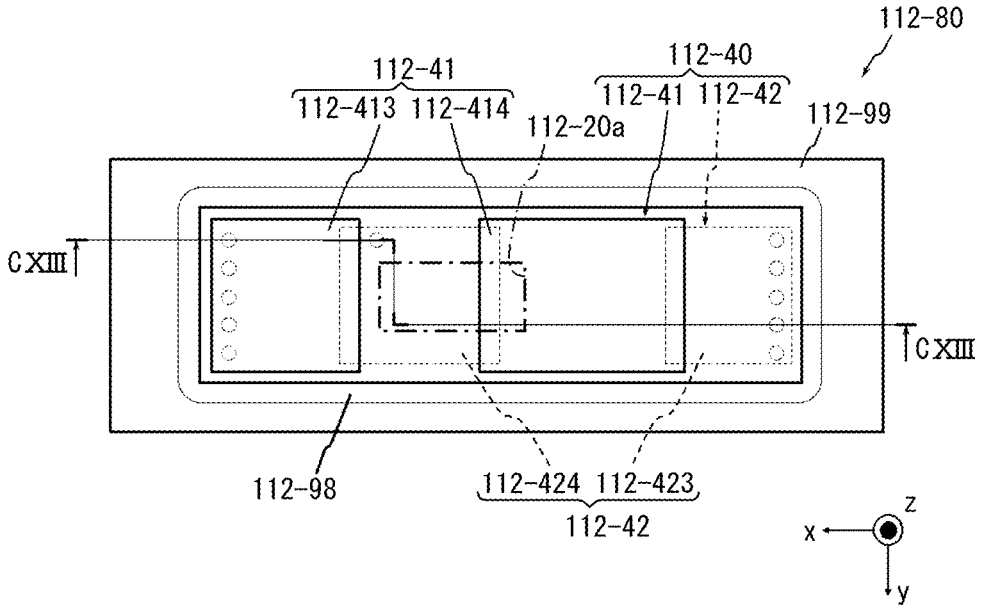
Figure 113:
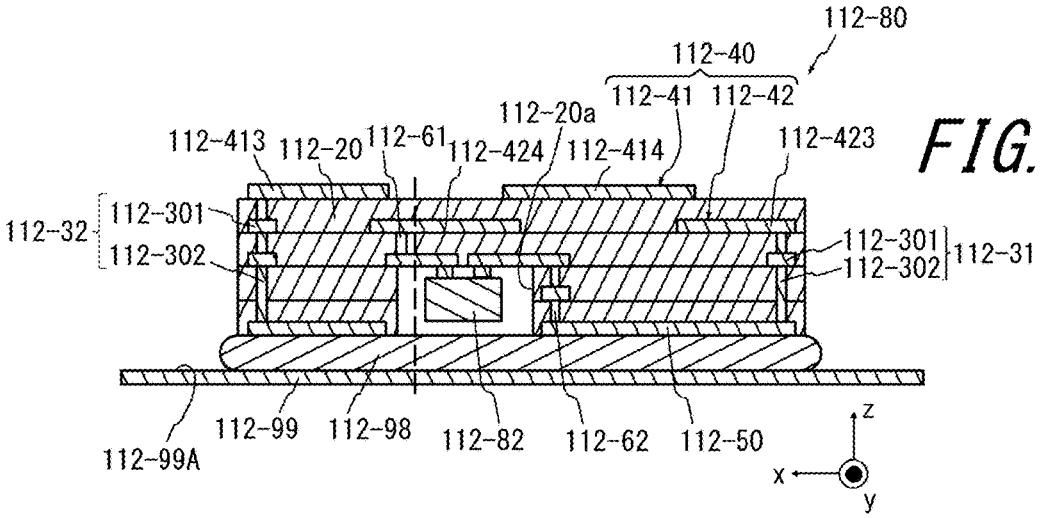
Figure 114:
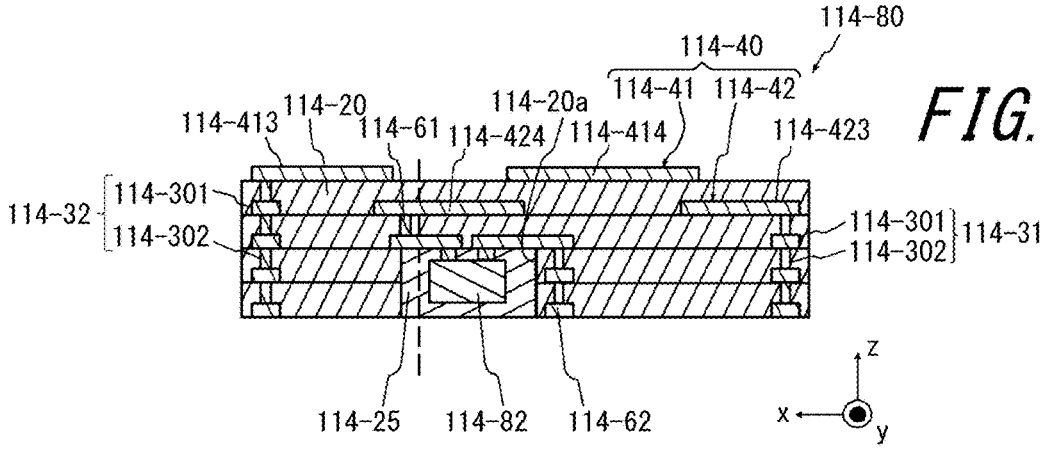
Figure 115:
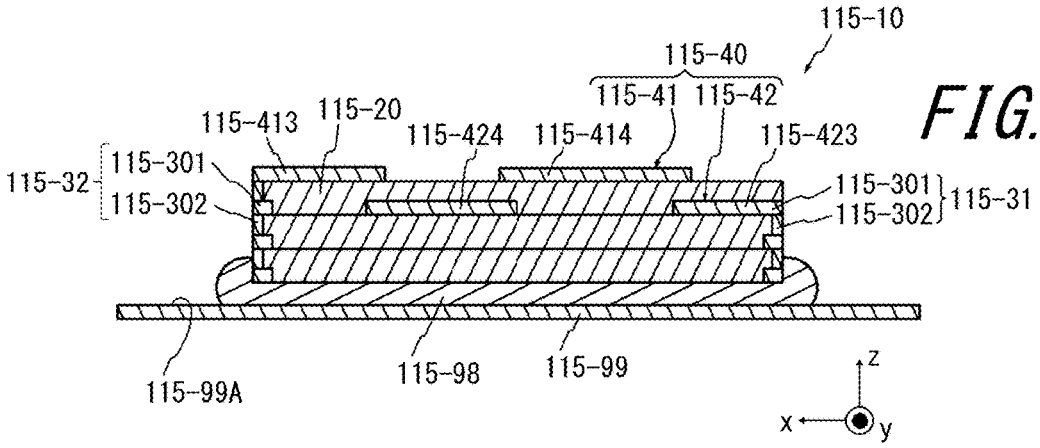
Figure 116:
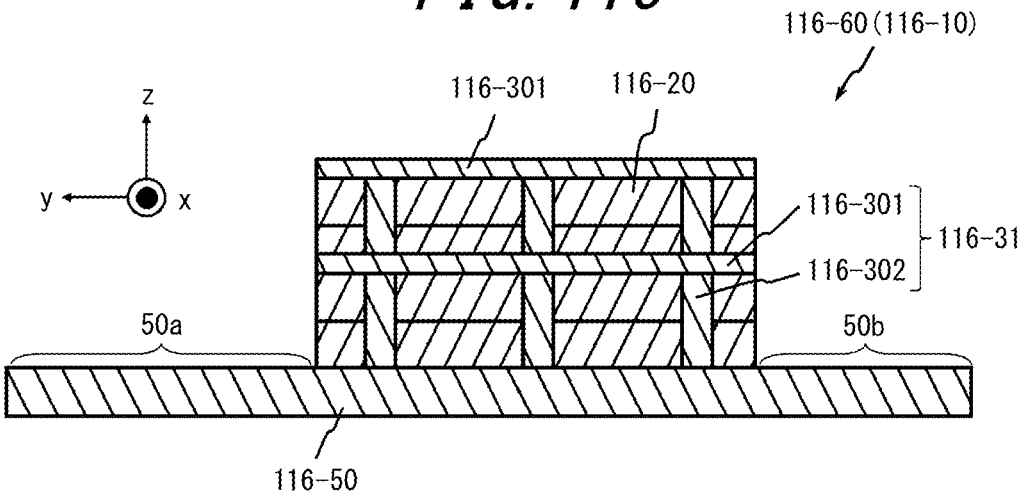
Figure 117:
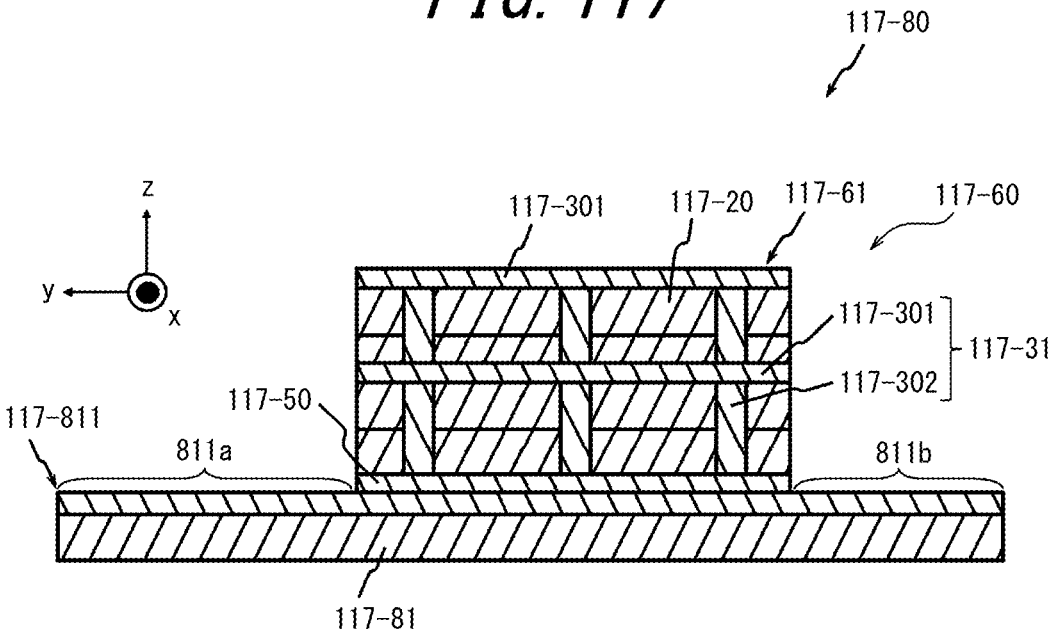
Figure 118:
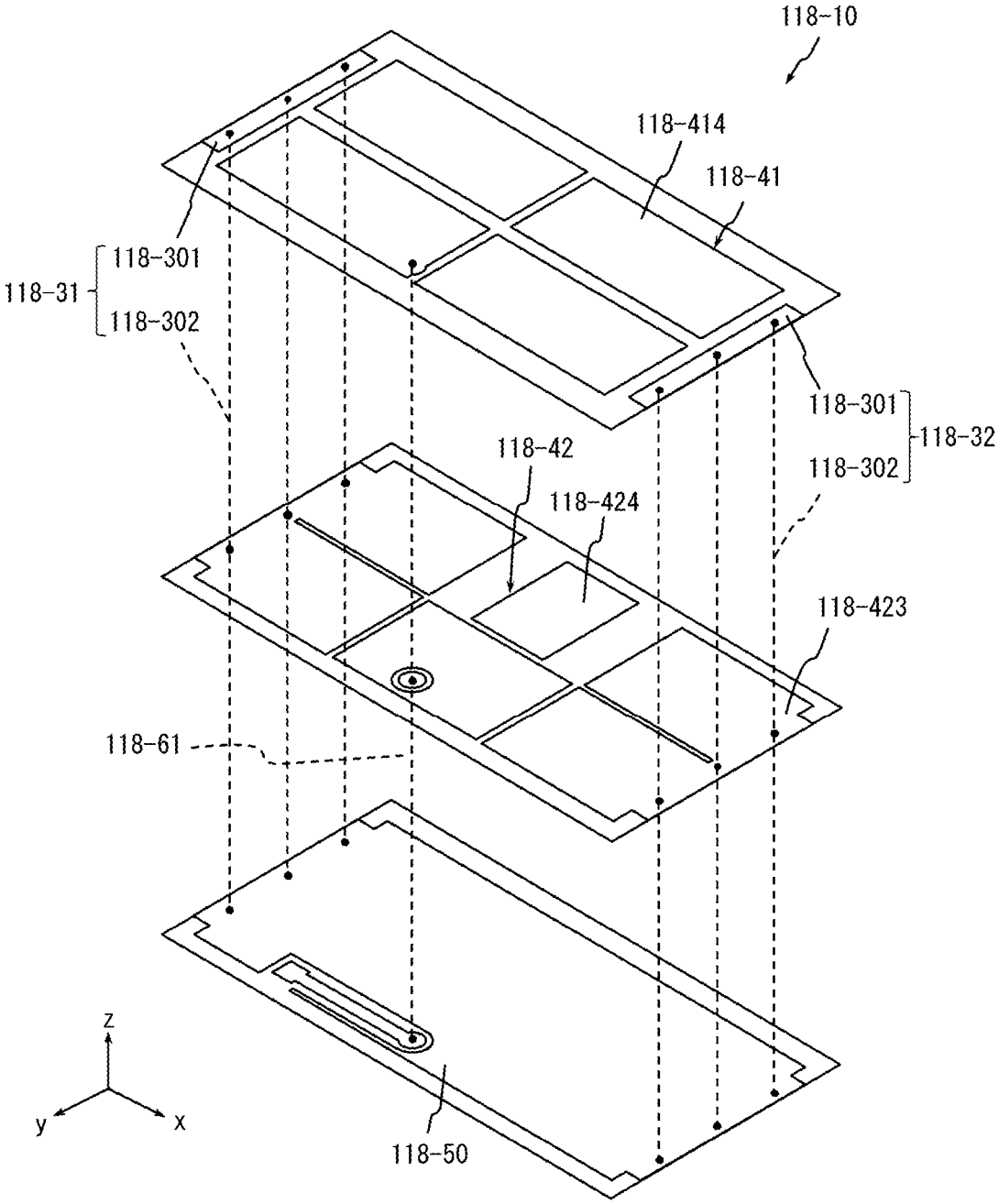
Figure 119:
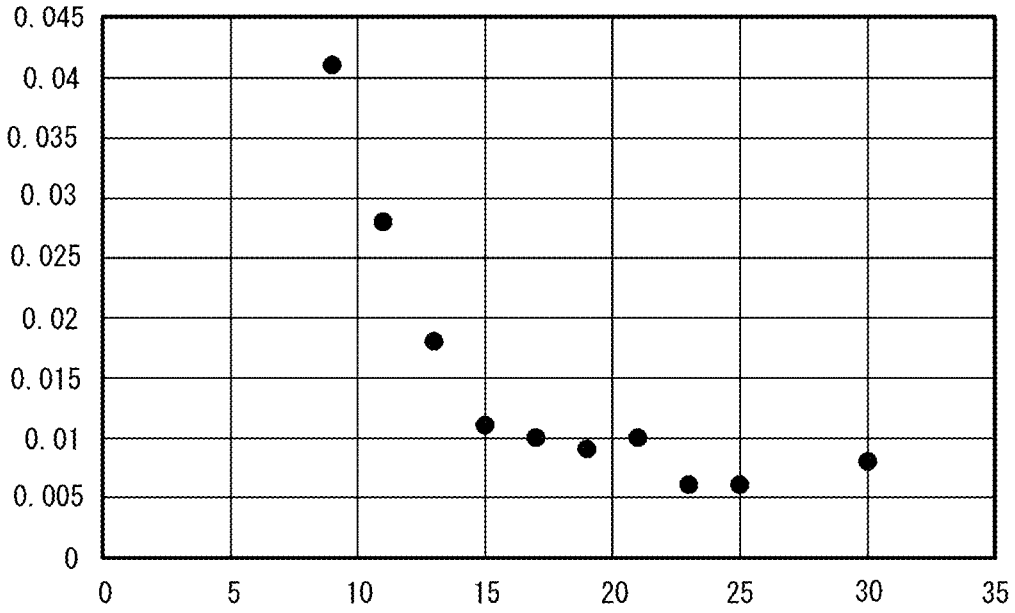
Figure 120:
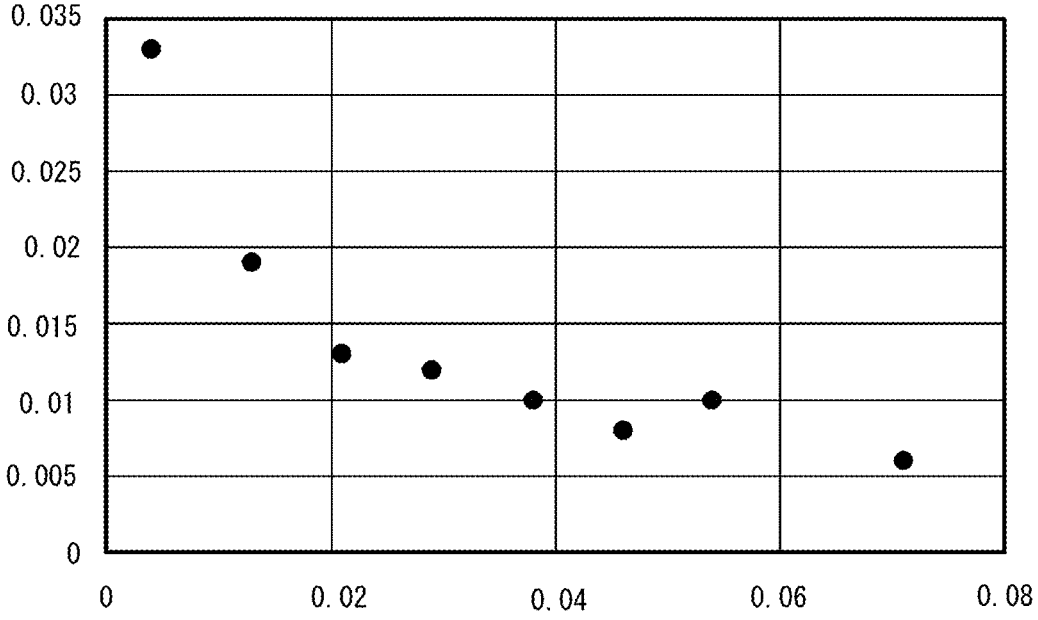

FIG. 107 is a cross-sectional diagram of the resonator illustrated in FIG. 106;

FIG. 108 is a plan view illustrating an embodiment of a wireless communication module;

FIG. 109 is a plan view illustrating an embodiment of a wireless communication module;

FIG. 110 is a cross-sectional diagram of the wireless communication module illustrated in FIG. 109;

FIG. 111 is a plan view illustrating an embodiment of a wireless communication module;

FIG. 112 is a plan view illustrating an embodiment of a wireless communication module;

FIG. 113 is a cross-sectional diagram of the wireless communication module illustrated in FIG. 112;

FIG. 114 is a cross-sectional diagram illustrating an embodiment of a wireless communication module;

FIG. 115 is a cross-sectional diagram illustrating an embodiment of a resonator;

FIG. 116 is a cross-sectional diagram illustrating an embodiment of a resonance structure;

FIG. 117 is a cross-sectional diagram illustrating an embodiment of a resonance structure;

FIG. 118 is a perspective view illustrating a conductor shape of a first antenna employed in a simulation;

FIG. 119 is a graph corresponding to the results shown in Table 1;

FIG. 120 is a graph corresponding to the results shown in Table 2; and

Figure 121:
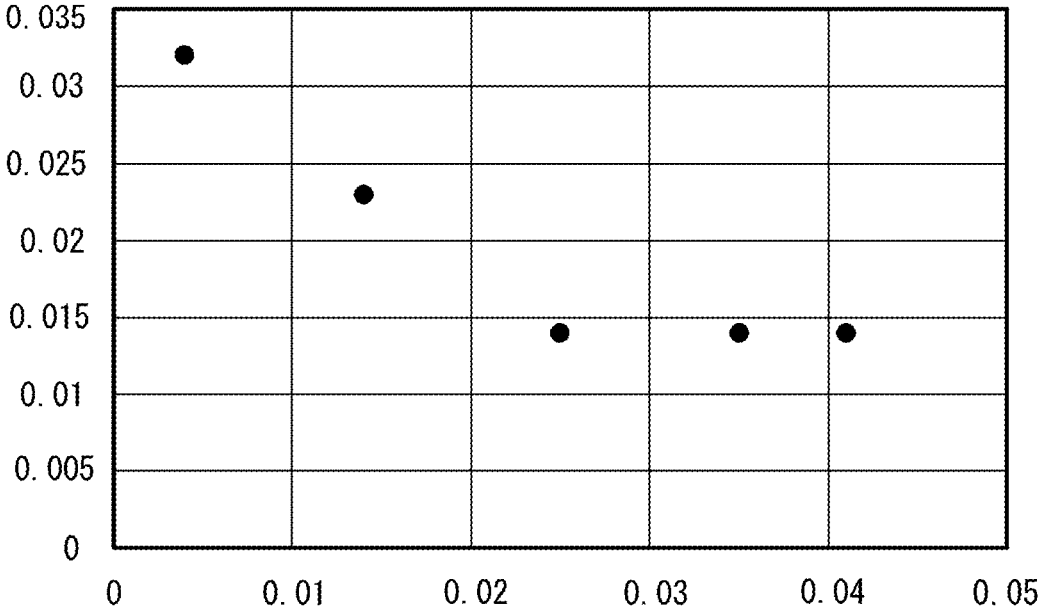

FIG. 121 is a graph corresponding to the results shown in Table 3.

DETAILED DESCRIPTION

Figure 1:
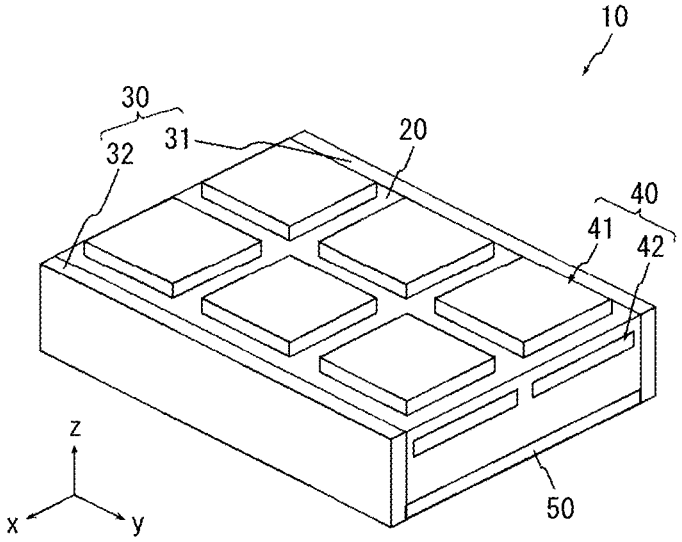
FIG. 1 is a perspective view illustrating an embodiment of a resonator.
Figure 64:
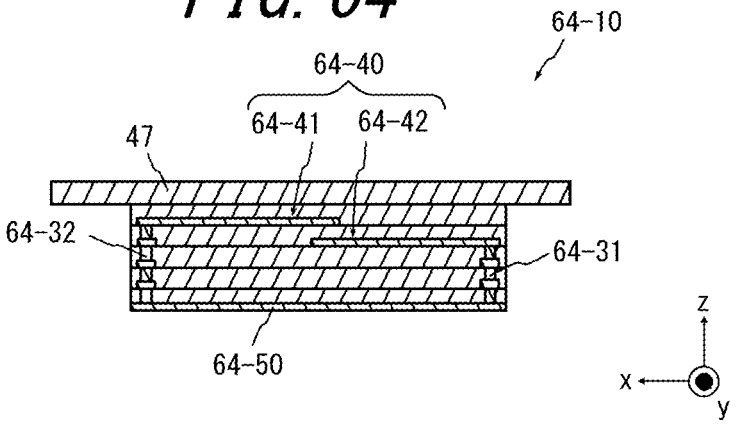
FIG. 64 is a cross-sectional diagram illustrating an embodiment of a resonator.

Embodiments of the present disclosure will be described below. In FIG. 1 to FIG. 115, a constituent element corresponding to another constituent element already illustrated in a figure is denoted with a reference sign made up of a figure number as a prefix followed by a reference code common to that of the constituent element already illustrated. A resonance structure may include a resonator. The resonance structure may be integrally realized by combining a resonator and another member. Hereinafter, when the constituent elements illustrated in FIG. 1 to FIG. 64 are not distinguished from one another, the constituent elements will be described using common codes. A resonator 10 illustrated in FIG. 1 to FIG. 64 includes a base 20, pair conductors 30, a third conductor 40, and a fourth conductor 50. The base 20 is in contact with the pair conductors 30, the third conductor 40, and the fourth conductor 50. In the resonator 10, the pair conductors 30, the third conductor 40, and the fourth conductor 50 are configured to function as a resonator. The resonator 10 may be configured to resonate at multiple resonant frequencies. One of the resonant frequencies of the resonator 10 will be referred to as a first frequency $f_1$. The wavelength of the first frequency $f_1$ is $\lambda_1$. The resonator 10 may have at least one of the resonant frequencies as an operating frequency. The resonator 10 has the first frequency $f_1$ as the operating frequency.

The base 20 may include a ceramic material or any resin material as a composition. The ceramic material includes an aluminum oxide sintered body, an aluminum nitride sintered body, a mullite sintered body, a glass ceramic sintered compact, a crystallized glass in which a crystalline component is precipitated in the glass base material, mica, or a microcrystalline sintered body such as aluminum titanate. The resin material includes epoxy resins, polyester resins, polyimide resins, polyamideimide resins, polyetherimide resins, and those obtained by curing uncured materials such as a liquid crystal polymer.

The pair conductors 30, the third conductor 40, and the fourth conductor 50 may contain any one of a metallic material, an alloy of a metal material, a cured product of a metal paste, and a conductive polymer as a composition. The pair conductors 30, the third conductor 40, and the fourth conductor 50 may be made of the same material. Each of the pair conductors 30, the third conductor 40, and the fourth conductor 50 may be made of a different material. Any combination of the pair conductors 30, the third conductor 40, and the fourth conductor 50 may be made of the same material. The metallic material includes copper, silver, palladium, gold, platinum, aluminum, chromium, nickel, cadmium lead, selenium, manganese, tin, vanadium, lithium, cobalt, or titanium. The alloy includes metal materials. The metal paste includes those obtained by kneading metal powder together with an organic solvent and a binder. The binder includes epoxy resins, polyester resins, polyimide resins, polyamide-imide resins, or polyether-imide resins. The conductive polymer includes polythiophene polymers, polyacetylene polymers, polyanilin polymers, polypyrrole polymers, or the like.

The resonator 10 includes two pair conductors 30. The pair conductors 30 include conductors. The pair conductors 30 include a first conductor 31 and a second conductor 32. The pair conductors 30 may include three or more conductors. Each of the conductors of the pair conductors 30 are separated from one another in a first direction. Each of the conductors of the pair conductors 30 may be paired with another conductor. Each of the conductors of the pair conductors 30 may be configured as an electric conductor for resonators between paired conductors. The first conductor 31 is separated from the second conductor 32 in the first direction. Each of the first conductor 31 and the second conductor 32 extends in a second plane that intersects with the first direction.

In the present disclosure, the first direction is referred to as an x direction. In the present disclosure, a third direction is referred to as a y direction. In the present disclosure, a second direction is referred to as a z direction. In the present disclosure, the first plane is referred to as an xy plane. In the present disclosure, the second plane is referred to as an yz plane. In the present disclosure, a third plane is referred to as a zx plane. Note that these planes are planes in the coordinate space and does not indicate specific planes or specific surfaces. In the present disclosure, a surface integral in the xy plane may be referred to as a first surface integral. In the present disclosure, a surface integral in the yz plane may be referred to as a second surface integral. In the present disclosure, a surface integral in the zx plane may be referred to as a third surface integral. The surface integral may be expressed in a unit such as a square meter. In the present disclosure, a length in the x direction may be referred to simply as "length". In the present disclosure, a length in the y direction may be referred to simply as "width". In the present disclosure, a length in the z direction may be referred to simply as "height".

In one example, the first conductor 31 and the second conductor 32 are positioned at both edge parts of the base 20 in the x direction. Each of the first conductor 31 and the second conductor 32 may have a portion being separated from an outside of the base 20. Each of the first conductor 31 and the second conductor 32 may have a portion positioned within the base 20 and another portion positioned outside of the base 20. Each of the first conductor 31 and the second conductor 32 may be positioned within the base 20.

The third conductor 40 is configured to function as a resonator. The third conductor 40 may include at least one of a line-type resonator, a patch-type resonator, and a slot-type resonator. In one example, the third conductor 40 is positioned on the base 20. In one example, the third conductor 40 is positioned at the edge of the base 20 in the z direction. In one example, the third conductor 40 may be positioned within the base 20. The third conductor 40 may have a portion positioned within the base 20 and another portion positioned outside of the base 20. The third conductor 40 may have a surface of a portion being separated from outside of the base 20.

The third conductor 40 includes at least one electrically conductive body. The third conductor 40 may include electrically conductive bodies. When the third conductor 40 includes electrically conductive bodies, the third conductor 40 may be referred to as a third conductor group. The third conductor 40 includes at least one conductive layer. In the third conductor 40, one conductive layer includes at least one electrically conductive body. The third conductor 40 may include conductive layers. For example, the third conductor 40 may include three or more conductive layers. In the third conductor 40, each of the conductive layers includes at least one electrically conductive body. The third conductor 40 extends in the xy plane. The xy plane includes the x direction. Each of the conductive layers of the third conductor 40 extends in the xy plane.

In one example of embodiments, the third conductor 40 includes a first conductive layer 41 and a second conductive layer 42. The first conductive layer 41 extends in the xy plane. The first conductive layer 41 may be positioned on the base 20. The second conductive layer 42 extends in the xy plane. The second conductive layer 42 may be configured to capacitively couple to the first conductive layer 41. The second conductive layer 42 may be electrically connected to the first conductive layer 41. Two conductive layers with capacitive coupling may be opposite each other in the y direction. Two conductive layers with capacitive coupling may be opposite each other in the x direction. Two conductive layers with capacitive coupling may be opposite each other in the first plane. Two conductive layers being separated from each other in the first plane can be paraphrased as two electrically conductive bodies in one conductive layer. The second conductive layer 42 may be positioned at least partially overlapping with the first conductive layer 41 in the z direction. The second conductive layer 42 may be positioned within the base 20.

The fourth conductor 50 is separated from the third conductor 40. The fourth conductor 50 is electrically connected to the first conductor 31 and the second conductor 32 of the pair conductors 30. The fourth conductor 50 is electrically connected to the first conductor 31 and the second conductor 32. The fourth conductor 50 extends in the third conductor 40. The fourth conductor 50 extends in the first plane. The fourth conductor 50 extends from the first conductor 31 to the second conductor 32. The fourth conductor 50 is positioned on the base 20. The fourth conductor 50 may be positioned within the base 20. The fourth conductor 50 may have a portion positioned within the base 20 and another portion positioned outside of the base 20. The fourth conductor 50 may have a surface of a portion being separated from outside of the base 20.

In one example of embodiments, the fourth conductor 50 may be configured to function as a ground conductor of the resonator 10. The fourth conductor 50 may be an electric potential standard of the resonator 10. The fourth conductor 50 may be connected to the ground of the device that includes the resonator 10.

In one example of embodiments, the resonator 10 may include a fourth conductor 50 and a reference potential layer 51. The reference potential layer 51 is separated from the fourth conductor 50 in the z direction. The reference potential layer 51 is electrically insulated from the fourth conductor 50. The reference potential layer 51 may be a reference potential of the resonator 10. The reference potential layer 51 may be electrically connected to the ground of the device that includes the resonator 10. The fourth conductor 50 may be electrically separated from the ground of the device that includes the resonator 10. The reference potential layer 51 is opposite with the third conductor 40 or the fourth conductor 50 in the z direction.

In one example of embodiments, the reference potential layer 51 is opposite with the third conductor 40 over through the fourth conductor 50. The fourth conductor 50 is positioned between the third conductor 40 and the reference potential layer 51. The spacing between the reference potential layer 51 and the fourth conductor 50 is narrower than the spacing between the third conductor 40 and fourth conductor 50.

In the resonator 10 that includes the reference potential layer 51, the fourth conductor 50 may include one or more electrically conductive bodies. In the resonator 10 that includes the reference potential layer 51, the fourth conductor 50 includes one or more electrically conductive bodies, and the third conductor 40 may be one electrically conductive body connected to the pair conductors 30. In the resonator 10 that includes the reference potential layer 51, each of the third conductor 40 and fourth conductor 50 may include at least one resonator.

In the resonator 10 that includes the reference potential layer 51, the fourth conductor 50 may include conductive layers. For example, the fourth conductor 50 may include a third conductive layer 52 and a fourth conductive layer 53. The third conductive layer 52 may be configured to capacitively couple to the fourth conductive layer 53. The third conductive layer 52 may be electrically connected to the first conductive layer 41. Two conductive layers of capacitive coupling may be opposite each other in the y direction. Two conductive layers of capacitive coupling may be opposite each other in the x direction. Two conductive layers of capacitive coupling may be opposite each other in the xy plane.

A distance between two conductive layers of capacitive coupling being separated from each other in the z direction is less than a distance between the conductor group and the reference potential layer 51. For example, the distance between the first conductive layer 41 and the second conductive layer 42 is less than the distance between the third conductor 40 and the reference potential layer 51. For example, the distance between the third conductive layer 52 and the fourth conductive layer 53 is less than the distance between the fourth conductor 50 and the reference potential layer 51.

Each of the first conductor 31 and the second conductor 32 may include one or more electrically conductive bodies. Each of the first conductor 31 and the second conductor 32 may be one electrically conductive body. Each of the first conductor 31 and the second conductor 32 may include electrically conductive bodies. Each of the first conductor 31 and the second conductor 32 may include at least one fifth conductive layer 301 and fifth conductors 302. The pair conductors 30 include at least one fifth conductive layer 301 and fifth conductors 302.

The fifth conductive layer 301 extends in the y direction. The fifth conductive layer 301 extends in the xy plane. The fifth conductive layer 301 is an electrically conductive body in the form of a layer. The fifth conductive layer 301 may be positioned on the base 20. The fifth conductive layer 301 may be positioned within the base 20. Fifth conductive layers 301 are separated from one another in the z direction. Fifth conductive layers 301 are arranged in the z direction. Fifth conductive layers 301 partially overlap with one another in the z direction. The fifth conductive layer 301 is electrically connected to Fifth conductors 302. The fifth conductive layer 301 is configured as a connecting conductor configured to connect the fifth conductors 302 together. The fifth conductive layer 301 may be electrically connected to any one of the conductive layers of the third conductor 40. In an embodiment, the fifth conductive layer 301 is electrically connected to the second conductive layer 42. The fifth conductive layer 301 may be integrated with the second conductive layer 42. In an embodiment, the fifth conductive layer 301 may be electrically connected to the fourth conductor 50. The fifth conductive layer 301 may be integrated with the fourth conductor 50.

Each of the fifth conductors 302 extends in the z direction. Fifth conductors 302 are separated from each other in the y direction. A distance between the fifth conductors 302 is equal to or smaller than the wavelength of ½ of $\lambda_1$. When the distance between the fifth conductors 302 electrically connected is equal to or smaller than $\lambda_1/2$, each of the first conductor 31 and the second conductor 32 can reduce the leakage of electromagnetic waves in the resonance frequency band from between the fifth conductors 302. Because the leakage of electromagnetic waves in the resonance frequency band is reduced, the pair conductors 30 can be viewed as the electric conductors from the unit structure. At least one or more of the fifth conductors 302 are electrically connected to the fourth conductor 50. In an embodiment, some of the fifth conductors 302 may electrically connect the fourth conductor 50 and the fifth conductive layer 301 together. In an embodiment, fifth conductors 302 may be electrically connected to the fourth conductor 50 through the fifth conductive layer 301. Some of the fifth conductors 302 may electrically connect one fifth conductive layer 301 and another fifth conductive layer 301 together. The fifth conductor 302 may be usable a via-conductor or a through-hole conductor.

The resonator 10 includes the third conductor 40 that is configured to function as a resonator. The third conductor 40 may be configured to function as an AMC (Artificial Magnetic Conductor). The artificial magnetic conductor may be rephrased as an RIS (Reactive Impedance Surface).

The resonator 10 includes the third conductor 40 that is configured to function as a resonator between two pair conductors 30 being separated from each other in the x direction. The two pair conductors 30 may be viewed as the electric conductors extending in the yz plane from the third conductor 40. In the resonator 10, the ends in the y direction are electrically opened. In the resonator 10, the zx planes at both ends in the y direction seem to be high impedance. The zx plane at the y-direction ends of the resonator 10 may be viewed as a magnetic conductor from the third conductor 40. In the resonator 10, by virtue of being surrounded by two electric conductors and two high-impedance surfaces (magnetic conductors), the resonator of the third conductor 40 has an artificial magnetic conductor character in the z direction. By virtue of being surrounded by two electric conductors and two high-impedance surfaces, the resonator of the third conductor 40 has the artificial magnetic conductor character with a finite value.

According to the "Artificial Magnetic Conductor Character", the phase difference between the incident wave and the reflected wave at the operating frequency becomes 0 degrees. In the resonator 10, the phase difference between the incident wave and the reflected wave at the first frequency $f_1$ becomes 0 degrees. According to the "Artificial Magnetic Conductor Character", the phase difference between the incident wave and the reflected wave in an operating frequency band becomes −90 degrees to +90 degrees. The operating frequency band is a frequency band between a second frequency $f_2$ and a third frequency $f_3$. The second frequency $f_2$ is the frequency in which the phase difference between the incident wave and the reflected wave is +90 degrees. The third frequency $f_3$ is the frequency in which the phase difference between the incident wave and the reflected wave is −90 degrees. The width of the operating frequency band determined on the basis of the second frequency $f_2$ and third frequency $f_3$ may be at least 100 MHz when, for example, the operating frequency is approximately 2.5 GHz. The width of the operating frequency band may be at least 5 MHz when, for example, the operating frequency is approximately 400 MHz.

The operating frequency of the resonator 10 may be different from the resonance frequency of each of the resonators of the third conductor 40. The operating frequency of the resonator 10 may vary depending on the lengths, sizes, shapes, and materials of the base 20, the pair conductors 30, the third conductor 40, and the fourth conductor 50.

In one example of embodiments, the third conductor 40 may include at least one unit resonator 40X. The third conductor 40 may include one unit resonator 40X. The third conductor 40 may include unit resonators 40X. The unit resonator 40X is positioned overlapping with the fourth conductor 50 in the z direction. The unit resonator 40X is opposite with the fourth conductor 50. The unit resonator 40X may be configured to function as an FSS (Frequency Selective Surface). Unit resonators 40X are arranged in the xy plane. Unit resonators 40X may be arranged regularly in the xy plane. The unit resonators 40X may be arranged in a square grid, an oblique grid, a rectangular grid, or a hexagonal grid.

The third conductor 40 may include conductive layers arranged in the z direction. Each of the conductive layers of the third conductor 40 includes at least one part of a unit resonator. For example, the third conductor 40 includes a first conductive layer 41 and a second conductive layer 42.

The first conductive layer 41 includes at least one part of a first unit resonator 41X. The first conductive layer 41 may include one first unit resonator 41X. The first conductive layer 41 may include first divisional resonators 41Y subdivided from one first unit resonator 41X. First divisional resonators 41Y may be configured to function as at least one part of the first unit resonator 41X together with a unit structure 10X adjacent thereto. First divisional resonators 41Y are positioned at an edge of the first conductive layer 41. The first unit resonator 41X and the first divisional resonator 41Y may be referred to as a third conductor.

The second conductive layer 42 includes at least one part of a second unit resonator 42X. The second conductive layer 42 may include one second unit resonator 42X. The second conductive layer 42 may include second divisional resonators 42Y subdivided from one second unit resonator 42X. Second divisional resonator 42Y may be configured to function as one part of the second unit resonator 42X together with a unit structure 10X adjacent thereto. Second divisional resonators 42Y may be positioned at an edge of the second conductive layer 42. The second unit resonator 42X and the second divisional resonator 42Y may be referred to as a third conductor.

At least a portion of each of the second unit resonator 42X and the second divisional resonator 42Y is positioned overlapping with the first unit resonator 41X and the first divisional resonator 41Y in z direction. In the third conductor 40, at least portions of the unit resonator and the divisional resonator of each layer overlap with one another in the z direction and form one unit resonator 40X. In the unit resonator 40X, each layer includes at least one part of a unit resonator.

When the first unit resonator 41X includes a line-type resonator or a patch-type resonator, the first conductive layer 41 includes at least one first unit conductor 411. The first unit conductor 411 may be configured to function as the first unit resonator 41X or the first divisional resonator 41Y. The first conductive layer 41 includes first unit conductors 411 arranged in n-rows and m-columns in the xy direction. Each of n and m is a natural number of 1 or greater and are mutually independent. In the example illustrated in FIG. 1 to FIG. 9 etc., the first conductive layer 41 includes six first unit conductors 411 arranged in a grid with two rows and three columns. The first unit conductors 411 may be arranged in a square grid, an oblique grid, a rectangular grid, or a hexagonal grid. The first unit conductor 411 corresponding to the first divisional resonator 41Y is positioned at the edge of the first conductive layer 41 in the xy plane.

When the first unit resonator 41X is a slot-type resonator, at least one first conductive layer 41 extends in the xy direction. The first conductive layer 41 includes at least one first unit slot 412. The first unit slot 412 can function as the first unit resonator 41X or the first divisional resonator 41Y. The first conductive layer 41 may include first unit slots 412 arranged in n-rows and m-columns in the xy direction. Each of n and m is a natural number of 1 or larger and are mutually independent. In the example illustrated in FIG. 6 to FIG. 9 etc., the first conductive layer 41 includes six first unit slots 412 arranged in a grid with two rows and three columns. The first unit slot 412 may be arranged in a square grid, an oblique grid, a rectangular grid, or a hexagonal grid. The first unit slot 412 corresponding to the first divisional resonator 41Y is positioned at the edge of the first conductive layer 41 in the xy plane.

When the second unit resonator 42X is a line-type resonator or a patch type resonator, the second conductive layer 42 includes at least one second unit conductor 421. The second conductive layer 42 may include second unit conductors 421 arranged in the xy direction. The second unit conductor 421 may be arranged in a square grid, an oblique grid, a rectangular grid, or a hexagonal grid. The second unit conductor 421 may be configured to function as the second unit resonator 42X or the second divisional resonator 42Y. The second unit conductor 421 corresponding to the second divisional resonator 42Y is positioned at the edge of the second conductive layer 42 in the xy plane.

The second unit conductor 421 at least partially overlaps with at least one of the first unit resonator 41X and the first divisional resonator 41Y in the z direction. The second unit conductor 421 may overlap with first unit resonators 41X. The second unit conductor 421 may overlap with first divisional resonators 41Y. The second unit conductor 421 may overlap with one first unit resonator 41X and four first divisional resonators 41Y. The second unit conductor 421 may overlap with one first unit resonator 41X alone. The centroid of the second unit conductor 421 may overlap with one first unit conductor 41X. The centroid of the second unit conductor 421 may be positioned between first unit conductors 41X and the first divisional resonator 41Y. The centroid of the second unit conductor 421 may be positioned between two first unit resonators 41X arranged in the x direction or in the y direction.

The second unit conductor 421 may at least partially overlap with two first unit conductors 411. The second unit conductor 421 may overlap with one first unit conductor 411 alone. The centroid of the second unit conductor 421 may be positioned between two first unit conductors 411. The centroid of the second unit conductor 421 may overlap with one first unit conductor 411. The second unit conductor 421 may at least partially overlap with the first unit slot 412. The second unit conductor 421 may overlap with one first unit slot 412 alone. The centroid of the second unit conductor 421 may be positioned between two first unit slots 412 arranged in the x direction or in the y direction. The centroid of the second unit conductor 421 may overlap with one first unit slot 412.

When the second unit resonator 42X is a slot-type resonator, at least one second conductive layer 42 extends in the xy plane. The second conductive layer 42 includes at least one second unit slot 422. The second unit slot 422 may be configured to function as the second unit resonator 42X or the first divisional resonator 42Y. The second conductive layer 42 may include second unit slots 422 arranged in the xy plane. The second unit slot 422 may be arranged in a square grid, an oblique grid, a rectangular grid, or a hexagonal grid. The second unit slot 422 corresponding to the second divisional resonator 42Y is positioned at the edge of the second conductive layer 42 in the xy plane.

The second unit slot 422 at least partially overlaps with at least one of the first unit resonator 41X and the first divisional resonator 41Y in the y direction. The second unit slot 422 may overlap with first unit resonators 41X. The second unit slot 422 may overlap with first divisional resonators 41Y. The second unit slot 422 may overlap with one first unit resonator 41X and four first divisional resonators 41Y. The second unit slot 422 may overlap with one first unit resonator 41X alone. The centroid of the second unit slot 422 may overlap with one first unit conductor 41X. The centroid of the second unit slot 422 may be positioned between first unit conductors 41X. The centroid of the second unit slot 422 may be positioned between two first unit resonators 41X and the first divisional resonator 41Y arranged in the x direction or in the y direction.

The second unit slot 422 may at least partially overlap with two first unit conductors 411. The second unit slot 422 may overlap with one first unit conductor 411 alone. The centroid of the second unit slot 422 may be positioned between two first unit conductors 411. The centroid of the second unit slot 422 may overlap with one first unit conductor 411. The second unit slot 422 may at least partially overlap with the first unit slot 412. The second unit slot 422 may overlap with one first unit slot 412 alone. The centroid of the second unit slot 422 may be positioned between two first unit slots 412 arranged in the x direction or in the y direction. The center of the second unit slot 422 may overlap with one first unit slot 412.

The unit resonator 40X includes at least one part of the first unit resonator 41X and at least one part of the second unit resonator 42X. The unit resonator 40X may include one first unit resonator 41X. The unit resonator 40X may include first unit resonators 41X. The unit resonator 40X may include one first divisional resonator 41Y. The unit resonator 40X may include first divisional resonators 41Y. The unit resonator 40X may include a portion of the first unit resonator 41X. The unit resonator 40X may include one or more portions of the first unit resonator 41X. The unit resonator 40X includes portions of resonator from one or more portions of the first unit resonator 41X and one or more portions of the first divisional resonator 41Y. portions of the resonator, included in the unit resonator 40X, are combined into the first unit resonator 41X corresponding to at least one part. The unit resonator 40X may include first divisional resonators 41Y without including the first unit resonator 41X. The unit resonator 40X may include, for example, four first divisional resonators 41Y. The unit resonator 40X may include portions of the first unit resonator 41X alone. The unit resonator 40X may include one or more portions of the first unit resonator 41X and one or more portions of the first divisional resonator 41Y. The unit resonator 40X may include, for example, two portions of the first unit resonator 4X and two first divisional resonators 41Y. At both x-direction ends of the unit resonator 40X, a mirror image of the first conductive layer 41 included therein may be approximately the same. In the unit resonator 40X, the first conductive layer 41 included therein may be approximately symmetrical with respect to the center line extending in the z direction.

The unit resonator 40X may include one second unit resonator 42X. The unit resonator 40X may include second unit resonators 42X. The unit resonator 40X may include one second divisional resonator 42Y. The unit resonator 40X may include second divisional resonators 42Y. The unit resonator 40X may include a portion of the second unit resonator 42X. The unit resonator 40X may include one or more portions of the second unit resonator 42X. The unit resonator 40X includes portions of the resonator from one or more portions of the second unit resonator 42X and one or more portions of the second divisional resonator 42Y. Portions of the resonator, included in the unit resonator 40X, is combined into the second unit resonator 42X corresponding to at least one part. The unit resonator 40X may include second divisional resonators 42Y without including the second unit resonator 42X. The unit resonator 40X may include, for example, four second divisional resonators 42Y. The unit resonator 40X may include portions of the second unit resonator 42X. The unit resonator 40X may include one or more portions of the second unit resonator 42X and one or more of the second divisional resonator 42Y. The unit resonator 40X may include, for example, two portions of the second unit resonator 42X and two second divisional resonators 42Y. At both x direction ends of the unit resonator 40X, a mirror image of the second conductive layer 42 included therein may be approximately the same. In the unit resonator 40X, the second conductive layer 42 included therein may be approximately symmetrical with respect to the center line extending in the y direction.

In one example of embodiments, the unit resonator 40X includes one first unit resonator 41X and portions of the second unit resonator 42X. For example, the unit resonator 40X includes one first unit resonator 41X and a half portion of each one of four second unit resonators 42X. The unit resonator 40X includes one part of the first unit resonator 41X and two sets of components of the second unit resonator 42X. The configuration of the unit resonator 40X is not limited thereto.

The resonator 10 may include at least one unit structure 10X. The resonator 10 may include unit structures 10X. Unit structures 10X may be arranged in the xy plane. Unit structures 10X may be arranged in a square grid, an oblique grid, a rectangular grid, or a hexagonal grid. The unit structure 10X includes a repeating unit of any one of the square grid, the oblique grid, the rectangular grid, and the hexagonal grid. The unit structure 10X may be configured to function as an AMC (artificial magnetic conductor) when arranged infinitely in the xy plane.

The unit structure 10X may include at least a portion of the base 20, at least a portion of the third conductor 40, and at least a portion of the fourth conductor 50. Each of the portions of the base 20, the third conductor 40, and the fourth conductor 50 included in the unit structure 10X overlaps with one another in the z direction. The unit structure 10X includes the unit resonator 40X, a portion of the base 20 overlapping with the unit resonator 40X in the z direction, and the fourth conductor 50 overlapping with the unit resonator 40X in z direction. The resonator 10 may include six unit structures 10X arranged in, for example, two rows and three columns.

The resonator 10 may include at least one unit structure 10X between the two pair conductors 30 opposite each other in the x direction. The two pair conductors 30 may be viewed as electric conductors, which are extending in the yz plane, from the at least one unit structure 10X. The at least one unit structure 10X is electrically opened at y-direction ends. The zx planes at the both y direction ends seem to be high impedance from the at least one unit structure 10X. The zx planes at the y direction ends may be viewed as magnetic conductors from the at least one unit structure 10X. The at least one unit structure 10X may be symmetrical in the z direction when lined up repeatedly. When the at least one unit structure 10X is surrounded by two electric conductors and two high-impedance surfaces (magnetic conductors), the at least one unit structure 10X has the artificial magnetic conductor character in the z direction. When the at least one unit structure 10X is surrounded by two electric conductors and two high-impedance surfaces (magnetic conductors), the at least one unit structure 10X has the artificial magnetic conductor character with a finite value.

The operating frequency of the resonator 10 may be different from the operating frequency of the first unit resonator 41X. The operating frequency of the resonator 10 may be different from the operating frequency of the second unit resonator 42X. The operating frequency of the resonator 10 may vary due to the coupling of the first unit resonator 41X and the second unit resonator 42X, those are constituting the unit resonator 40X.

The third conductor 40 may include the first conductive layer 41 and the second conductive layer 42. The first conductive layer 41 includes at least one first unit conductor 411. The at least one first unit conductor 411 includes a first connecting conductor 413 and a first floating conductor 414. The first connecting conductor 413 is connected to one of the pair conductors 30. The first floating conductor 414 is not connected to the pair conductors 30. The second conductive layer 42 includes at least one second unit conductor 421. The at least one second unit conductor 421 includes a second connecting conductor 423 and a second floating conductor 424. The second connecting conductor 423 is connected to one of the pair conductors 30. The second floating conductor 424 is not connected to the pair conductors 30. The third conductor 40 may include the first unit conductor 411 and the second unit conductor 421.

The length of the first connecting conductor 413 in the x direction may be longer than the first floating conductor 414. The length of the first connecting conductor 413 in the x direction may be shorter than the first floating conductor 414. The length of the first connecting conductor 413 in the x direction may be half the length of the first floating conductor 414. The length of the second connecting conductor 423 in the x direction may be longer than the second floating conductor 424. The length of the second connecting conductor 423 in the x direction may be shorter than the second floating conductor 424. The length of the second connecting conductor 423 in the x direction may be half the length of the second floating conductor 424.

The third conductor 40 may include a current path 401, that serves as a current path between the first conductor 31 and the second conductor 32 when the resonator 10 resonates. The current path 401 may be connected to the first conductor 31 and the second conductor 32. The current path 401 includes a capacitance between the first conductor 31 and the second conductor 32. The capacitance of the current path 401 is electrically connected in series between the first conductor 31 and the second conductor 32. In the current path 401, an electrically conductive body is spaced between the first conductor 31 and the second conductor 32. The current path 401 may include an electrically conductive body connected to the first conductor 31 and an electrically conductive body connected to the second conductor 32.

In embodiments, in the current path 401, the first unit conductor 411 and the second unit conductor 421 partially are separated from each other in the z direction. In the current path 401, the first unit conductor 411 and the second unit conductor 421 are configured to capacitively couple to each other. The first unit conductor 411 includes a capacitive component at the x-direction edge. The first unit conductor 411 may include a capacitive component at the y-direction edge being separated from the second unit conductor 241 in the z direction. The first unit conductor 411 may include a capacitive component at an edge of both the x direction and the y direction being separated from the second unit conductor 421 in the z direction. The second unit conductor 421 includes a capacitive component at the x-direction edge. The second unit conductor may include a capacitive component at the y-direction edge being separated from the first unit conductor 411 in the z direction. The second unit conductor 421 may include a capacitive component at an edge of both the x direction and y direction being separated from the first unit conductor 411 in the z direction.

The resonator 10 can lower the resonance frequency by increasing the capacitive coupling in the current path 401. In order to realize a required operating frequency, the resonator 10 can reduce the x-direction length by increasing the capacitive coupling of the current path 401. In the third conductor 40, the first unit conductor 411 and the second unit conductor 421 are configured to capacitively couple to each other being separated from the stacking direction of the base 20. The third conductor 40 may adjust the capacitance between the first unit conductor 411 and the second unit conductor 421 by changing the being separated from surface integral.

In embodiments, the length of the first unit conductor 411 in the y direction is different from the length of the second unit conductor 421 in the y direction. When the relative positions of the first unit conductor 411 and the second unit conductor 421 are deviated in the xy plane, in in the resonator 10 may reduce a magnitude of the change in the capacitance by difference among the length of the first unit conductor 411 in the third direction and the length of the second unit conductor 421 in the third direction.

In embodiments, the current path 401 is formed of one electrically conductive body, that is spaced apart from the first conductor 31 and the second conductor 32, and is configured to capacitively couple to the first conductor 31 and the second conductor 32.

In embodiments, the current path 401 includes the first conductive layer 41 and the second conductive layer 42. The current path 401 includes at least one first unit conductor 411 and at least one second unit conductor 421. The current path 401 includes two first connecting conductors 413, two second connecting conductors 423, or one first connecting conductor 413 and one second connecting conductor 423. In the current path 401, the first unit conductor 411 and the second unit conductor 421 may be alternately arranged in the first direction.

In embodiments, the current path 401 includes a first connecting conductor 413 and a second connecting conductor 423. The current path 401 includes at least one first connecting conductor 413 and at least one second connecting conductor 423. In the current path 401, the third conductor 40 has a capacitance between the first connecting conductor 413 and the second connecting conductor 423. In an exemplary embodiment, the first connecting conductor 413 is separated from the second connecting conductor 423 and may have a capacitance. In an exemplary embodiment, the first connecting conductor 413 may be configured to capacitively couple to the second connecting conductor 423 through another electrically conductive body.

In embodiments, the current path 401 includes a first connecting conductor 413 and a second floating conductor 424. The current path 401 includes two first connecting conductors 413. In the current path 401, the third conductor 40 has a capacitance between the two first connecting conductors 413. In an exemplary embodiment, two first connecting conductors 413 may be configured to capacitively couple to each other through at least one second floating conductor 424. In an exemplary embodiment, two first connecting conductors 413 may be configured to capacitively couple to each other through at least one first floating conductor 414 and second floating conductors 424.

In embodiments, the current path 401 includes a first floating conductor 414 and a second connecting conductor 423. The current path 401 includes two second connecting conductors 423. In the current path 401, the third conductor 40 has a capacitance between two second connecting conductors 423. In an exemplary embodiment, two second connecting conductors 423 may be configured to capacitively couple to each other through at least one first floating conductor 414. In an exemplary embodiment, two second connecting conductors 423 may be configured to capacitively coupled to each other through first floating conductors 414 and at least one second floating conductor 424.

In embodiments, each of the first connecting conductor 413 and the second connecting conductor 423 may have a length that is ¼ of a wavelength λ of the resonance frequency. Each of the first connecting conductor 413 and the second connecting conductor 423 may be configured to function as a resonator having the length of ½ of the wavelength λ. Each of the first connecting conductor 413 and the second connecting conductor 423 can oscillate in an odd mode and in an even mode by capacitive coupling of the resonators thereof. The resonator 10 may have the resonance frequency in the even mode after capacitive coupling as an operating frequency.

The current path 401 may be connected to of the first conductor 31 at multiple positions. The current path 401 may be connected to the second conductor 32 at multiple positions. The current path 401 may include conductive paths that electrically conduct from the first conductor 31 to the second conductor 32 in a manner independent from one another.

In the second floating conductor 424 capacitively coupled to the first connecting conductor 413, an edge of the second floating conductor 424 having the capacitive coupling has a distance to the first connecting conductor 413 less than a distance to the pair conductors 30. In the first floating conductor 414 capacitively coupled to the second connecting conductor 423, an edge of the first floating conductor 414 having the capacitive coupling has a distance to the second connecting conductor 423 less than a distance to the pair conductors 30.

In the resonator 10 according to embodiments, the conductive layers of the third conductor 40 may have different lengths in the y direction. The conductive layers of the third conductor 40 are configured to capacitively couple to another conductive layer in the z direction. In the resonator 10, when the lengths of the conductive layers in the y direction are different, the change in the capacitance is small even if the conductive layers are shifted in the y direction. The resonator 10 can be configured to increase an allowable range of the deviation of the conductive layers in the y direction by difference among the lengths of the conductive layers in the y direction.

In the resonator 10 of embodiments, the third conductor 40 has a capacitance due to capacitive coupling between the conductive layers. Capacitive parts having capacitance may be arranged in the y direction. Capacitive parts, arranged in the y direction, may have an electro-magnetical parallel relationship. Because the resonator 10 includes capacitive parts electrically arranged in parallel, individual capacitance errors can be mutually compensated.

When the resonator 10 is in a resonant state, the currents flowing in the pair conductors 30, the third conductor 40, and the fourth conductor 50 is configured to loop. When the resonator 10 is in the resonant state, an alternating current is configured to flow in the resonator 10. In the resonator 10, the current flowing in the third conductor 40 is referred to as a first current, and the current flowing in the fourth conductor 50 is referred to as a second current. When the resonator 10 is in the resonant state, the first current is configured to flow in a direction different from the direction of the second current in the x direction. For example, when the first current is configured to flow in the +x direction, the second current is configured to flow in the −x direction. Further, for example, when the first current is configured to flow in the −x direction, the second current is configured to flow in the +x direction. That is, when the resonator 10 is in the resonant state, the loop current alternately is configured to flow in the +x direction and in the −x direction. The loop current generating a magnetic field is repeatedly inverted, whereby the resonator 10 is configured to radiate electromagnetic waves.

In embodiments, the third conductor 40 includes the first conductive layer 41 and the second conductive layer 42. In the third conductor 40, because of the capacitive coupling of the first conductive layer 41 and the second conductive layer 42, the current appears to be globally flowing in one direction in the resonance state. In embodiments, the current, flowing through each conductor, has a high density at the y-direction edges.

In the resonator 10, the first current and the second current are configured to loop through the pair conductors 30. In the resonator 10, the first conductor 31, the second conductor 32, the third conductor 40, and the fourth conductor 50 form a resonant circuit. The resonance frequency of the resonator 10 corresponds to a resonance frequency of the unit resonator. When the resonator 10 includes one unit resonator, or when the resonator 10 includes a portion of a unit resonator, the resonance frequency of the resonator 10 is changed by the electromagnetic coupling of the base 20, the pair conductors 30, the third conductor 40, and the fourth conductor 50 to the surroundings of the resonator 10. For example, when the third conductor 40 has a poor periodicity, the resonator 10 forms one unit resonator or a portion of a unit resonator in its entirety. For example, the resonance frequency of the resonator 10 varies depending on the lengths of the first conductor 31 and the second conductor 32 in the z direction, the lengths of the third conductor 40 and the fourth conductor 50 in the x direction, and the capacitances of the third conductor 40 and the fourth conductor 50. For example, when the resonator 10 has a large capacitance between the first unit conductor 411 and the second unit conductor 421, the resonator 10 can lower the resonance frequency while reducing the lengths of the first conductor 31 and the second conductor 32 in the z direction and the lengths of the third conductor 40 and the fourth conductor 50 in the x direction.

In embodiments, in the resonator 10, the first conductive layer 41 is configured as an effective surface configured to radiate an electromagnetic waves in the z direction. In embodiments, in the resonator 10, the first surface integral of the first conductive layer 41 is larger than the first surface integrals of other conductive layers. The resonator 10 can be configured to increase the radiation of the electromagnetic waves by increasing the first surface integral of the first conductive layer 41.

In embodiments, in the resonator 10, the first conductive layer 41 is configured as an effective surface configured to radiate an electromagnetic waves in the z direction. The resonator 10 can be configured to increase the radiation of the electromagnetic wave by increasing the first surface integral of the first conductive layer 41. Further, the resonator 10 does not change the resonance frequency when the resonator 10 includes unit resonators. By utilizing such characteristics, the resonator 10 can be configured to readily increase the first surface integral of the first conductive layer 41, as compared with a case in which one unit resonator resonates.

In embodiments, the resonator 10 may include one or more impedance elements 45. The impedance element 45 has an inner impedance value between terminals. The impedance element 45 is configured to changes the resonance frequency of the resonator 10. The impedance element 45 may include a resistor, a capacitor, and an inductor. The impedance element 45 may include a variable element capable of changing the impedance value. The variable element may be configured to change the impedance value according to an electrical signal. The variable element may be configured to change the impedance value by a physical mechanism.

The impedance element 45 may be connected to two unit conductors of the third conductor 40 arranged in the x direction. The impedance element 45 may be connected to two first unit conductors 411 arranged in the x direction. The impedance element 45 may be connected to the first connecting conductor 413 and the first floating conductor 414 arranged in the x direction. The impedance element 45 may be connected to the first conductor 31 and the first floating conductor 414. The impedance element 45 is connected to the unit conductor of the third conductor 40 in the central portion in the y direction. The impedance element 45 is connected to central portions of two first unit conductors 411 in the y direction.

The impedance element 45 is electrically connected in series between two electrically conductive bodies arranged in the x direction in the xy plane. The impedance element 45 may be electrically connected in series between two first unit conductors 411 arranged in the x direction. The impedance element 45 may be electrically connected in series between the first connecting conductor 413 and the first floating conductor 414 arranged in the x direction. The impedance element 45 may be electrically connected in series between the first conductor 31 and the first floating conductor 414.

The impedance element 45 may be electrically connected in parallel with two first unit conductors 411 and the second unit conductor 421, those have capacitances overlapping in the z direction. The impedance element 45 may be electrically connected in parallel with the second connecting conductor 423 and the first floating conductor 414, those have capacitances overlapping in the z direction.

The resonator 10 can lower the resonance frequency by adding a capacitor as the impedance element 45. The resonator 10 can be configured to increase the resonance frequency by adding an inductor as the impedance element 45.

The resonator 10 may include impedance elements 45 having different impedance values. The resonator 10 may include capacitors having different capacitances as the impedance elements 45. The resonator 10 may include inductors having different inductances as the impedance elements 45. The resonator 10 is configured to increase an adjustment range of the resonance frequency by adding the impedance element 45 having a different impedance value. The resonator 10 may include both a capacitor and an inductor as the impedance elements 45. The resonator 10 is configured to increase the adjustment range of the resonance frequency by simultaneously adding a capacitor and an inductor as the impedance elements 45. By having the impedance element 15, the resonator 10 can form one unit resonator or a portion of one unit resonator in its entirety.

In embodiments, the resonator 10 may include one or more conductive components 46. The conductive component 46 is a functional component having a conductor therein. The functional component may include a processor, a memory, and a sensor. The conductive component 46 is aligned with the resonator 10 in the y direction. In the conductive component 46, a ground terminal may be electrically connected to the fourth conductor 50. The conductive component 46 is not limited to the configuration in which the ground terminal is electrically connected to the fourth conductor 50, and the ground terminal may be electrically independent of the resonator 10. The resonator 10 is configured to increase the resonance frequency when the conductive component 46 is adjacent in the y direction. The resonator 10 further is configured to increase the resonance frequency when conductive components 46 are adjacent to one another in the y direction. In the resonator 10, the resonance frequency becomes higher in accordance with the length of the conductive component 46 in the z direction becomes the longer. When the length of the conductive component 46 in the z direction is longer than the resonator 10, an amount by which the resonance frequency changes per increment of a unit length decreases.

In embodiments, the resonator 10 may include one or more dielectric components 47. The dielectric component 47 is separated from the third conductor 40 in the z direction. The dielectric component 47 is an object having at least a portion being separated from the third conductor 40 that does not include an electrically conductive body and has a dielectric constant greater than that of air. In the resonator 10, the resonance frequency is lowered when the dielectric component 47 is separated from the third conductor 40 in the z direction. In the resonator 10, the resonance frequency becomes in accordance with the surface integral, in which the third conductor 40 and the dielectric component 47 are separated from each other, becomes the larger.

Figure 2:
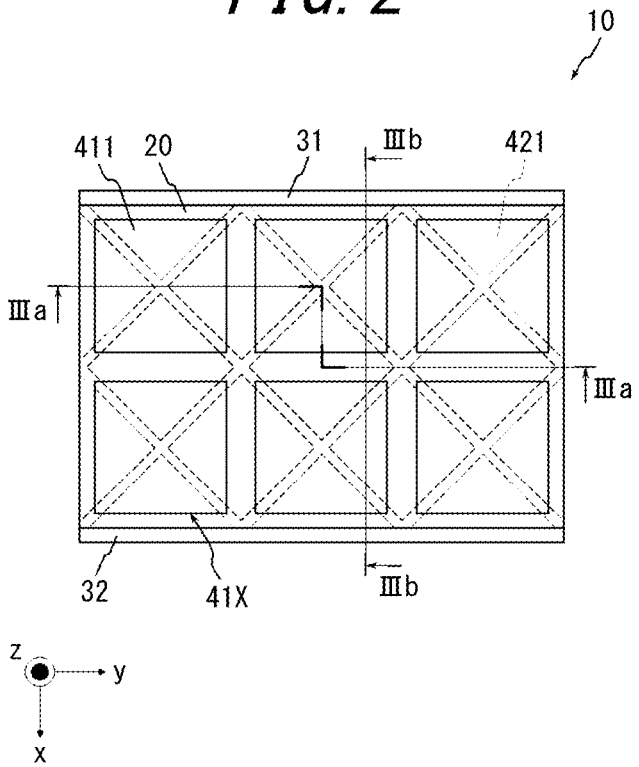
FIG. 2 is a plan view illustrating the resonator illustrated in FIG. 1.
Figure 3A:
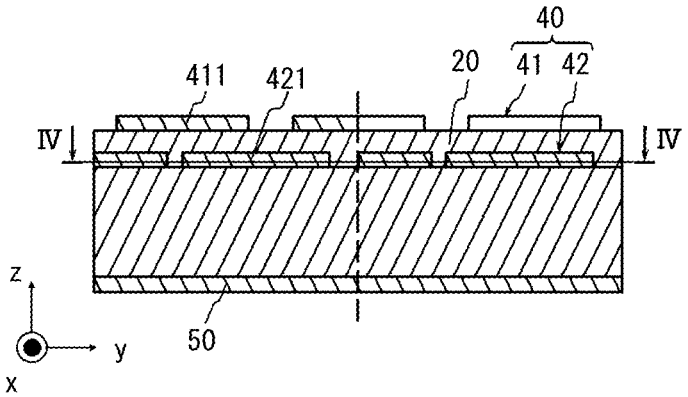
FIG. 3A is a cross-sectional diagram of the resonator illustrated in FIG. 1.
Figure 3B:
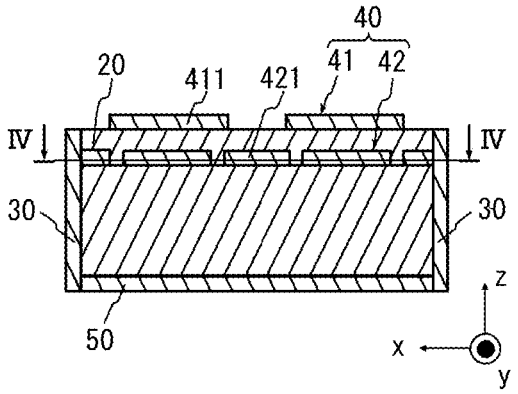
FIG. 3B is a cross-sectional diagram of the resonator illustrated in FIG. 1.
Figure 4:
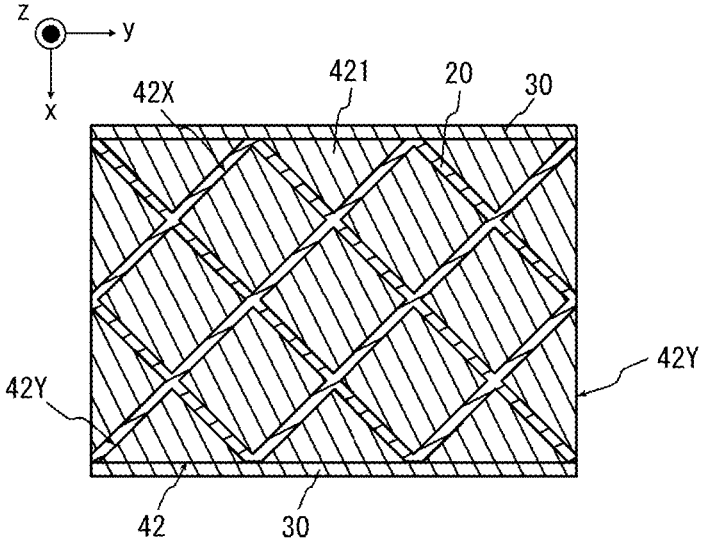
FIG. 4 is a cross-sectional diagram of the resonator illustrated in FIG. 1.
Figure 5:
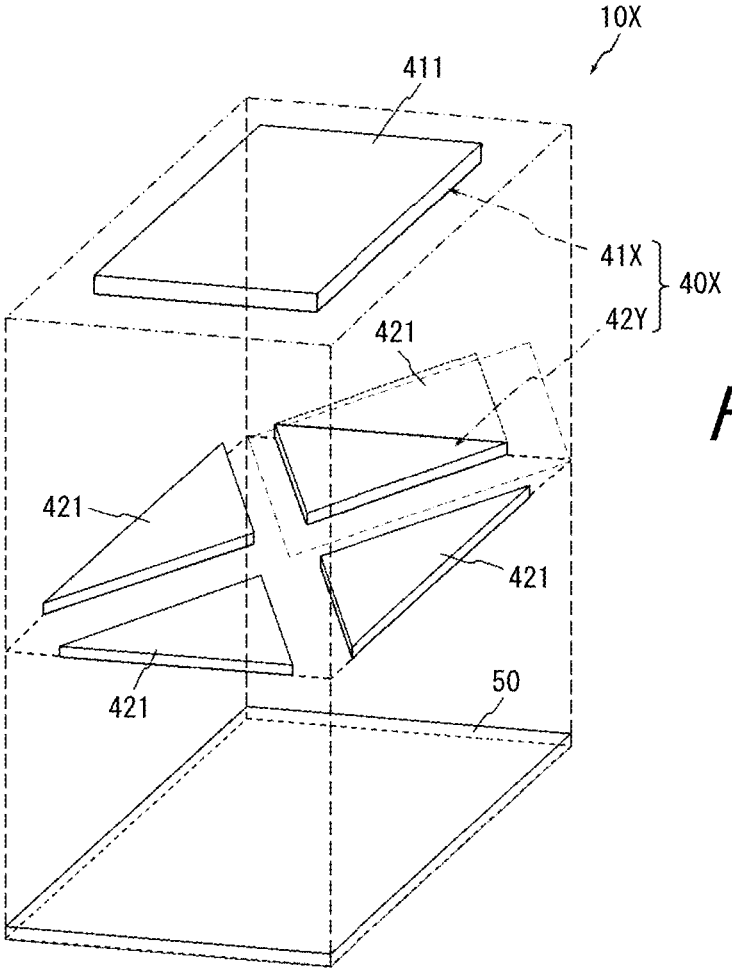
FIG. 5 is a conceptual diagram illustrating a unit structure of the resonator illustrated in FIG. 1.

FIG. 1 to FIG. 5 are diagrams illustrating the resonator 10 as an example in embodiments. FIG. 1 is a schematic diagram of the resonator 10. FIG. 2 is a plan view illustrating the xy plane viewed from the z direction. FIG. 3A is a cross-sectional diagram taken from line IIIa-IIIa illustrated in FIG. 2. FIG. 3B is a cross-sectional diagram taken from line IIIb-IIIb illustrated in FIG. 2. FIG. 4 is a cross-sectional diagram taken from line IV-IV illustrated in FIG. 3. FIG. 5 is a conceptual diagram illustrating a unit structure 10X as an example in embodiments.

In the resonator 10 illustrated in FIG. 1 to FIG. 5, the first conductive layer 41 includes a patch-type resonator as the first unit resonator 41X. The second conductive layer 42 includes a patch-type resonator as the second unit resonator 42X. The unit resonator 40X includes one first unit resonator 41X and four second divisional resonators 42Y. The unit structure 10X includes the unit resonator 40X, and a portion of the base 20 and a portion of the fourth conductor 50 that overlap with the unit resonator 40X in the z direction.

Figure 6:
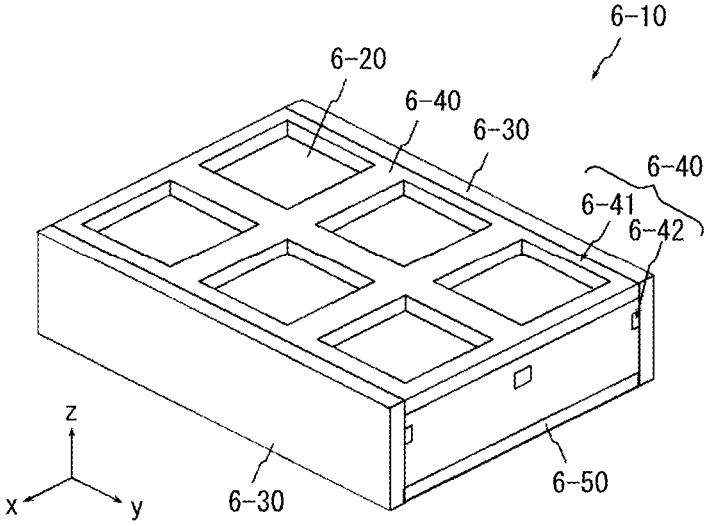
FIG. 6 is a perspective view illustrating an embodiment of a resonator.
Figure 7:
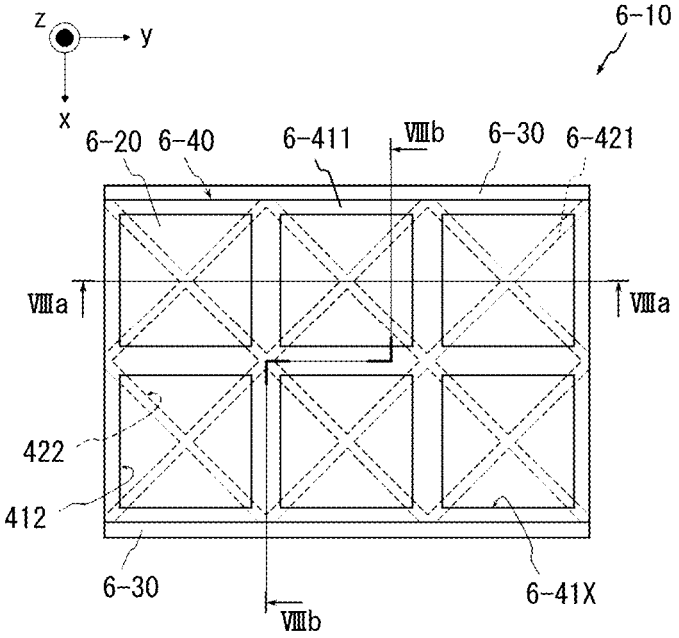
FIG. 7 is a plan view illustrating the resonator illustrated in FIG. 6.
Figure 8A:
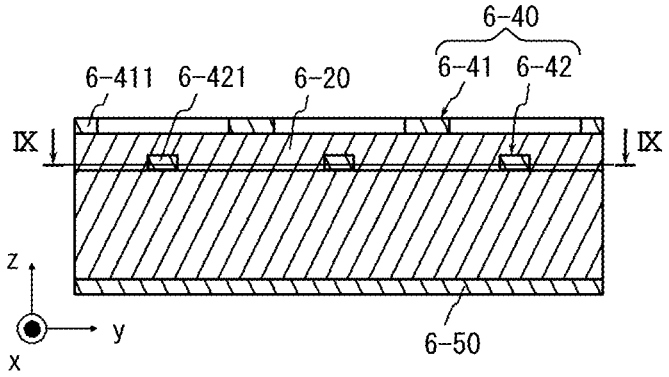
FIG. 8A is a cross-sectional diagram of the resonator illustrated in FIG. 6.
Figure 8B:
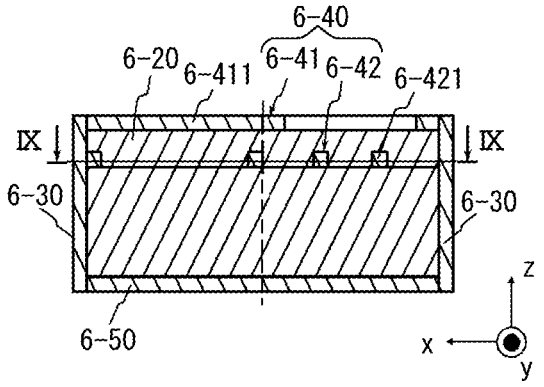
FIG. 8B is a cross-sectional diagram of the resonator illustrated in FIG. 6.
Figure 9:
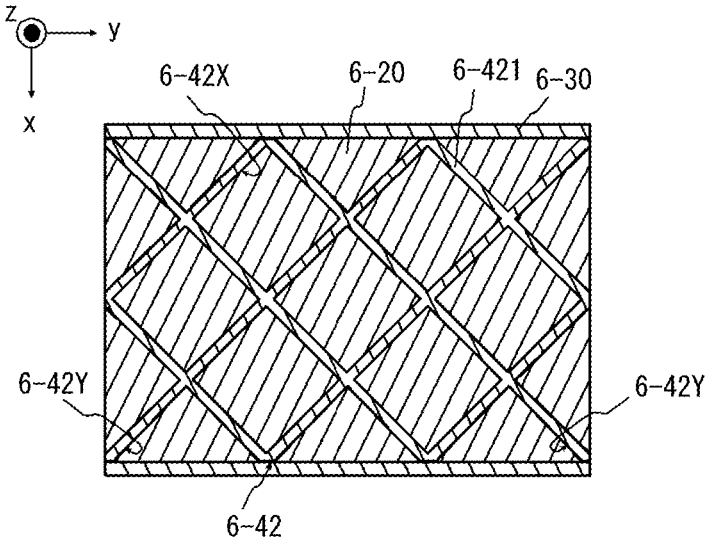
FIG. 9 is a cross-sectional diagram of the resonator illustrated in FIG. 6.

FIG. 6 to FIG. 9 are diagrams illustrating a resonator 6-10 as an example in embodiments. FIG. 6 is a schematic diagram illustrating the resonator 6-10. FIG. 7 is a plan view illustrating the xy plane viewed from the z direction. FIG. 8A is a cross-sectional diagram taken from line VIIIa-VIIIa illustrated in FIG. 7. FIG. 8B is a cross-sectional diagram taken from line VIIIb-VIIIb illustrated in FIG. 7. FIG. 9 is a cross-sectional diagram taken from line IX-IX illustrated in FIG. 8.

In the resonator 6-10, the first conductive layer 6-41 includes a slot-type resonator as a first unit resonator 6-41X. The second conductive layer 6-42 includes a slot-type resonator as a second unit resonator 6-42X. The unit resonator 6-40X includes one first unit resonator 6-41X and four second divisional resonators 6-42Y. A unit structures 6-10X includes a unit resonator 6-40X, and a portion of the base 6-20 and a portion the fourth conductor 6-50 that overlap with the unit resonator 6-40X in the z direction.

Figure 10:
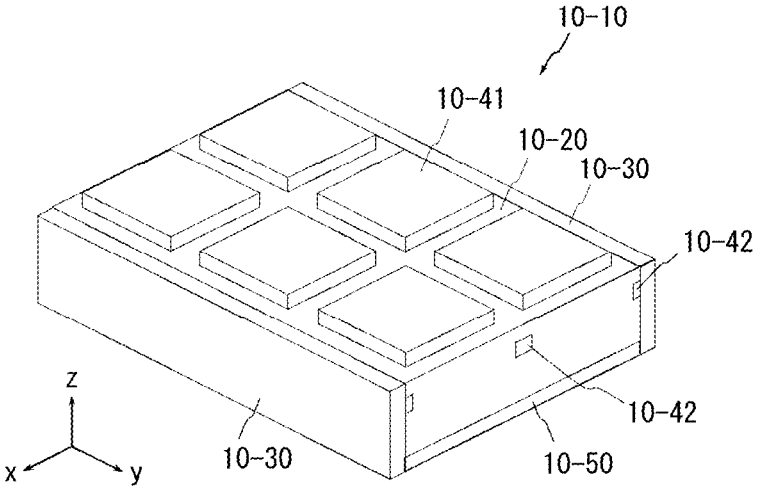
FIG. 10 is a perspective view illustrating an embodiment of a resonator.
Figure 11:
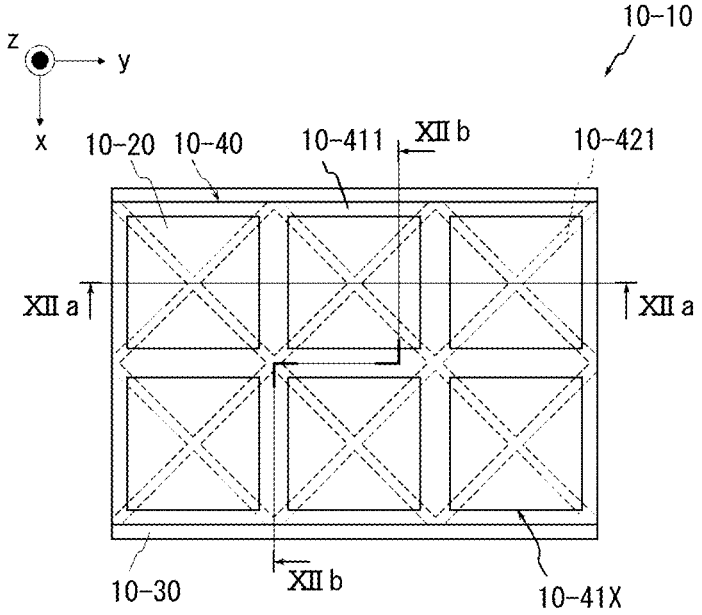
FIG. 11 is a plan view illustrating the resonator illustrated in FIG. 10.
Figure 12A:
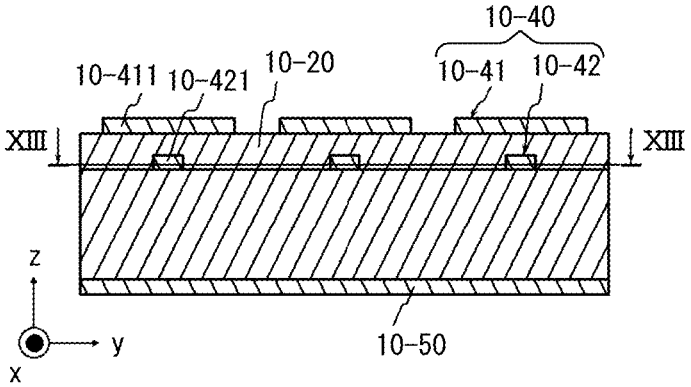
FIG. 12A is a cross-sectional diagram of the resonator illustrated in FIG. 10.
Figure 12B:
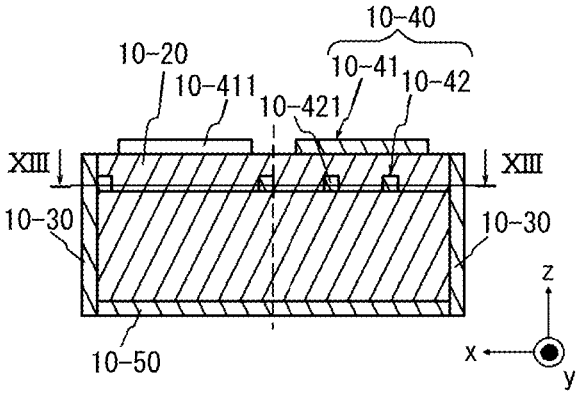
FIG. 12B is a cross-sectional diagram of the resonator illustrated in FIG. 10.
Figure 13:
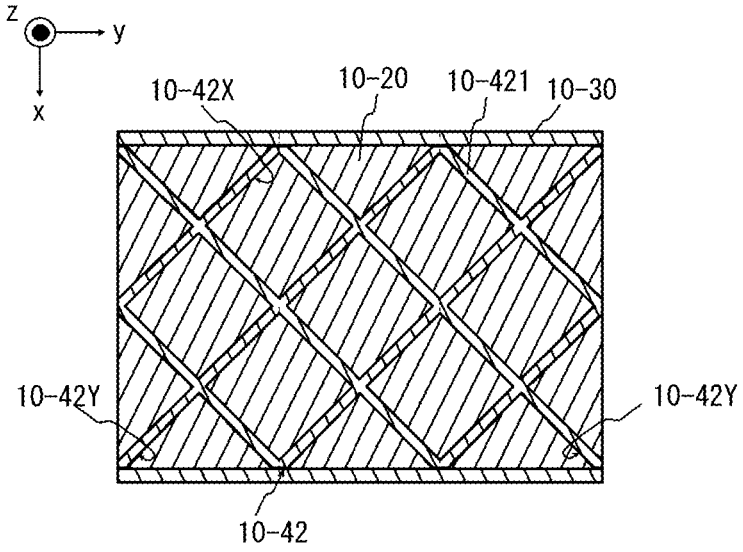
FIG. 13 is a cross-sectional diagram of the resonator illustrated in FIG. 10.

FIG. 10 to FIG. 13 are diagrams illustrating a resonator 10-10 as an example in embodiments. FIG. 10 is a schematic diagram illustrating the resonator 10-10. FIG. 11 is a plan view illustrating the xy plane viewed from the z direction. FIG. 12A is a cross-sectional diagram taken from line XIIa-XIIa illustrated in FIG. 11. FIG. 12B is a cross-sectional diagram taken from line XIIb-XIIb illustrated in FIG. 11. FIG. 13 is a cross-sectional diagram taken from line XIII-XIII illustrated in FIG. 12.

In the resonator 10-10, the first conductive layer 10-41 includes a patch-type resonator as a first unit resonator 10-41X. The second conductive layer 10-42 includes a slot-type resonator as a second unit resonator 10-42X. The unit resonator 10-40X includes one first unit resonator 10-41X and four second divisional resonators 10-42Y. A unit structure 10-10X includes the unit resonator 10-40X, and a portion of the base 10-20 and a portion of the fourth conductor 10-50 that overlap with the unit resonator 10-40X in the z direction.

Figure 14:
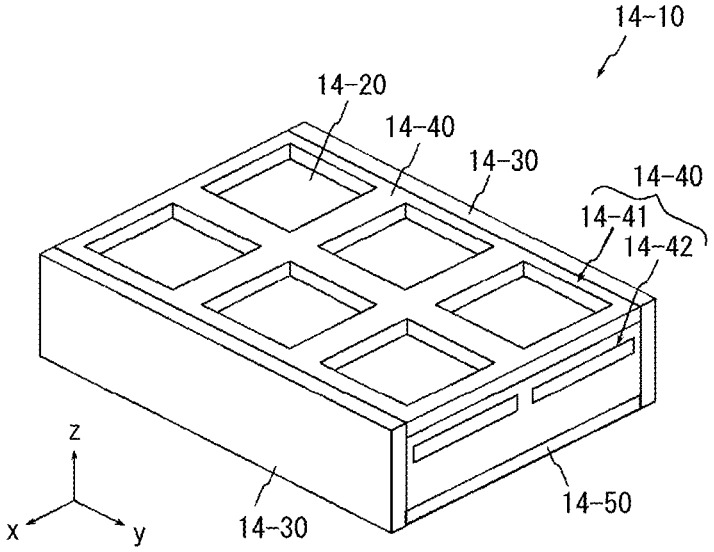
FIG. 14 is a perspective view illustrating an embodiment of a resonator.
Figure 15:
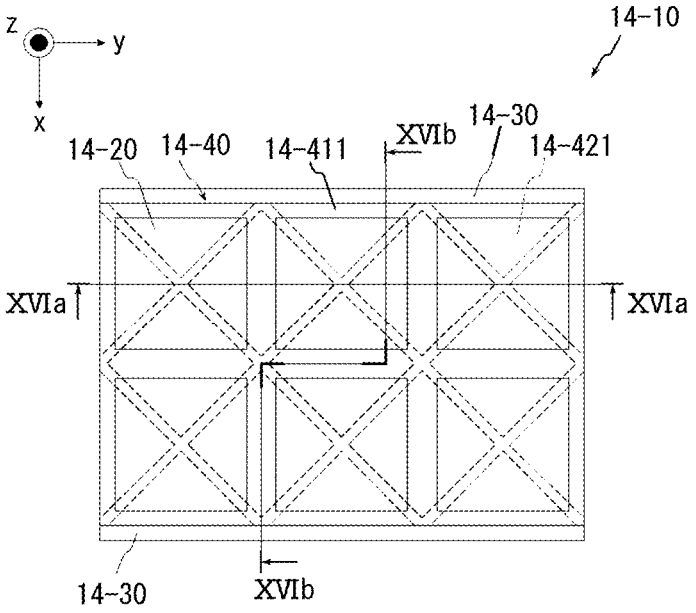
FIG. 15 is a plan view illustrating the resonator illustrated in FIG. 14.
Figure 16A:
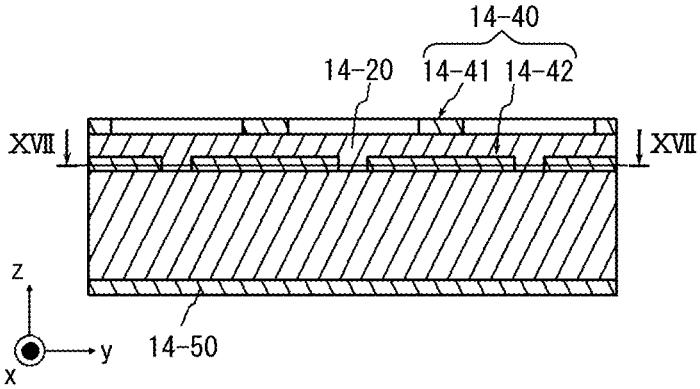
FIG. 16A is a cross-sectional diagram of the resonator illustrated in FIG. 14.
Figure 16B:
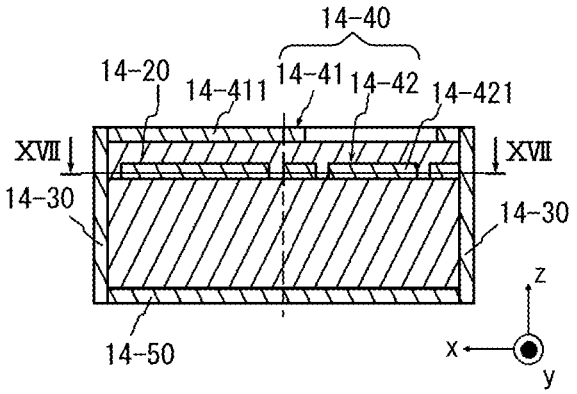
FIG. 16B is a cross-sectional diagram of the resonator illustrated in FIG. 14.
Figure 17:
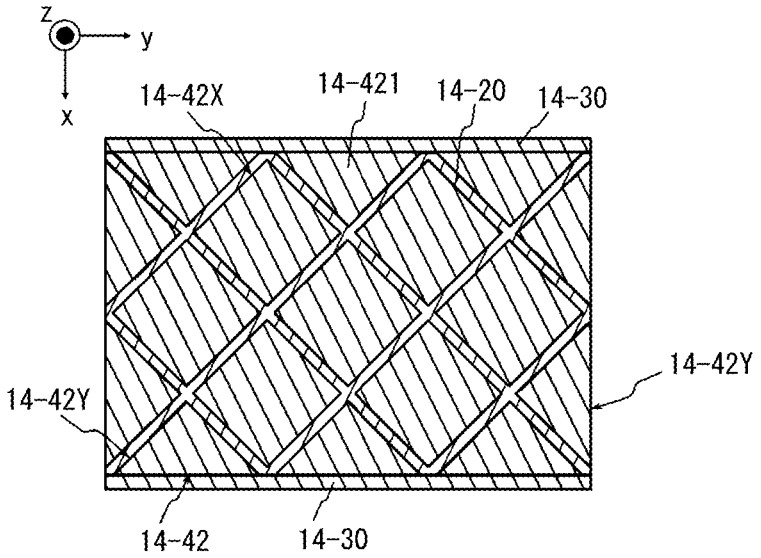
FIG. 17 is a cross-sectional diagram of the resonator illustrated in FIG. 14.

FIG. 14 to FIG. 17 are diagrams illustrating a resonator 14-10 as an example in embodiments. FIG. 14 is a schematic diagram illustrating the resonator 14-10. FIG. 15 is a plan view illustrating the xy plane viewed from the z direction. FIG. 16A is a cross-sectional diagram taken from line XVIa-XVIa illustrated in FIG. 15. FIG. 16B is a cross-sectional diagram taken from line XVIb-XVIb illustrated in FIG. 15. FIG. 17 is a cross-sectional diagram taken from line XVII-XVII illustrated in FIG. 16.

In the resonator 14-10, the first conductive layer 14-41 includes a slot-type resonator as a first unit resonator 14-41X. The second conductive layer 14-42 includes a patch-type resonator as a second unit resonator 14-42X. The unit resonator 14-40X includes one first unit resonator 14-41X and four second divisional resonators 14-42Y. A unit structure 14-10X includes the unit resonator 14-40X, and a portion of the base 14-20 and a portion of the fourth conductor 14-50 that overlap with the unit resonator 14-40X in the z direction.

Figure 18:
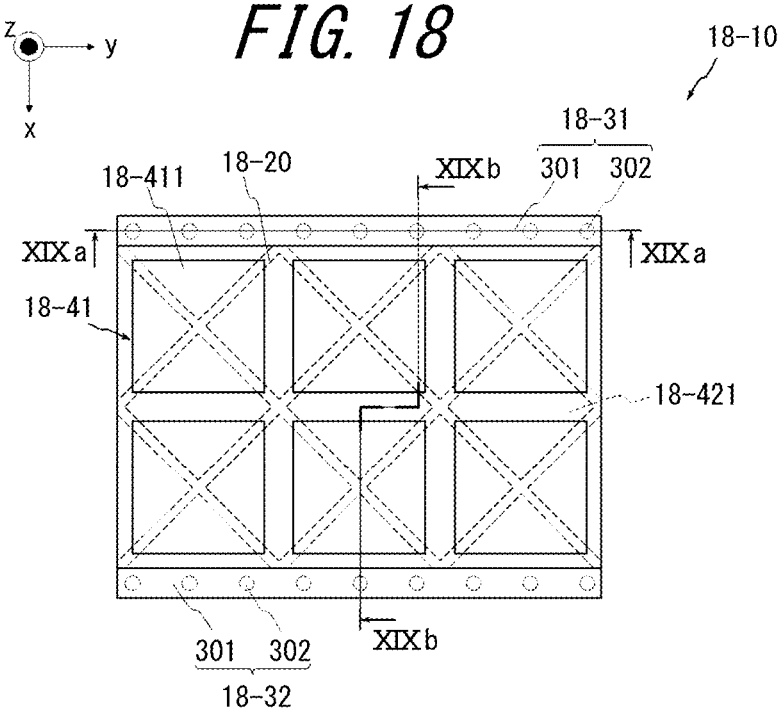
FIG. 18 is a plan view illustrating an embodiment of a resonator.
Figure 19A:
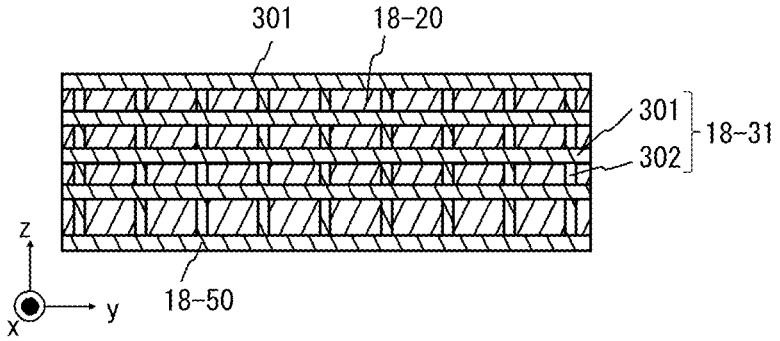
FIG. 19A is a cross-sectional diagram of the resonator illustrated in FIG. 18.
Figure 19B:
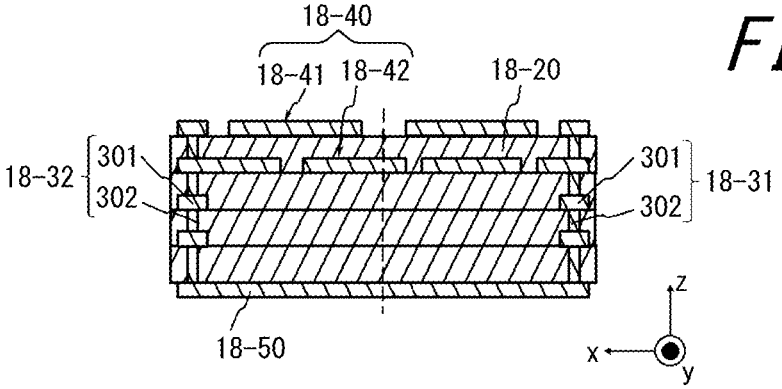
FIG. 19B is a cross-sectional diagram of the resonator illustrated in FIG. 18.

The resonator 10 is illustrated in FIG. 1 to FIG. 17 by way of example. The configuration of the resonator 10 is not limited to the configurations illustrated in FIG. 1 to FIG. 17. FIG. 18 is a diagram illustrating a resonator 18-10 that includes pair conductors 18-30 having a different configuration. FIG. 19A is a cross-sectional diagram taken from line XIXa-XIXa illustrated in FIG. 18. FIG. 19B is a cross-sectional diagram taken from line XIXb-XIXb illustrated in FIG. 18.

Figure 20:
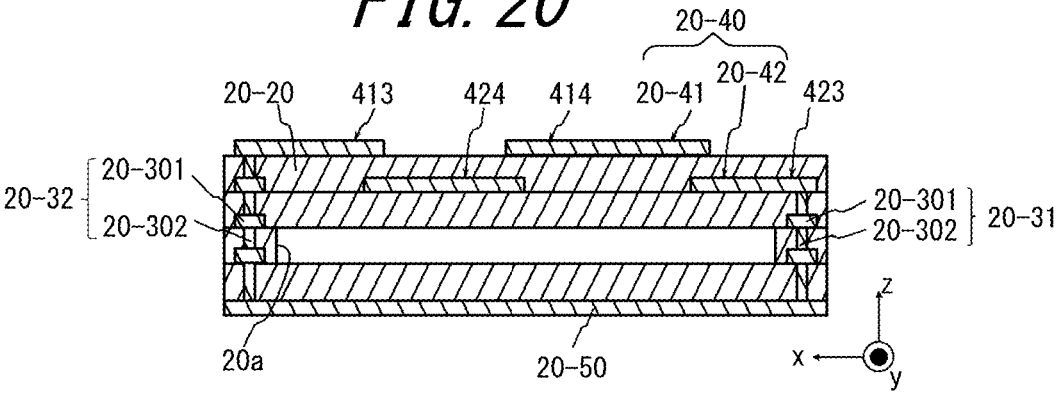
FIG. 20 is a cross-sectional diagram of an embodiment of a resonator.

The base 20 is illustrated in FIG. 1 to FIG. 19 by way of example. The configuration of the base 20 is not limited to the configurations illustrated in FIG. 1 to FIG. 19. A base 20-20 may include a cavity 20*a* therein as illustrated in FIG. 20. In the z direction, the cavity 20*a* is positioned between a third conductor 20-40 and a fourth conductor 20-50. The dielectric constant of the cavity 20*a* is lower than that of the base 20-20. By having the cavity 20*a*, the base 20-20 can reduce an electromagnetic distance between the third conductor 20-40 and the fourth conductor 20-50.

Figure 21:
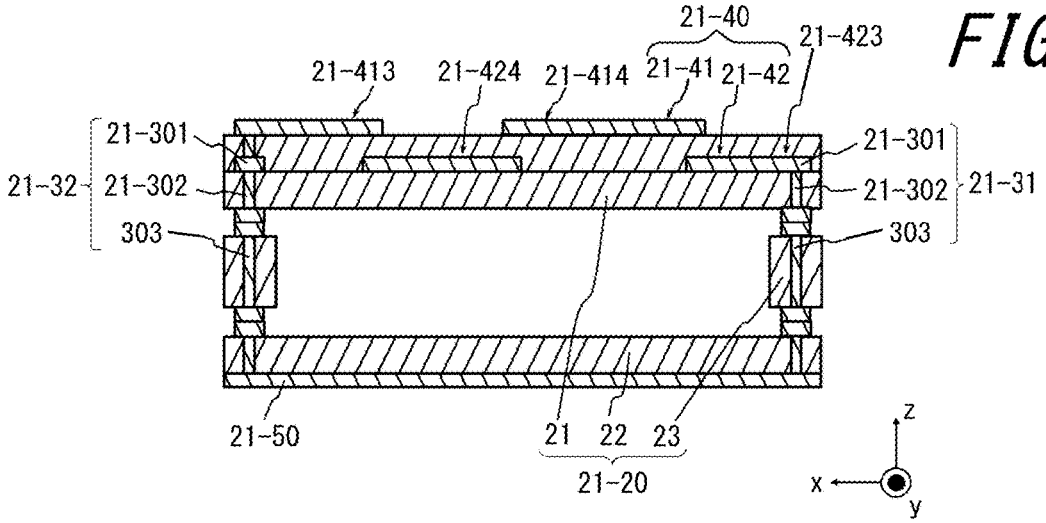
FIG. 21 is a plan view illustrating an embodiment of a resonator.

A base 21-20 may include members as illustrated in FIG. 21. The base 21-20 may include a first base 21-21, a second base 21-22, and a connecting member 21-23. The first base 21-21 and the second base 21-22 may be configured to mechanically couple to each other through the connecting member 21-23. The connecting member 21-23 may include a sixth conductor 303 therein. The sixth conductor 303 is electrically connected to a fourth conductor 21-301 or a fifth conductor 21-302. The sixth conductor 303 serves as a first conductor 21-31 or a second conductor 21-32 in combination with the fourth conductor 21-301 or the fifth conductor 21-302.

Figure 22A:
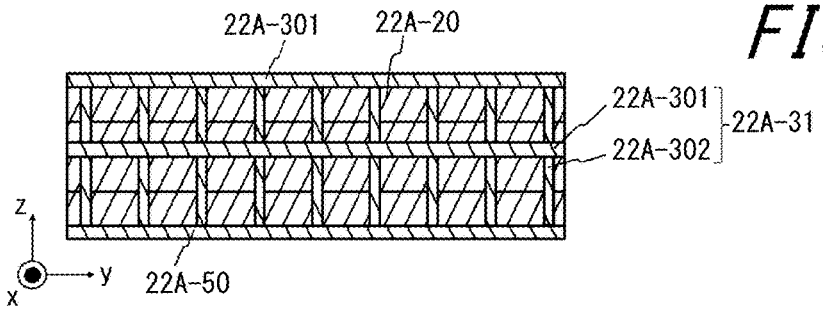
FIG. 22A is a cross-sectional diagram of an embodiment of a resonator.
Figure 22B:
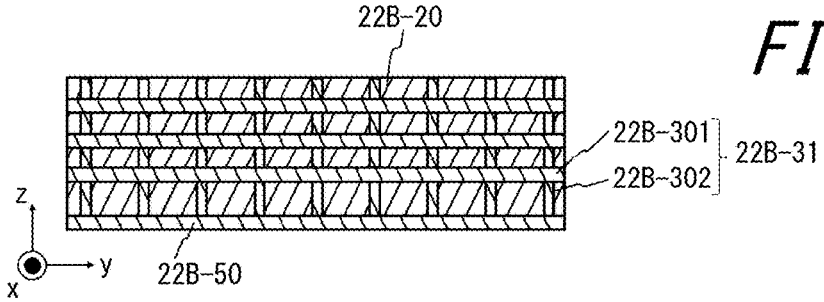
FIG. 22B is a cross-sectional diagram of an embodiment of a resonator.
Figure 22C:
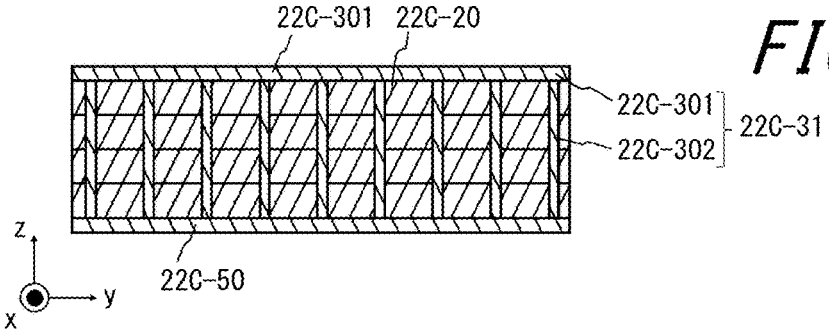
FIG. 22C is a cross-sectional diagram of an embodiment of a resonator.

The pair conductors 30 are illustrated in FIG. 1 to FIG. 21 by way of example. The configuration of the pair conductors 30 is not limited to the configurations illustrated in FIG. 1 to FIG. 21. FIG. 22 to FIG. 28 are diagrams illustrating a resonator 10 that includes pair conductors 30 having a different configuration. FIG. 22 is a cross-sectional diagram corresponding to FIG. 19A. As illustrated in FIG. 22A, the number of fifth conductive layers 22A-301 may be appropriately changed. Fifth conductive layer 22B-301 does not need to be positioned on the base 22B-20, as illustrated in FIG. 22B. Fifth conductive layer 22C-301 does not need to be positioned in a base 22C-20, as illustrated in FIG. 22C.

Figure 23:
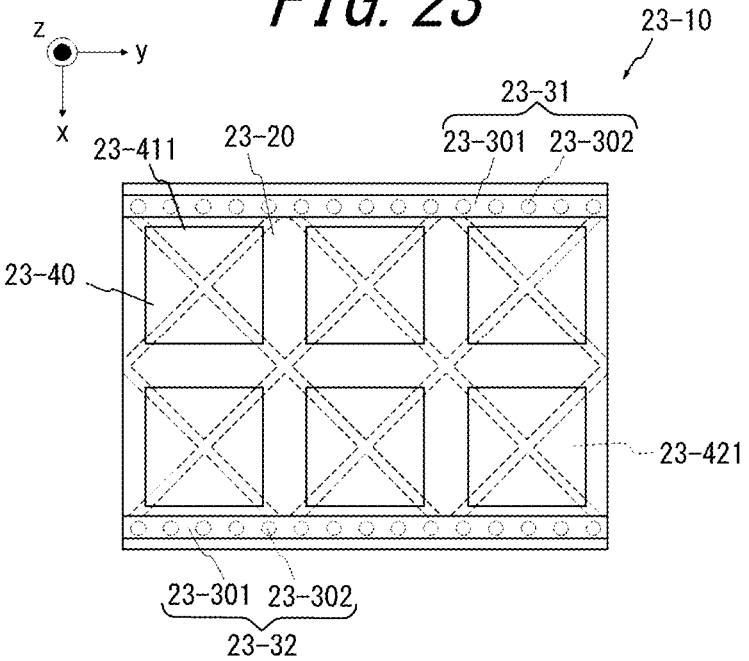
FIG. 23 is a plan view illustrating an embodiment of a resonator.
Figure 24:
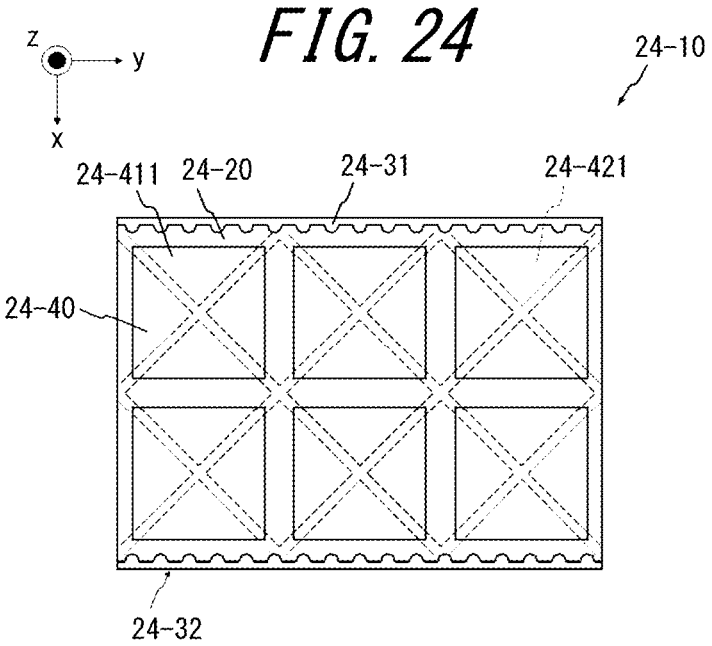
FIG. 24 is a plan view illustrating an embodiment of a resonator.

FIG. 23 is a plan view corresponding to FIG. 18. As illustrated in FIG. 23, in a resonator 23-10, a fifth conductor 23-302 may be separated from the boundary of a unit resonator 23-40X. FIG. 24 is a plan view corresponding to FIG. 18. As illustrated in FIG. 24, each of a first conductor 24-31 and a second conductor 24-32 may have a convex portion protruding toward a corresponding one of the first conductor 24-31 or the second conductor 24-32. The resonator 10 as described above may be formed by, for example, applying metal paste to the base 20 having recesses and then curing. In the examples illustrated in FIG. 18 to FIG. 23, the recesses are in a circular shape. The shape of the recesses is not limited to the circular shape and may be a polygonal shape with rounded corners, or an oval shape.

Figure 25:
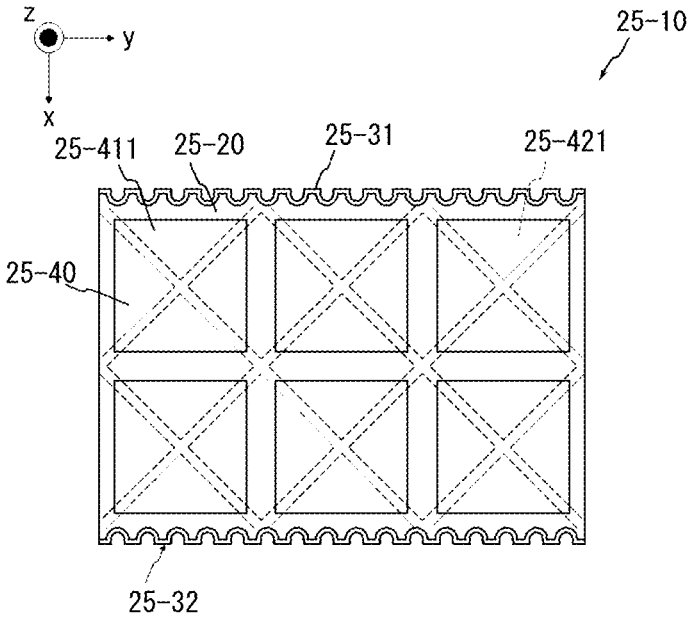
FIG. 25 is a plan view illustrating an embodiment of a resonator.

FIG. 25 is a plan view corresponding to FIG. 18. A base 25-20 can have recesses as illustrated in FIG. 25. As illustrated in FIG. 25, each of a first conductor 25-31 and a second conductor 25-32 have recesses recessed from the outer surface in the x direction to the inside. As illustrated in FIG. 25, the first conductor 25-31 and the second conductor 25-32 extend in the surface of the base 25-20. The resonator 25-10 in this configuration may be formed by, for example, blowing a fine metal material to the base 25-20 having recesses.

Figure 26:
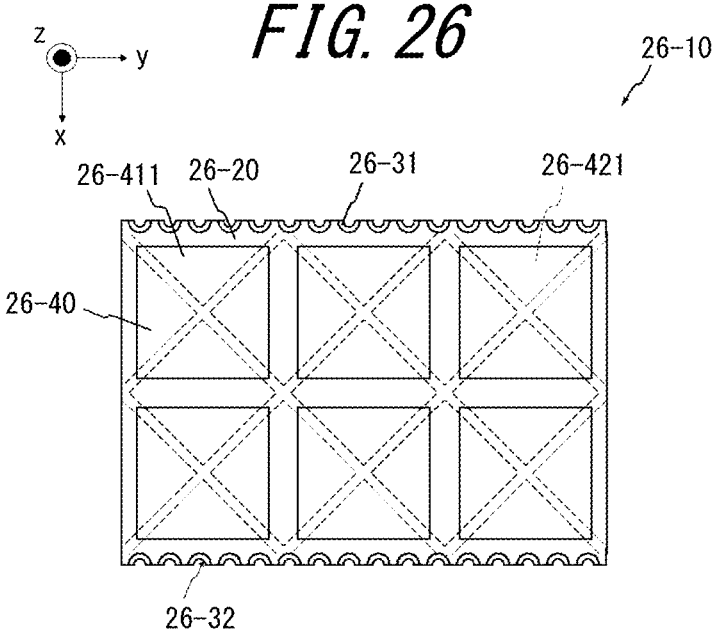
FIG. 26 is a plan view illustrating an embodiment of a resonator.

FIG. 26 is a plan view corresponding to FIG. 18. As illustrated in FIG. 26, a base 26-20 can have recesses. As illustrated in FIG. 26, each of a first conductor 26-31 and a second conductor 26-32 have recesses recessed from the outer surface in the x direction to the inside. As illustrated in FIG. 26, the first conductor 26-31 and the second conductor 26-32 extend in the recesses of the base 26-20. The resonator 26-10 in this configuration may be produced by, for example, dividing a mother substrate in a row of through-hole conductors. Each of the first conductor 26-31 and the second conductor 26-32 as described above may be referred to as a plated half hole.

Figure 27:
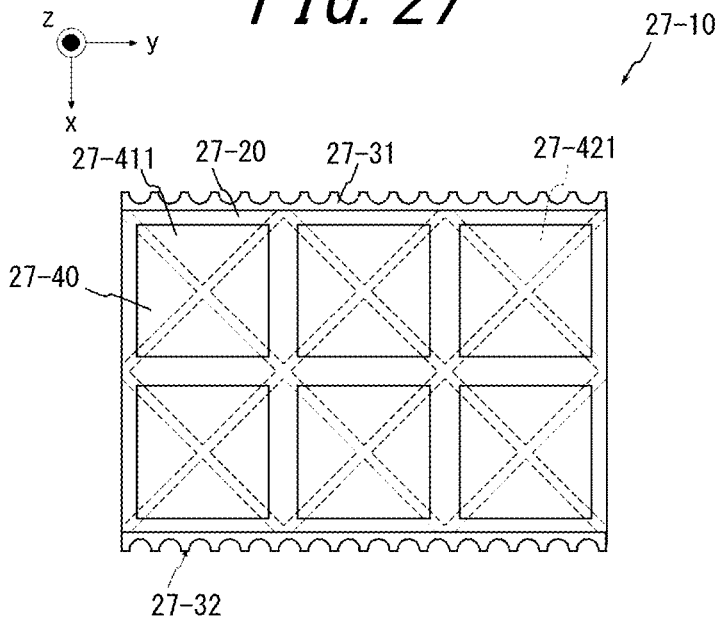
FIG. 27 is a plan view illustrating an embodiment of a resonator.

FIG. 27 is a plan view corresponding to FIG. 18. As illustrated in FIG. 27, a base 27-20 may have recesses. As illustrated in FIG. 27, a first conductor 27-31 and a second conductor 27-32 have recesses recessed from the outer surface in the x direction to the inside. A resonator 27-10 configured as described above may be produced by, for example, dividing a mother substrate in a row of through hole conductors. Each of the first conductor 27-31 and the second conductor 27-32 as described above may be referred to as a plated half hole. In the examples illustrated in FIG. 24 to FIG. 27, the recesses have a semicircular shape. The shape of the recesses is not limited to the semicircular shape, and may be a partial polygonal shape with round corners or a partial oval arc shape. For example, by utilizing a portion in the long direction of the oval, the plated half hole may be configured to increase the integral surface of the yz plane in a small number.

Figure 28:
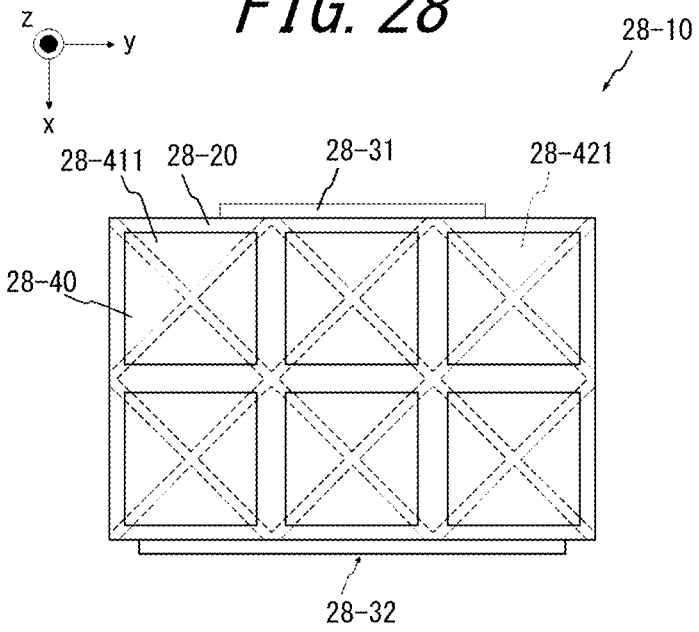
FIG. 28 is a plan view illustrating an embodiment of a resonator.

FIG. 28 is a plan view corresponding to FIG. 18. As illustrated in FIG. 28, x-direction lengths of a first conductor 28-31 and a second conductor 28-32 may be shorter than a base 28-10. The configurations of the first conductor 28-31 and the second conductor 28-32 are not limited thereto. In the example illustrated in FIG. 28, the x-direction lengths of the pair conductors are different, but they may be the same. One or both of the x-direction lengths of the pair conductors 30 may be shorter than the third conductor 40. The pair conductors 30 having the x-direction lengths shorter than the base 20 may have the configurations as illustrated in FIG. 18 to FIG. 27. The pair conductors 30 having the x-direction lengths shorter than the third conductor 40 may have the configurations as illustrated in FIG. 18 to FIG. 27. The pair conductors 30 may have configurations different from each other. For example, one of the pair conductors 30 may include the fifth conductive layers 301 and 302, and the other one of the pair conductors 30 may be the plated half holes.

Figure 29A:
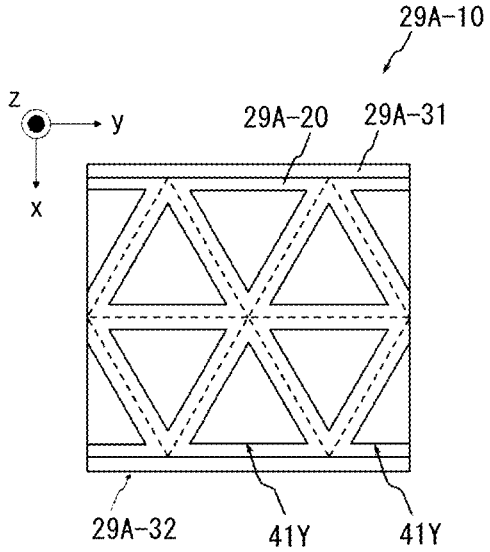
FIG. 29A is a plan view illustrating an embodiment of a resonator.
Figure 29B:
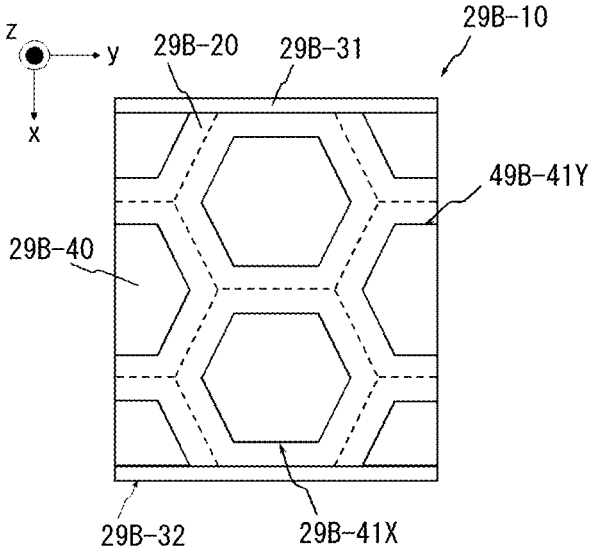
FIG. 29B is a plan view illustrating an embodiment of a resonator.

The third conductor 40 is illustrated in FIG. 1 to FIG. 28 by way of example. The configuration of the third conductor 40 is not limited to the configurations illustrated in FIG. 1 to FIG. 28. The shapes of the unit resonator 40X, the first unit resonator 41X, and the second unit resonator 42X are not limited to a square. The unit resonator 40X, the first unit resonator 41X, and the second unit resonator 42X may be referred to as unit resonator 40X and the like. For example, the unit resonator 40X and the like may have a triangular shape as illustrated in FIG. 29A, or a hexagonal shape as illustrated in FIG. 29B. Each side of the unit resonator 30-40X and the like may extend in different directions in the x direction and y direction as illustrated in FIG. 30. In a third conductor 30-40, a second conductive layer 30-42 may be positioned on a base 30-20, and a first conductive layer 30-41 may be positioned within the base 30-20. In the third conductor 30-40, the second conductive layer 30-42 may be positioned further from a fourth conductor 30-50 than from the first conductive layer 30-41.

Figure 31C:
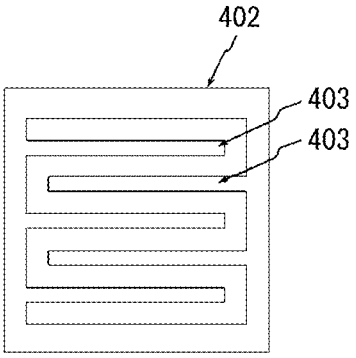
FIG. 31C is a schematic diagram illustrating an example of a resonator.
Figure 31D:
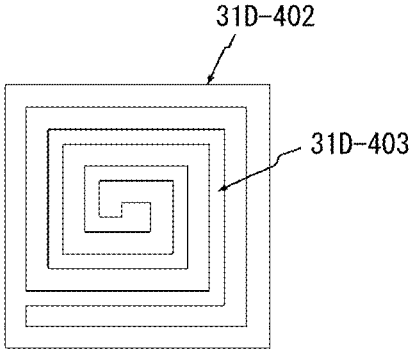
FIG. 31D is a schematic diagram illustrating an example of a resonator.
Figure 32A:
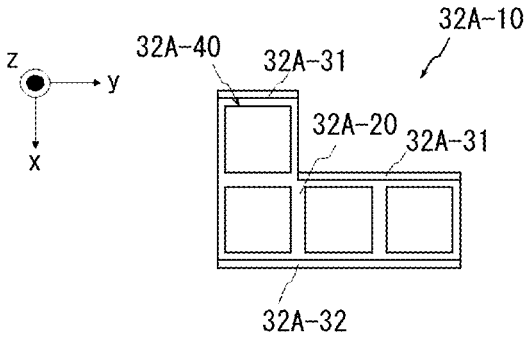
FIG. 32A is a plan view illustrating an embodiment of a resonator.
Figure 32B:
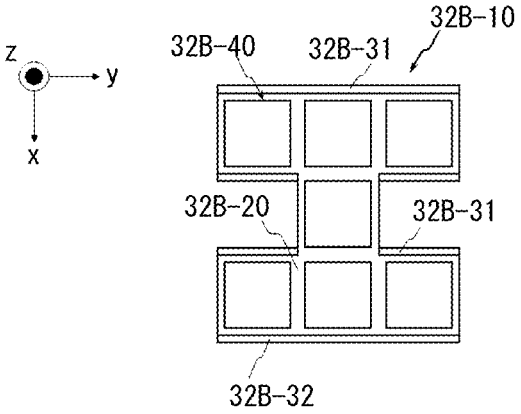
FIG. 32B is a plan view illustrating an embodiment of a resonator.
Figure 32C:
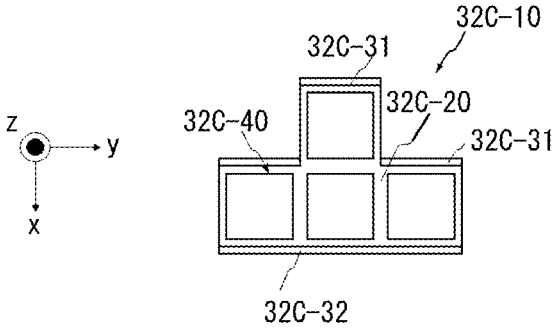
FIG. 32C is a plan view illustrating an embodiment of a resonator.
Figure 32D:
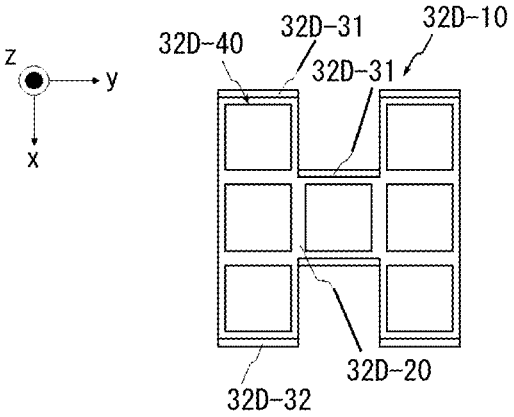
FIG. 32D is a plan view illustrating an embodiment of a resonator.
Figure 33A:
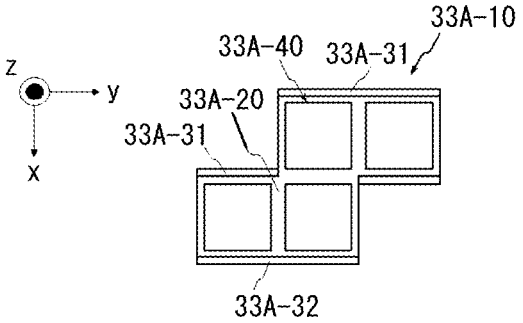
FIG. 33A is a plan view illustrating an embodiment of a resonator.
Figure 33B:
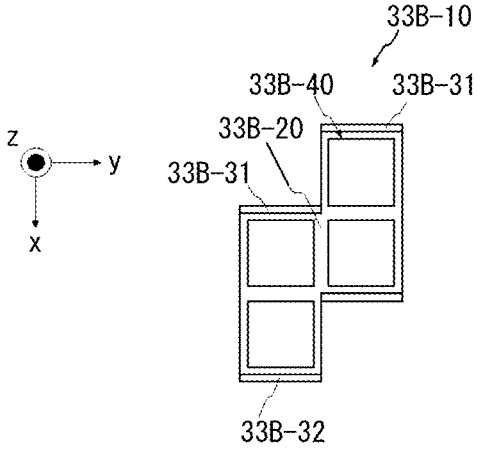
FIG. 33B is a plan view illustrating an embodiment of a resonator.
Figure 33C:
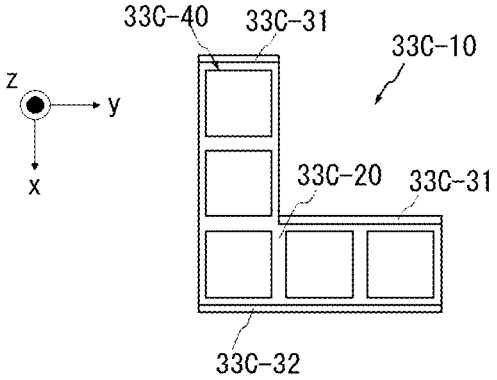
FIG. 33C is a plan view illustrating an embodiment of a resonator.
Figure 33D:
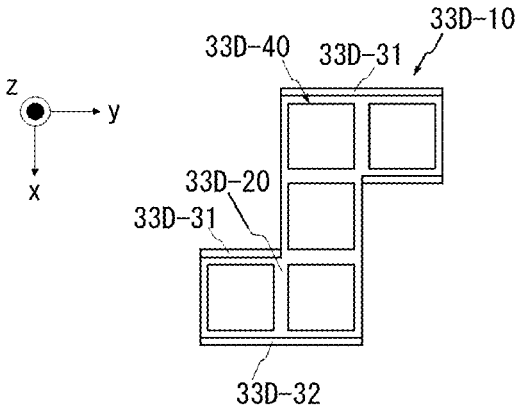
FIG. 33D is a plan view illustrating an embodiment of a resonator.
Figure 34A:
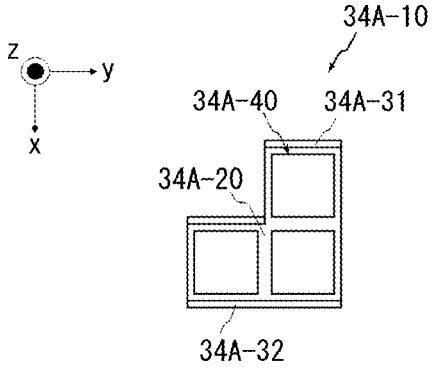
FIG. 34A is a plan view illustrating an embodiment of a resonator.
Figure 34B:
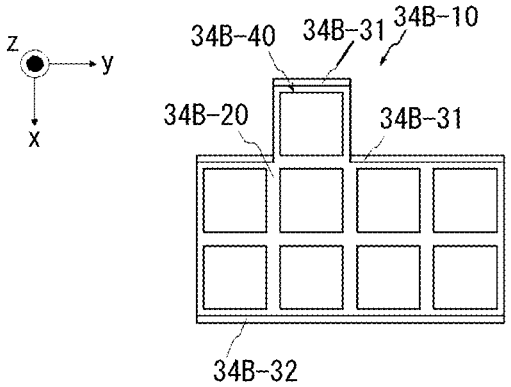
FIG. 34B is a plan view illustrating an embodiment of a resonator.
Figure 34C:
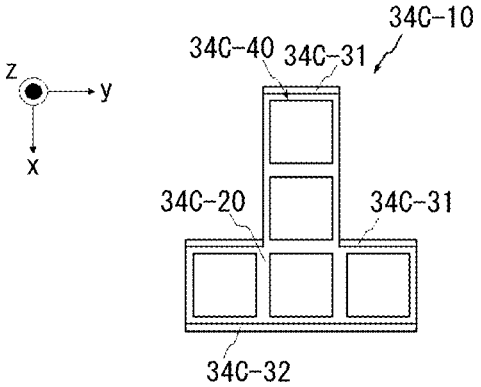
FIG. 34C is a plan view illustrating an embodiment of a resonator.
Figure 34D:
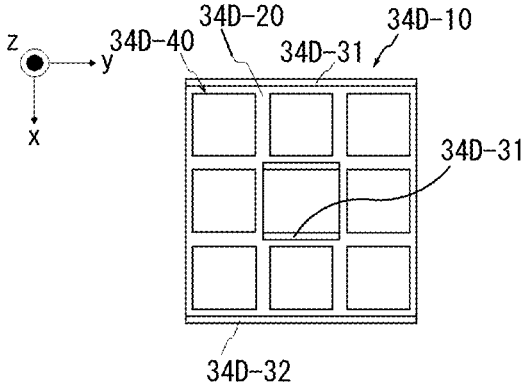
FIG. 34D is a plan view illustrating an embodiment of a resonator.

The third conductor 40 is illustrated in FIG. 1 to FIG. 30 by way of example. The configuration of the third conductor 40 is not limited to the configurations illustrated in FIG. 1 to FIG. 30. The resonator that includes the third conductor 40 may be a line-type resonator 401. FIG. 31A illustrates a meander-line type resonator 401. FIG. 31B illustrates a spiral-type resonator 31B-401. The resonator included in the third conductor 40 may be a slot-type resonator 402. The slot-type resonator 402 may include one or more of seventh conductors 403 inside an opening. The seventh conductor 403 within the opening is electrically connected to a conductor that has one released end and the other end for regulating the opening. In a unit slot illustrated in FIG. 31C, five seventh conductors 403 are positioned within the opening. The unit slot has a shape corresponding to a meander line by the seventh conductor 403. In the unit slot illustrated in FIG. 31D, one seventh conductor 31D-403 is positioned within the opening. The unit slot has a shape corresponding to a spiral because of the seventh conductor 31D-403.

The configurations of the resonator 10 are illustrated in FIG. 1 to FIG. 31 by way of example. The configuration of the resonator 10 is not limited to the configurations illustrated in FIG. FIG. 1 to FIG. 31. For example, the resonator 10 may include three or more of the pair conductors 30. For example, one pair conductor 30 may be opposite with two pair conductors 30 in the x direction. The two pair conductors 30 may have different distances to the other pair conductors 30. For example, the resonator 10 may include two pair conductors 30. The two pair conductors 30 may have a distance therebetween and lengths different from each other. The resonator 10 may include five or more first conductors. The unit structure 10X of the resonator 10 may be arranged together with another unit structure 10X in the y direction. The unit structure 10X of the resonator 10 may be arranged together with another unit structure 10X in the x direction, without passing through the pair conductors 30. FIG. 32 to FIG. 34 are diagrams illustrating examples of the resonator 10. In the resonator 10 illustrated in FIG. 32 to FIG. 34, the unit resonator 40X of the unit structure 10X has a square shape but is not limited thereto.

Figure 35:
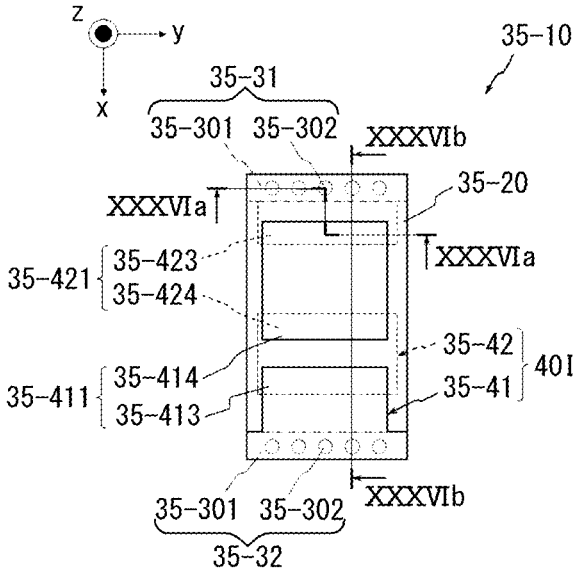
FIG. 35 is a plan view illustrating an embodiment of a resonator.
Figure 36A:
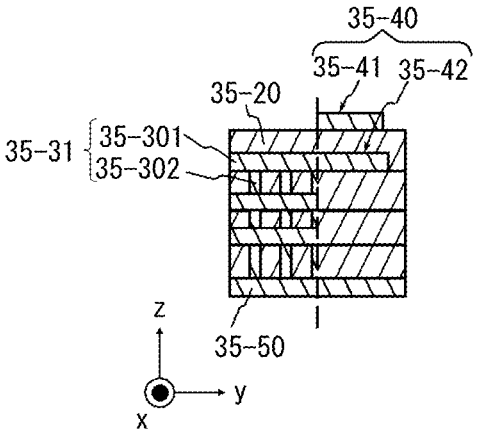
FIG. 36A is a cross-sectional diagram of the resonator illustrated in FIG. 35.
Figure 36B:
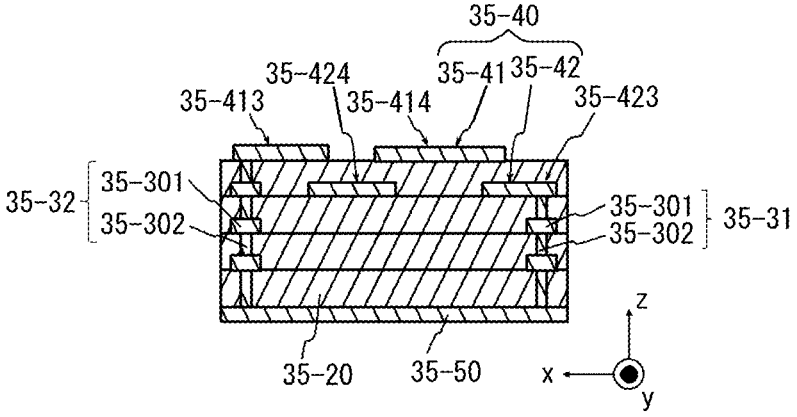
FIG. 36B is a cross-sectional diagram of the resonator illustrated in FIG. 35.

The configurations of the resonator 10 are illustrated in FIG. 1 to FIG. 34 by way of example. The configuration of the resonator 10 are not limited to the configurations illustrated in FIG. 1 to FIG. 34. FIG. 35 is a plan view illustrating the xy plane viewed from the z direction. FIG. 36A is a cross-sectional diagram taken from line XXXVIa-XXXVIa illustrated in FIG. 35. FIG. 36B is a cross-sectional diagram taken from line XXXVIb-XXXVIb illustrated in FIG. 35.

In the resonator 35-10, the first conductive layer 35-41 includes a half portion of a patch-type resonator as a first unit resonator 35-41X. The second conductive layer 35-42 includes a half portion of a patch type resonator as a second unit resonator 35-42X. The unit resonator 35-40X includes one first divisional resonator 35-41Y and one second partial resonator 35-42Y. The unit structure 35-10X includes a unit resonator 35-40X, and a portion of the base 35-20 and a portion of the fourth conductor 35-50 that overlap with the unit resonator 35-40X in the zdirection. In the resonator 35-10, three unit resonators 35-40X are arranged in the x direction. A first unit conductor 35-411 and a second unit conductor 35-421 included in the three unit resonators 35-40X form one current path 35-401.

Figure 37:
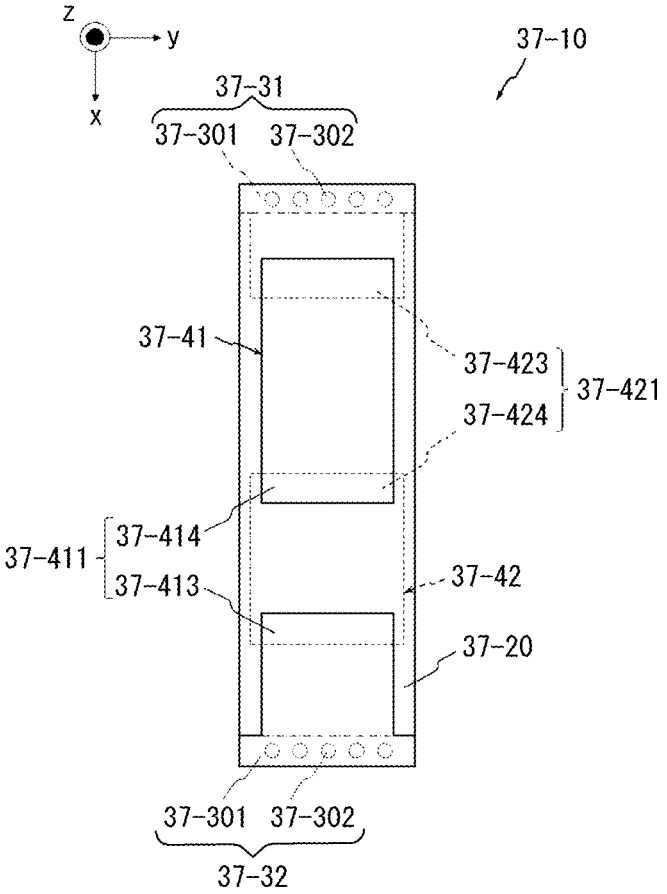
FIG. 37 is a plan view illustrating an embodiment of a resonator.
Figure 38:
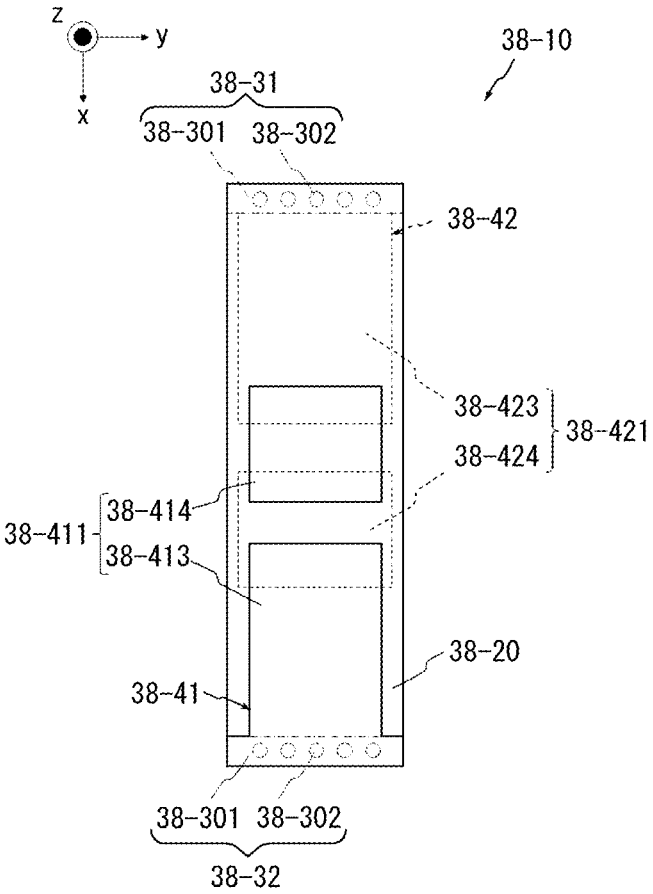
FIG. 38 is a plan view illustrating an embodiment of a resonator.

FIG. 37 illustrates another example of the resonator 35-10 illustrated in FIG. 35. The resonator 37-10 illustrated in FIG. 37 is longer in the x direction than the resonator 35-10. The dimension of the resonator 10 is not limited to that of the resonator 37-10 and may be appropriately changed. In the resonator 37-10, the x-direction length of a first connecting conductor 37-413 is different from a first floating conductor 37-414. In the resonator 37-10, the x-direction length of the first connecting conductor 37-413 is shorter than the first floating conductor 37-414. FIG. 38 illustrates another example of the resonator 35-10. In a resonator 38-10 illustrated in FIG. 38, the x-direction length of the third conductor 38-40 is different. In the resonator 38-10, the x-direction length of a first connecting conductor 38-413 is longer than a first floating conductor 38-414.

Figure 39:
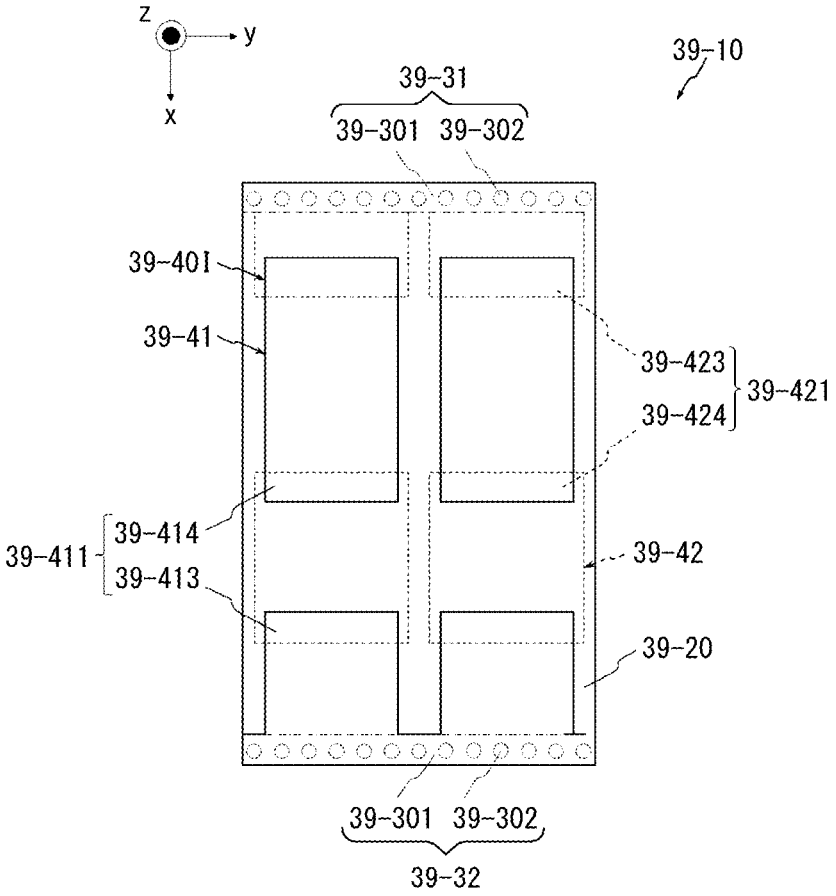
FIG. 39 is a plan view illustrating an embodiment of a resonator.

FIG. 39 illustrates another example of the resonator 10. FIG. 39 illustrates another example of the resonator 37-10 illustrated in FIG. 37. In embodiments, in the resonator 10, first unit conductors 411 and second unit conductors 421 arranged in the x direction are configured to capacitively couple to one another. In the resonator 10, two current paths 401, in which a current does not be configured to flow from one current path 401 to the other current path 401, may be arranged in the y direction.

Figure 40:
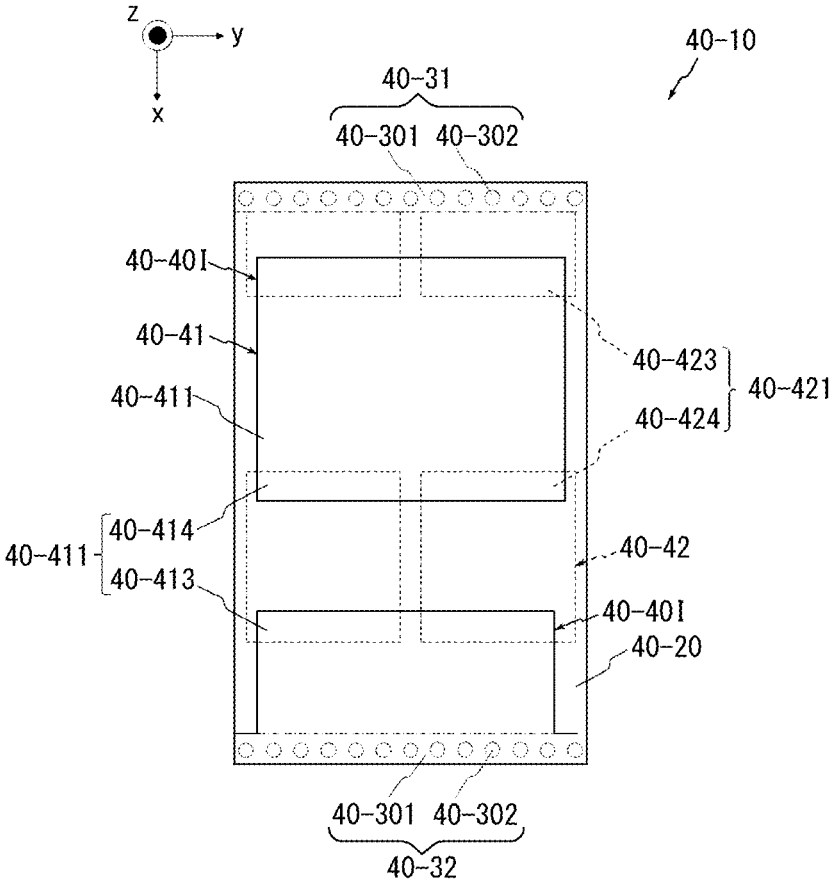
FIG. 40 is a plan view illustrating an embodiment of a resonator.

FIG. 40 illustrates another example of the resonator 10. FIG. 40 illustrates another example of a resonator 39-10 illustrated in FIG. 39. In embodiments, in the resonator 10, the number of electrically conductive bodies connected to the first conductor 31 and the number of electrically conductive bodies connected to the second conductor 32 may be different from each other. In the resonator 40-10 illustrated in FIG. 40, one first connecting conductor 40-413 is configured to capacitively couple to two second floating conductors 40-424. In a resonator 40-10 illustrated in FIG. 40, two second connecting conductors 40-423 are configured to capacitively couple to one first floating conductor 40-414. In embodiments, the number of the first unit conductors 411 may be different from the number of the second unit conductors 421 capacitively coupled thereto.

Figure 41:
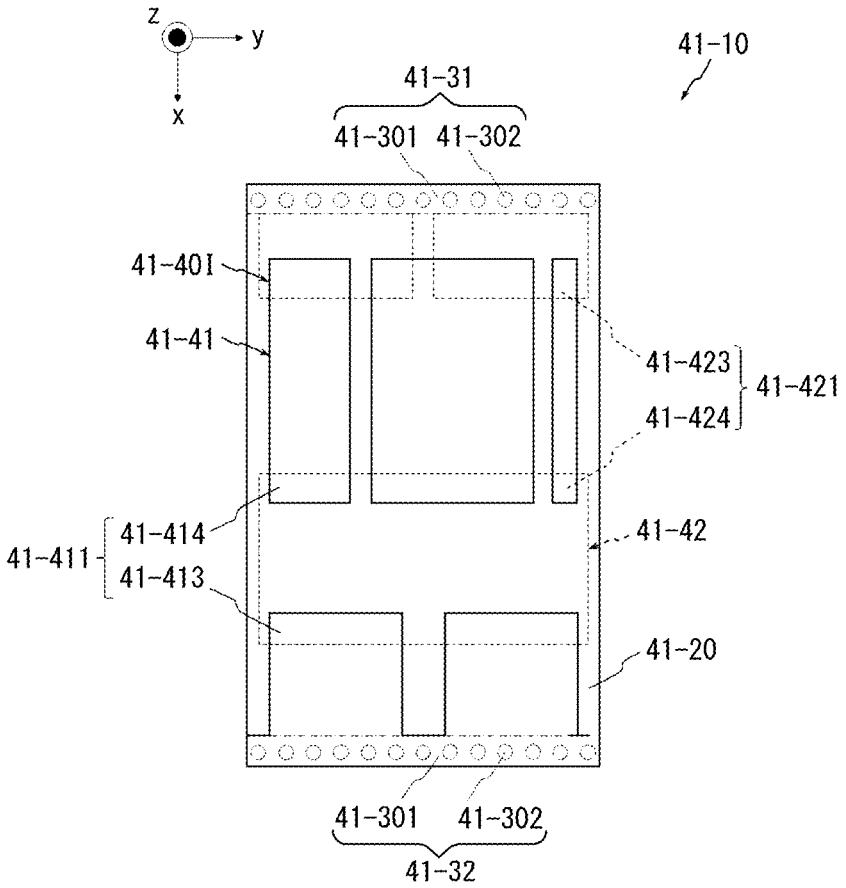
FIG. 41 is a plan view illustrating an embodiment of a resonator.

FIG. 41 illustrates another example of the resonator 39-10 illustrated in FIG. 39. In embodiments, in the first unit conductor 411, the number of the second unit conductors 421 capacitively coupled at a first edge in the x direction and the number of the second unit conductors 421 capacitively coupled at a second edge in the x direction may be different from each other. In a resonator 41-10 illustrated in FIG. 41, in one second floating conductor 41-424, two first connecting conductors 41-413 are configured to capacitively couple at the first edge in the x direction, and three second floating conductors 41-424 are configured to capacitively couple at the second edge. In embodiments, electrically conductive bodies arranged in the y direction may have different lengths in the y direction. In the resonator 41-10 illustrated in FIG. 41, three first floating conductors 41-414 arranged in the y direction have different lengths in the y direction.

Figure 42:
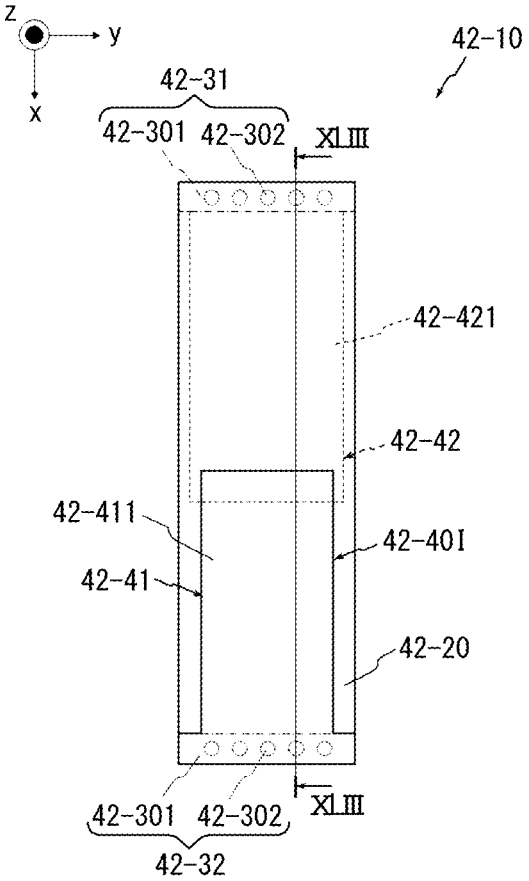
FIG. 42 is a plan view illustrating an embodiment of a resonator.
Figure 43:
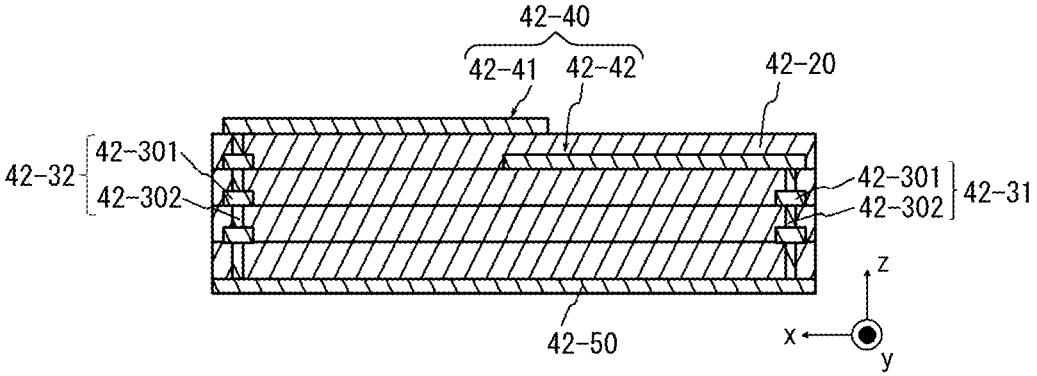
FIG. 43 is a cross-sectional diagram of the resonator illustrated in FIG. 42.

FIG. 42 illustrates another example of the resonator 10. FIG. 43 is a cross-sectional diagram taken from line XLIII-XLIII illustrated in FIG. 42. In a resonator 42-10 illustrated FIG. 42 and FIG. 43, a first conductive layer 42-41 includes a half portion of a patch-type resonator as a first unit resonator 42-41X. A second conductive layer 42-42 includes a half portion of a patch-type resonator as a second unit resonator 42-42X. A unit resonator 42-40X includes one first divisional resonator 42-41Y and one second partial resonator 42-42Y. The unit structure 42-10X includes a unit resonator 42-40X, and a portion of a base 42-20 and a portion of a fourth conductor 42-50 those are overlapped with the unit resonator 42-40X in the z direction. In the resonator 42-10 illustrated in FIG. 42, one unit resonator 42-40X extends in the x direction.

Figure 44:
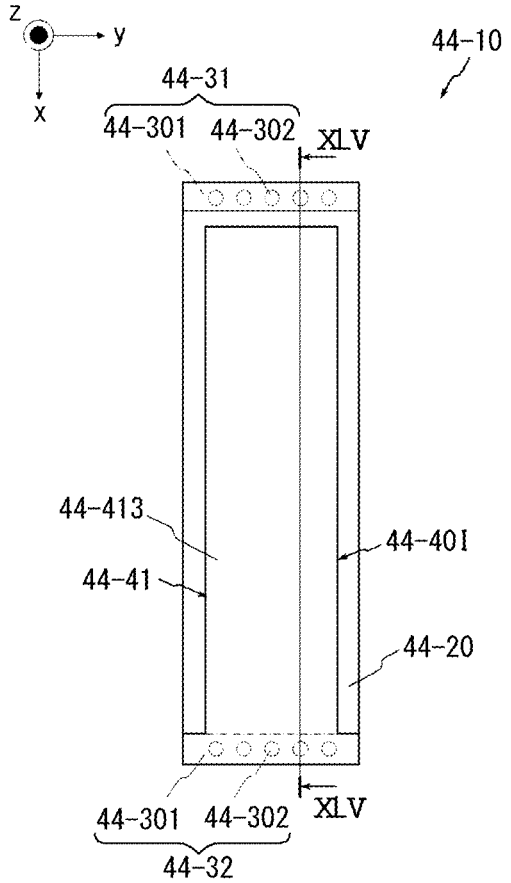
FIG. 44 is a plan view illustrating an embodiment of a resonator.
Figure 45:
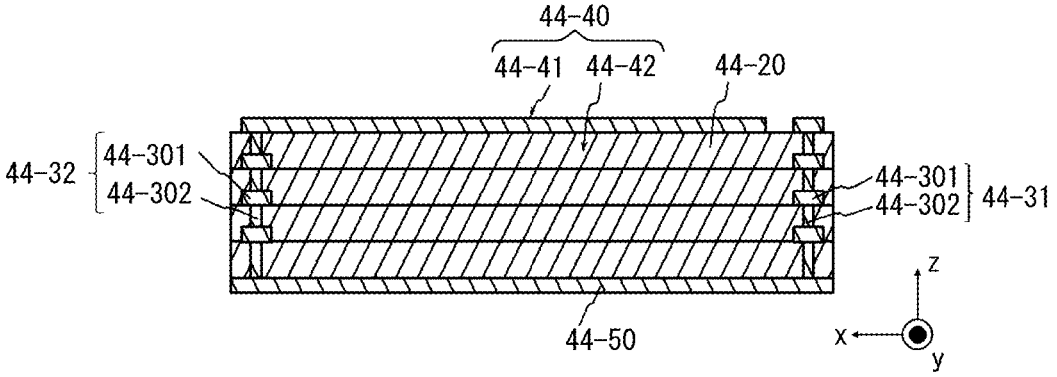
FIG. 45 is a cross-sectional diagram of the resonator illustrated in FIG. 44.

FIG. 44 illustrates another example of the resonator 10. FIG. 45 is a cross-sectional diagram taken from line XLV-XLV illustrated in FIG. 44. In a resonator 44-10 illustrated in FIG. 44 and FIG. 45, a third conductor 44-40 includes a first connecting conductor 44-413 alone. The first connecting conductor 44-413 is separated from a first conductor 44-31 in the xy plane. The first connecting conductor 44-413 is configured to capacitively couple to the first conductor 44-31.

Figure 46:
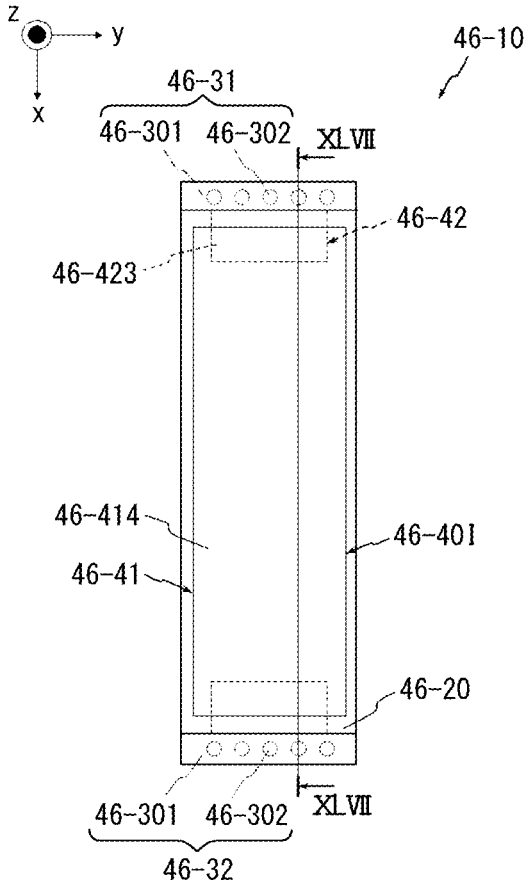
FIG. 46 is a plan view illustrating an embodiment of a resonator.
Figure 47:
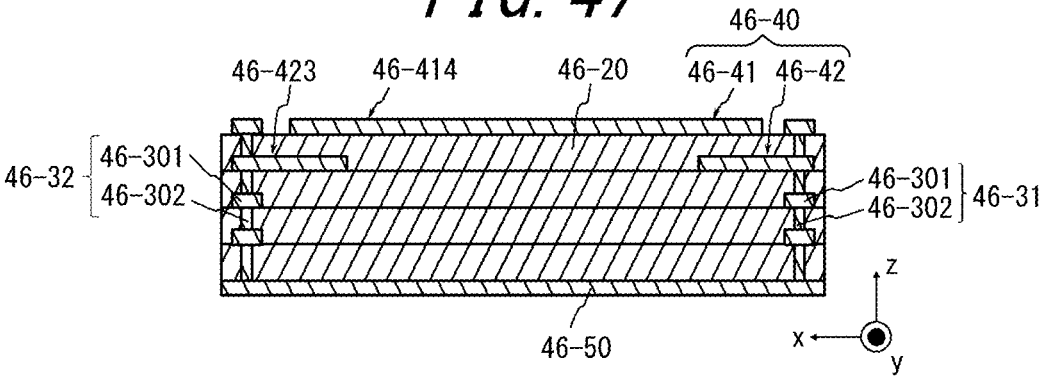
FIG. 47 is a cross-sectional diagram of the resonator illustrated in FIG. 46.

FIG. 46 illustrates another example of the resonator 10. FIG. 47 is a cross-sectional diagram taken from line XLVII-XLVII illustrated in FIG. 46. In a resonator 46-10 illustrated in FIG. 46 and FIG. 47, a third conductor 46-40 includes a first conductive layer 46-41 and a second conductive layer 46-42. The first conductive layer 46-41 includes one first floating conductor 46-414. The second conductive layer 46-42 includes two second connecting conductors 46-423. The first conductive layer 46-41 is separated from pair conductors 46-30 in the xy plane. The two second connecting conductors 46-423 overlap with the first floating conductor 46-414 in the z direction. The first floating conductor 46-414 is configured to capacitively couple to two second connecting conductors 46-423.

Figure 48:
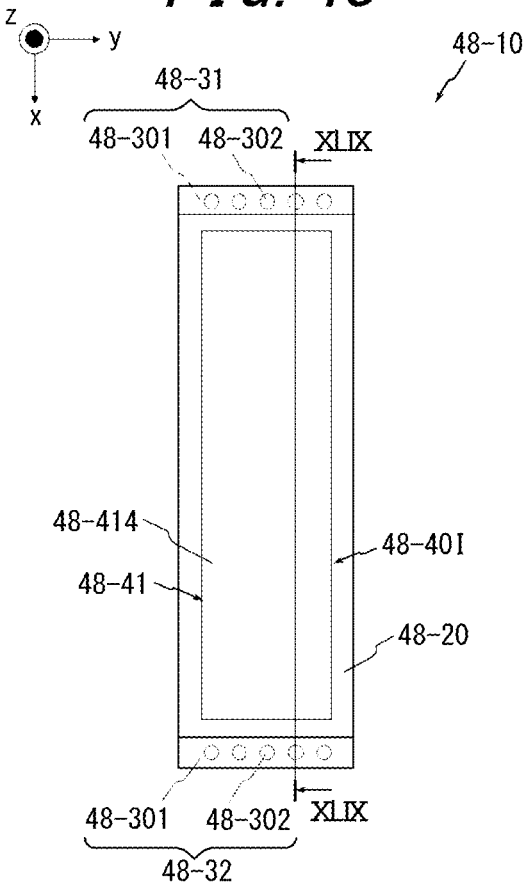
FIG. 48 is a plan view illustrating an embodiment of a resonator.
Figure 49:
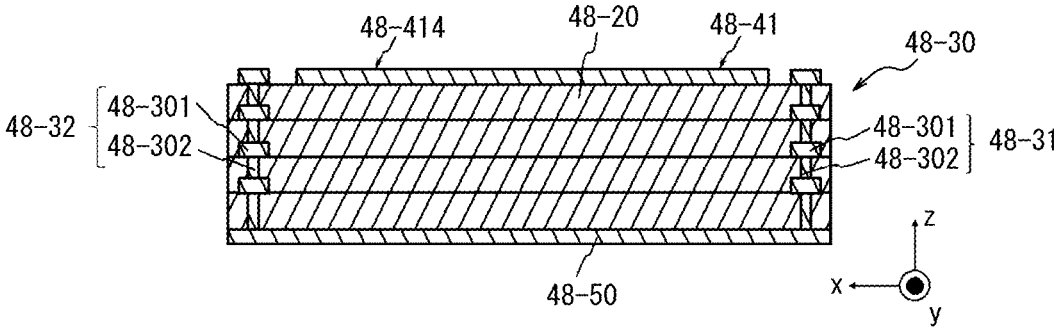
FIG. 49 is a cross-sectional diagram of the resonator illustrated in FIG. 48.

FIG. 48 illustrates another example of the resonator 10. FIG. 49 is a cross-sectional diagram taken from line XLIX-XLIX illustrated in FIG. 48. In a resonator 48-10 illustrated in FIG. 48 and FIG. 49, a third conductor 48-40 includes a first floating conductor 48-414 alone. The first floating conductor 48-414 is separated from pair conductors 48-30 in the xy plane. The first floating conductor 48-414 is configured to capacitively couple to the pair conductors 48-30.

Figure 50:
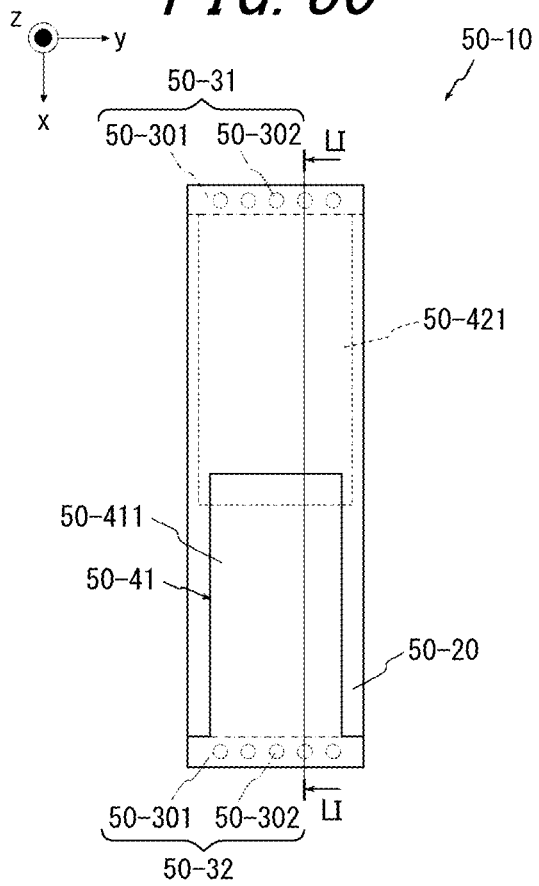
FIG. 50 is a plan view illustrating an embodiment of a resonator.
Figure 51:
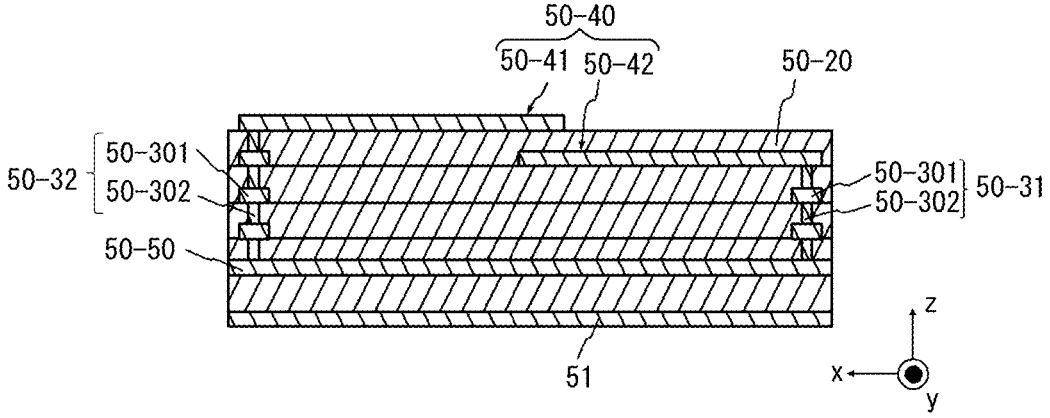
FIG. 51 is a cross-sectional diagram of the resonator illustrated in FIG. 50.

FIG. 50 illustrates another example of the resonator 10. FIG. 51 is a cross-sectional diagram taken from line LI-LI illustrated in FIG. 50. In a resonator 50-10 illustrated in FIG. 50 and FIG. 51, the configuration of the fourth conductor 50 is different from that in the resonator 42-10 illustrated in FIG. 42 and FIG. 43. The resonator 50-10 includes a fourth conductor 50-50 and a reference potential layer 51. The reference potential layer 51 is electrically connected to the ground of the device that includes the resonator 50-10. The reference potential layer 51 is separated from a third conductor 50-40 over through the fourth conductor 50-50. The fourth conductor 50-50 is positioned between the third conductor 50-40 and the reference potential layer 51. The spacing between the reference potential layer 51 and the fourth conductor 50-50 is narrower than the spacing between the third conductor 40 and the fourth conductor 50.

Figure 52:
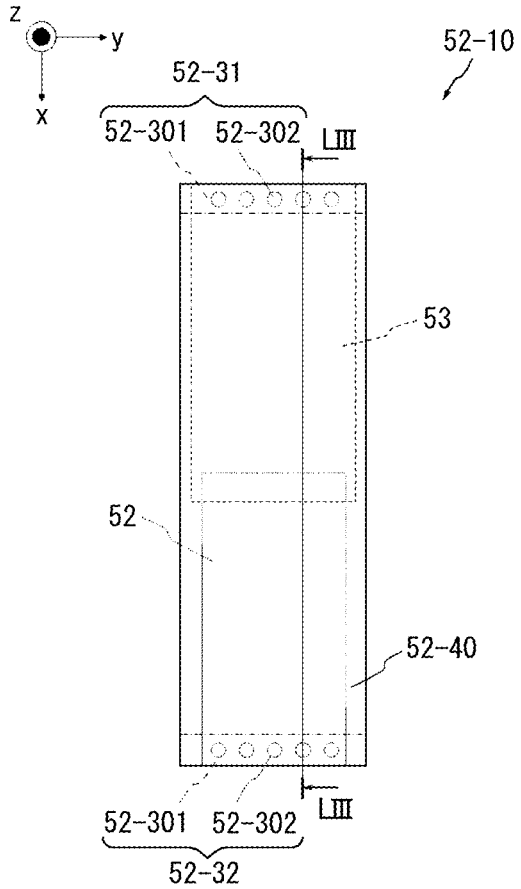
FIG. 52 is a plan view illustrating an embodiment of a resonator.
Figure 53:
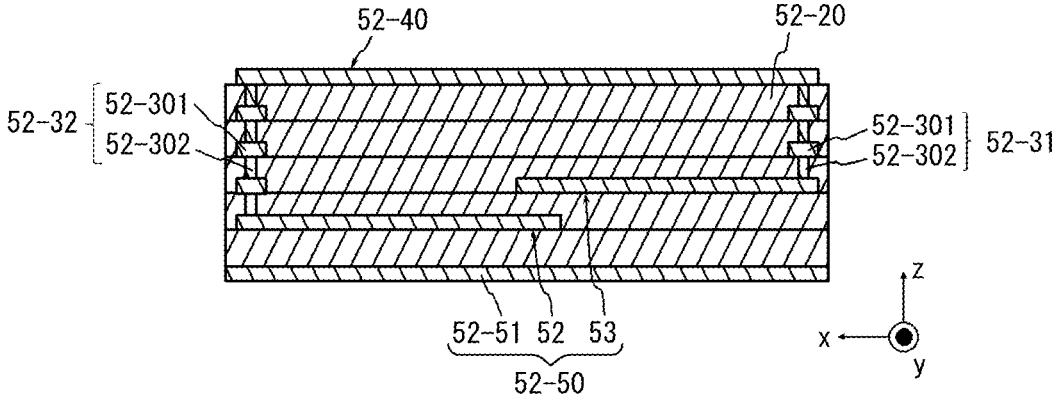
FIG. 53 is a cross-sectional diagram of the resonator illustrated in FIG. 52.

FIG. 52 illustrates another example of the resonator 10. FIG. 53 is a cross-sectional diagram taken from line LIII-LIII illustrated in FIG. 52. A resonator 52-10 includes a fourth conductor 52-50 and a reference potential layer 52-51. The reference potential layer 52-51 is electrically connected to the ground of the device that includes the resonator 52-10. The fourth conductor 52-50 includes a resonator. The fourth conductor 52-50 includes the third conductive layer 52 and the fourth conductive layer 53. The third conductive layer 52 and the fourth conductive layer 53 are configured to capacitively couple to each other. The third conductive layer 52 and the fourth conductive layer 53 are separated from each other in the z direction.

The distance between the third conductive layer 52 and the fourth conductive layer 53 is less than the distance between the fourth conductive layer 53 and the reference potential layer 52-51. The distance between the third conductive layer 52 and the fourth conductive layer 53 is less than the distance between the fourth conductor 52-50 and the reference potential layer 52-51. The third conductor 52-40 forms one conductive layer.

Figure 54:
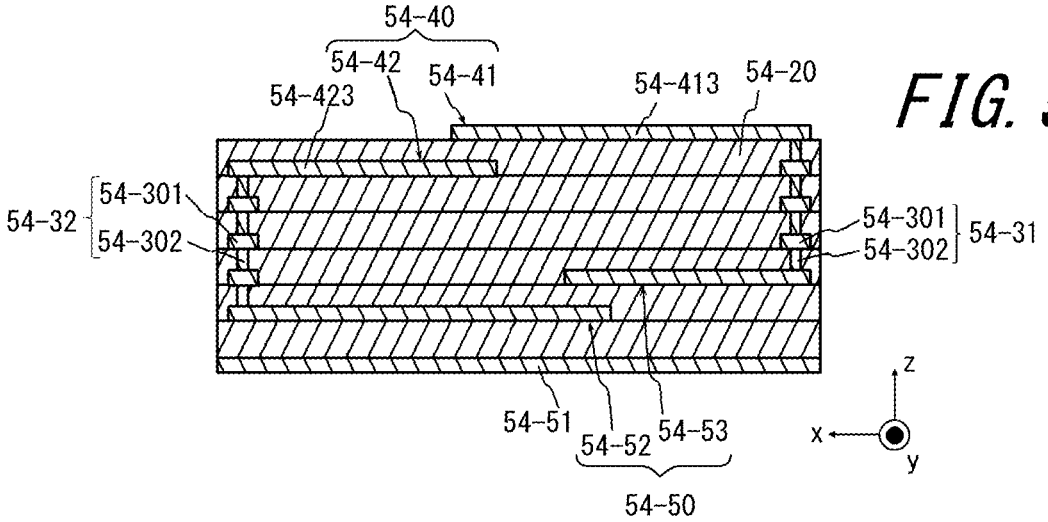
FIG. 54 is a cross-sectional diagram illustrating an embodiment of a resonator.

FIG. 54 illustrates another example of the resonator 53-10 illustrated in FIG. 53. A resonator 54-10 illustrated in FIG. 54 includes a third conductor 54-40, a fourth conductor 54-50, and a reference potential layer 54-51. The third conductor 54-40 includes a first conductive layer 54-41 and a second conductive layer 54-42. The first conductive layer 54-41 includes a first connecting conductor 54-413. The second conductive layer 54-42 includes a second connecting conductor 54-423. The first connecting conductor 54-413 is configured to capacitively couple to the second connecting conductor 54-423. The reference potential layer 54-51 is electrically connected to the ground of the device that includes the resonator 54-10. The fourth conductor 54-50 includes a third conductive layer 54-52 and a fourth conductive layer 54-53. The third conductive layer 54-52 and the fourth conductive layer 54-53 are configured to capacitively couple to each other. The third conductive layer 54-52 and the fourth conductive layer 54-53 are separated from each other in the z direction. The distance between the third conductive layer 54-52 and the fourth conductive layer 54-53 is less than the distance between the fourth conductive layer 54-53 and the reference potential layer 54-51. The distance between the third conductive layer 54-52 and the fourth conductive layer 54-53 is less than the distance between the fourth conductor 54-50 and the reference potential layer 54-51.

Figure 55:
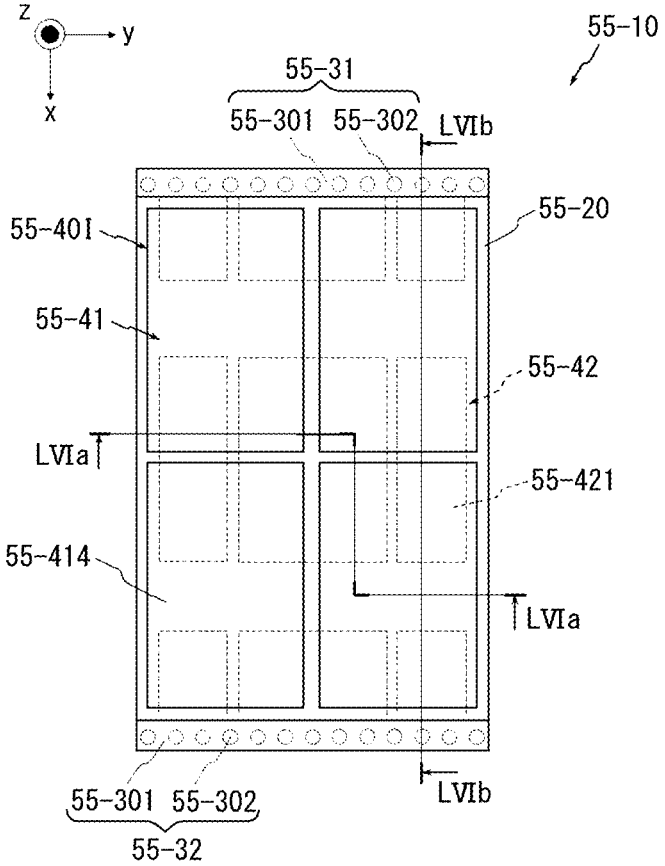
FIG. 55 is a plan view illustrating an embodiment of a resonator.
Figure 56A:
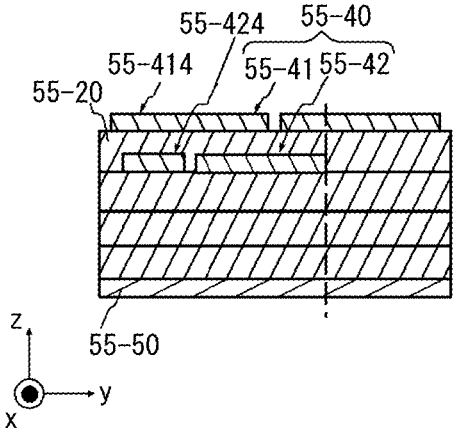
FIG. 56A is a cross-sectional diagram of the resonator illustrated in FIG. 55.
Figure 56B:
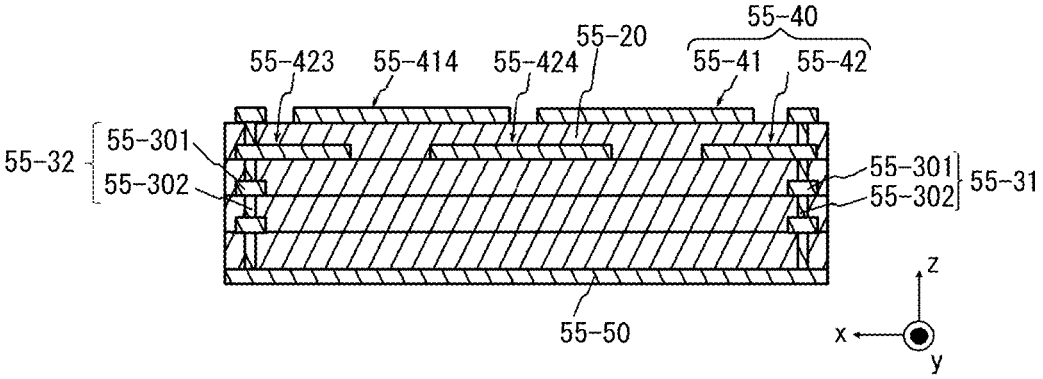
FIG. 56B is a cross-sectional diagram of the resonator illustrated in FIG. 55.

FIG. 55 illustrates another example of the resonator 10. FIG. 56A is a cross-sectional diagram taken from line LVIa-LVIa illustrated in FIG. 55. FIG. 56B is a cross-sectional diagram taken from line LVIb-LVIb illustrated in FIG. 55. In a resonator 55-10 illustrated in FIG. 55, a first conductive layer 55-41 includes four first floating conductors 55-414. The first conductive layer 55-41 does not include a first connecting conductor 55-413. In the resonator 55-10, a second conductive layer 55-42 includes six second connecting conductors 55-423 and three second floating conductors 55-424. Each of two the second connecting conductors 55-423 is configured to capacitively couple to two first floating conductors 55-414. One of the second floating conductors 55-424 is configured to capacitively couple to the four first floating conductors 55-414. Two of the second floating conductors 55-424 are configured to capacitively couple to two first floating conductors 55-414.

Figure 57:
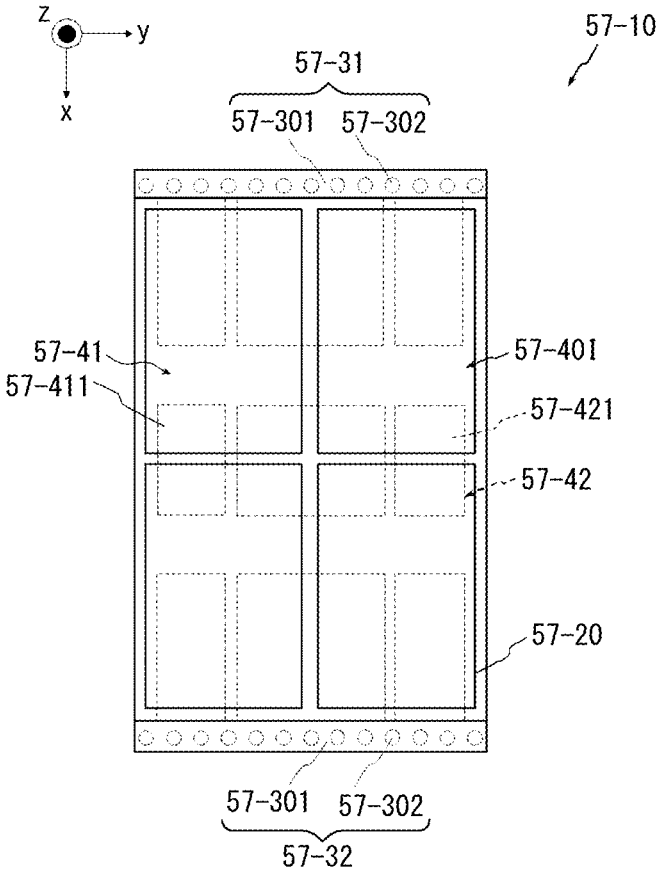
FIG. 57 is a plan view illustrating an embodiment of a resonator.

FIG. 57 is a diagram illustrating another example of the resonator 55-10 illustrated in FIG. 55. In a resonator 57-10 illustrated in FIG. 57, a second conductive layer 57-42 is different in size from the second conductive layer 55-42 of the resonator 55-10. In the resonator 57-10 illustrated in FIG. 57, the x-direction length of a second floating conductor 57-424 is less than the x-direction length of a second connecting conductor 57-423.

Figure 58:
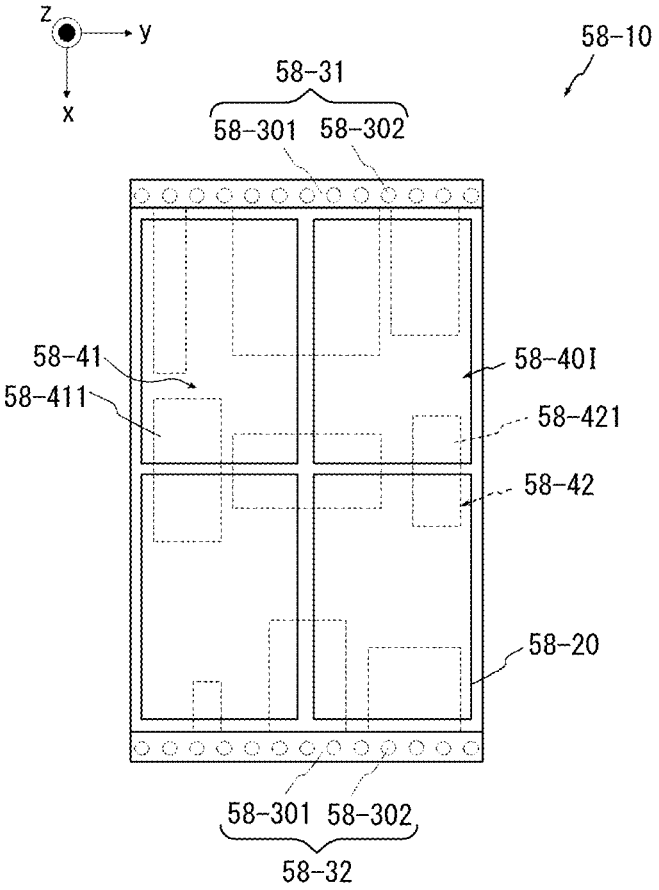
FIG. 58 is a plan view illustrating an embodiment of a resonator.

FIG. 58 is a diagram illustrating another example of the resonator 55-10 illustrated in FIG. 55. In a resonator 58-10 illustrated in FIG. 58, a second conductive layer 58-42 is different in size from the second conductive layer 55-42 of the resonator 55-10. In the resonator 58-10, each of second unit conductors 58-421 has a different first surface integral. In the resonator 58-10 illustrated in FIG. 58, each of second unit conductors 58-421 has a different x-direction length. In the resonator 58-10 illustrated in FIG. 58, each of second unit conductors 58-421 has a different y-direction length. In FIG. 58, second unit conductors 58 have different surface integrals, lengths, and widths, although this is not restrictive. In FIG. 58, some of the first integrals, lengths, and widths of the second unit conductors 58-421 may be different from one another. Some or all of the first surface integrals, lengths, and widths of the second unit conductors 58-421 may be identical to one another. Some or all of the first surface integrals, lengths, and widths of the second unit conductors 421 may be different from one another. Some or all of the first surface integrals, lengths, and widths of the second unit conductors 58-421 may be identical to one another. Some or all of the first surface integrals, lengths, and widths of some of second unit conductors 58-421 may be identical to one another.

In the resonator 58-10 illustrated in FIG. 58, second connecting conductors 58-423 arranged in the y direction have different first surface integrals. In the resonator 58-10 illustrated in FIG. 58, second connecting conductors 58-423 arranged in the y direction have different x-direction lengths. In the resonator 58-10 illustrated in FIG. 58, second connecting conductors 58-423 arranged in the y direction have different first surface integrals, lengths, and widths. However, this is not restrictive. In FIG. 58, some of the first surface integrals, the lengths, and the widths of second connecting conductors 58-423 may be different from one another. Second connecting conductors 58-423 may have some or all of the first surface integrals, lengths, and widths that are identical to one another. Second connecting conductors 58-423 may have some or all of the first surface integrals, lengths, and widths that are different from one another. Second connecting conductors 58-423 may have some or all of the first surface integrals, lengths, and widths that are identical to one another. Some of second connecting conductors 58-423 may have some or all of the first surface integrals, lengths, and widths that are identical to one another.

In the resonator 58-10, second floating conductors 58-424 arranged in the y direction have different first surface integrals. In the resonator 58-10, second floating conductors 58-424 arranged in the y direction have different x-direction lengths. In the resonator 58-10, second floating conductors 58-424 arranged in the y direction have different y-direction lengths. Second floating conductors 58-424 may different first surface integrals, lengths, and widths. However, this is not restrictive. Second floating conductors 58-424 may have some of the first surface integrals, lengths, and widths that are different from one another. Second floating conductors 58-424 may have some or all of the first surface integrals, lengths, and widths that are identical to one another. Second floating conductors 58-424 may have some or all of the first surface integrals, lengths, and widths that are different from one another. Second floating conductors 58-424 may have some or all of the first surface integrals, lengths, and widths that are identical to one another. Some of second floating conductor 58-424 may have some or all of the first surface integrals, lengths, and widths that are identical to one another.

Figure 59:
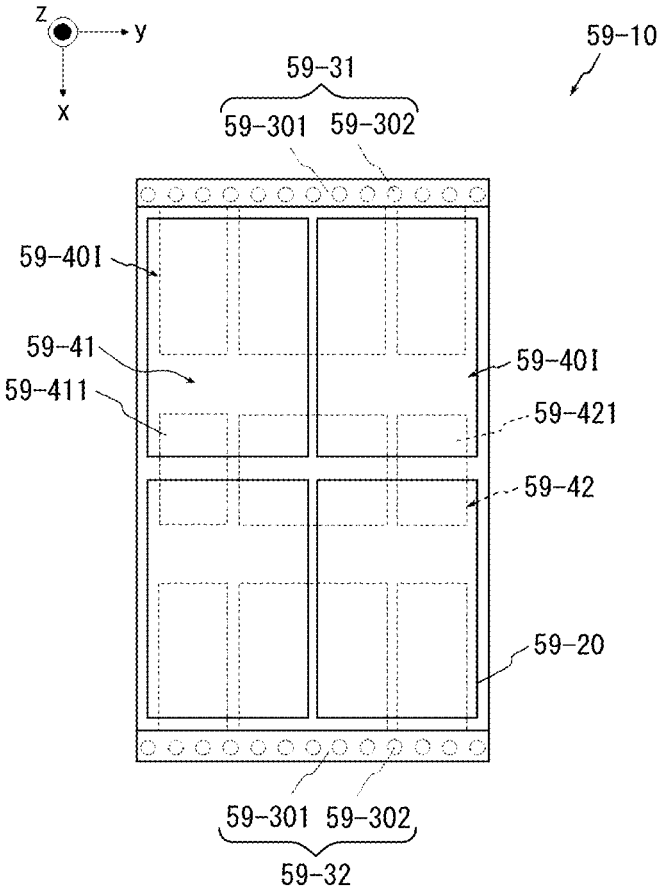
FIG. 59 is a plan view illustrating an embodiment of a resonator.

FIG. 59 is a diagram illustrating another example of the resonator 57-10 of FIG. 57. In a resonator 59-10 illustrated in FIG. 59, the spacing of a first unit conductors 59-411 in the y direction is different from the spacing of the first unit conductors 57-411 of the resonator 57-10 in the y direction. In the resonator 59-10, the spacing of the first unit conductors 59-411 in the y direction is smaller than the spacing of the first unit conductors 59-411 in the x direction. In the resonator 59-10, the current is configured to flow in the x direction by virtue of the pair conductors 59-30 that is configured to function as the electric conductor. In the resonator 59-10, the current flowing through a third conductor 59-40 in the y direction is negligible. The spacing of the first unit conductors 59-411 in the y direction may be less than the spacing of the first unit conductors 59-411 in the x direction. By shortening the spacing of the first unit conductor 59-411 in the y direction, the surface integral of the first unit conductor 59-411 may be configured to increase.

Figure 60:
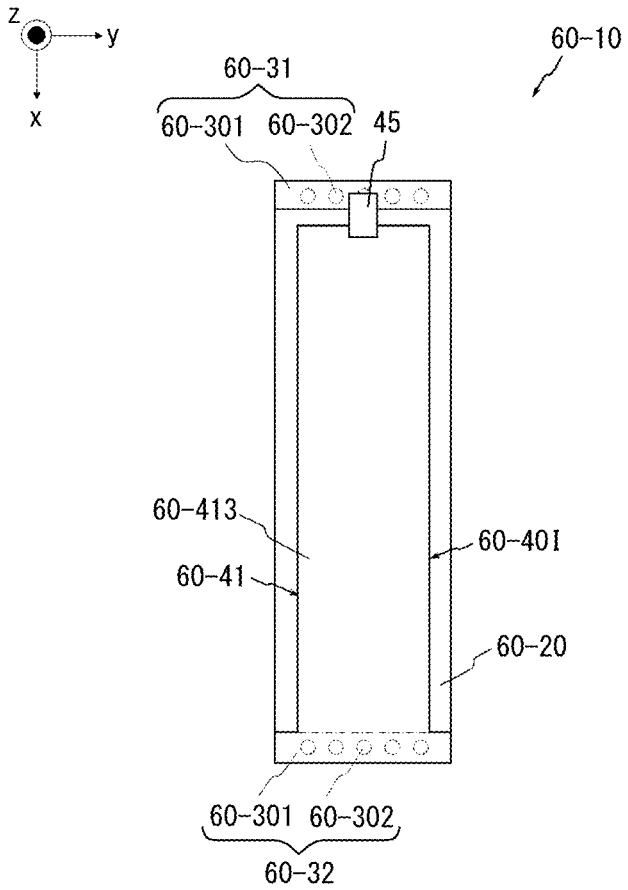
FIG. 60 is a plan view illustrating an embodiment of a resonator.
Figure 61:
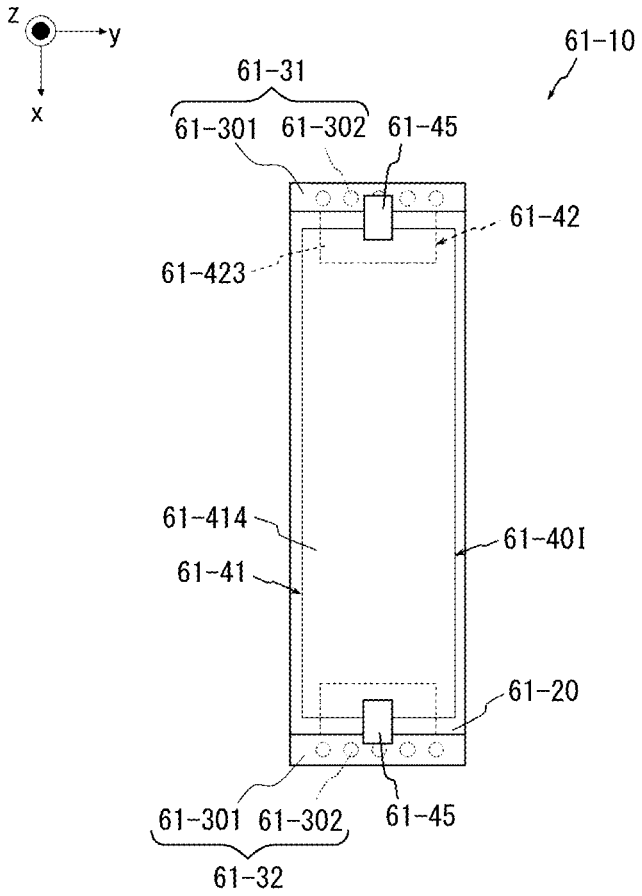
FIG. 61 is a plan view illustrating an embodiment of a resonator.
Figure 62:
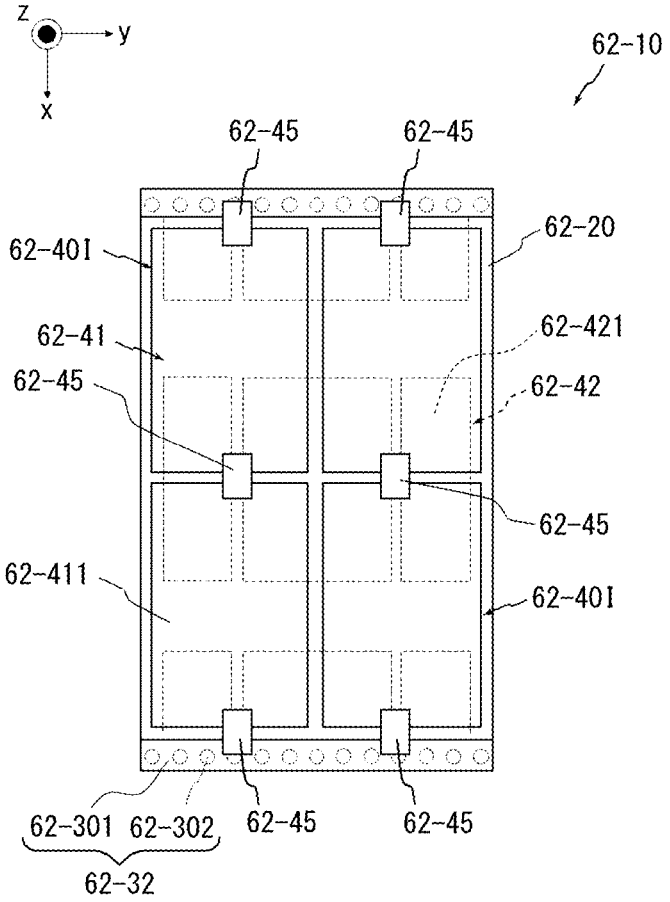
FIG. 62 is a plan view illustrating an embodiment of a resonator.

FIG. 60 to FIG. 62 are diagrams illustrating other examples of the resonator 10. Each resonator 10 includes the impedance element 45. The unit conductor to which the impedance element 45 is connected is not limited to the examples illustrated in FIG. 60 to FIG. 62. Some of the impedance elements 45 illustrated in FIG. 60 to FIG. 62 may be omitted. The impedance element 45 may have capacitance characteristics. The impedance element 45 may have inductance characteristics. The impedance element 45 may be a mechanically or electrically variable element. The impedance element 45 may connect two different conductors in one layer.

Figure 63:
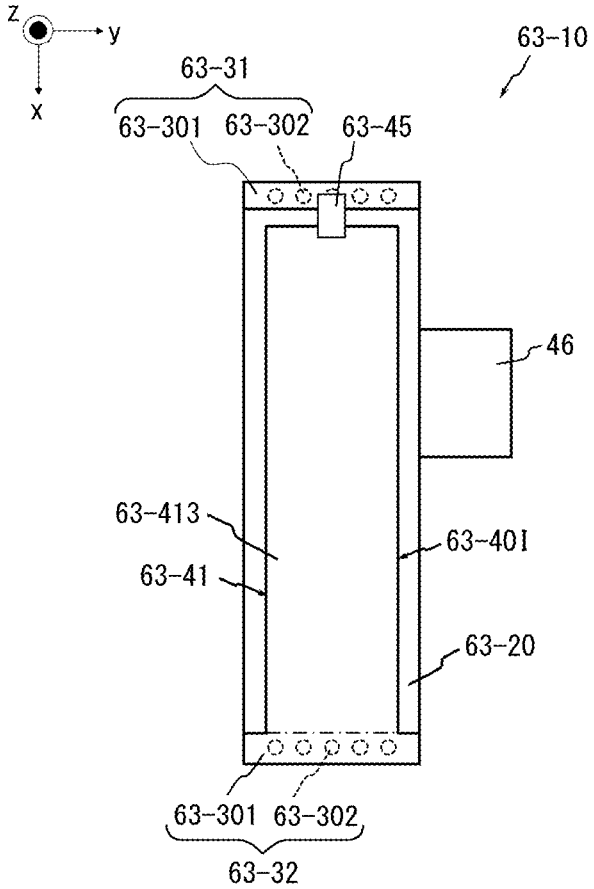
FIG. 63 is a plan view illustrating an embodiment of a resonator.

FIG. 63 is a plan view illustrating another example of the resonator 10. A resonator 63-10 includes the conductive component 46. The resonator 63-10 including the conductive component 46 is not limited to this configuration. The resonator 10 may include conductive components 46 on one side in the y direction. The resonator 10 may include one or more conductive components 46 on both sides in the y direction.

FIG. 64 is a cross-sectional diagram illustrating another example of the resonator 10. A resonator 64-10 includes a dielectric component 47. In the resonator 64-10, the dielectric component 47 overlaps with a third conductor 64-40 in the z direction. The resonator 64-10 including the dielectric component 47 is not limited to this configuration. In the resonator 10, the dielectric component 47 may overlap with a portion of the third conductor 40.

An antenna has at least one of a function of radiating electromagnetic waves and a function of receiving electromagnetic waves. Although the antenna in the present disclosure includes a first antenna 60 and a second antenna 70, this is not restrictive.

The first antenna 60 includes the base 20, the pair conductors 30, the third conductor 40, the fourth conductor 50, and a first feeding line 61. In one example, the first antenna 60 includes a third base 24 positioned on the base 20. The third base 24 may have a configuration different from that of the base 20. The third base 24 may be positioned on the third conductor 40. FIG. 65 to FIG. 78 are diagrams illustrating the first antenna 60 as an example of embodiments.

The first feeding line 61 supplies electricity to at least one of the resonators that are configured to function as artificial magnetic conductors, and are periodically arranged. In order to feed electricity to resonators, the first antenna 60 may include first feeding lines. The first feeding line 61 may be configured to electromagnetically couple to one of the resonators that are configured to function as the artificial magnetic conductor and are periodically arranged. The first feeding line 61 may be electromagnetically couple to one of the pair conductors that can be viewed as electric conductors from the resonators that are configured to function as the artificial magnetic conductor and are periodically arranged.

The first feeding line 61 configured to feed electricity to at least one of the first conductor 31, the second conductors 32, and the third conductor 40. In order to configured to feed electricity to portions of the first conductor 31, the second conductor 32, and the third conductor 40, the first antenna 60 may include first feeding lines. The first feeding line 61 may be configured to electromagnetically couple to one of the first conductor 31, the second conductor 32, and the third conductor 40. When the first antenna 60 includes the reference potential layer 51 in addition to the fourth conductor 50, the first feeding line 61 may be configured to electromagnetically couple to one of the first conductor 31, the second conductor 32, the third conductor 40, and the fourth conductor 50. The first feeding line 61 is electrically connected to one of the fifth conductive layer 301 and the fifth conductive layer 302 of the pair conductors 30. A portion of the first feeding line 61 may be integral with the fifth conductive layer 301.

The first feeding line 61 may be configured to electromagnetically couple to the third conductor 40. For example, the first feeding line 61 is configured to electromagnetically couple to one of the first unit resonators 41X. For example, the first feeding line 61 is configured to electromagnetically couple to one of the second unit conductors 42X. The first feeding line 61 is configured to electromagnetically couple to the unit conductor of the third conductor 40 at a position offset with the center in the x direction. In an embodiment, the first feeding line 61 configured to feed electricity to at least one resonator included in the third conductor 40. In an embodiment, the first feeding line 61 configured to feed electricity from at least one resonator included in the third conductor 40 to the outside. The first feeding line 61 may be at least partially located within the base 20. The first feeding line 61 may be separated from the outside from any one of two zx planes, two yz planes, and two xy planes of the base 20.

The first feeding line 61 may contact the third conductor 40 from forward or rearward of the z direction. The fourth conductor 50 may be omitted in the vicinity of the first feeding line 61. The first feeding line 61 may be configured to electromagnetically couple to the third conductor 40 through an opening of the fourth conductor 50. The first conductive layer 41 may be omitted in the vicinity of the first feeding line 61. The first feeding line 61 may be connected to the second conductive layer 42 through an opening of the first conductive layer 41. The first feeding line 61 may contact the third conductor 40 in the xy plane. The pair conductors 30 may be omitted in the vicinity of the first feeding line 61. The first feeding line 61 may be connected to the third conductor 40 through an opening of the pair conductors 30. The first feeding line 61 is connected to the unit conductor of the third conductor 40 at a position remote from the center of the unit conductor.

Figure 65:
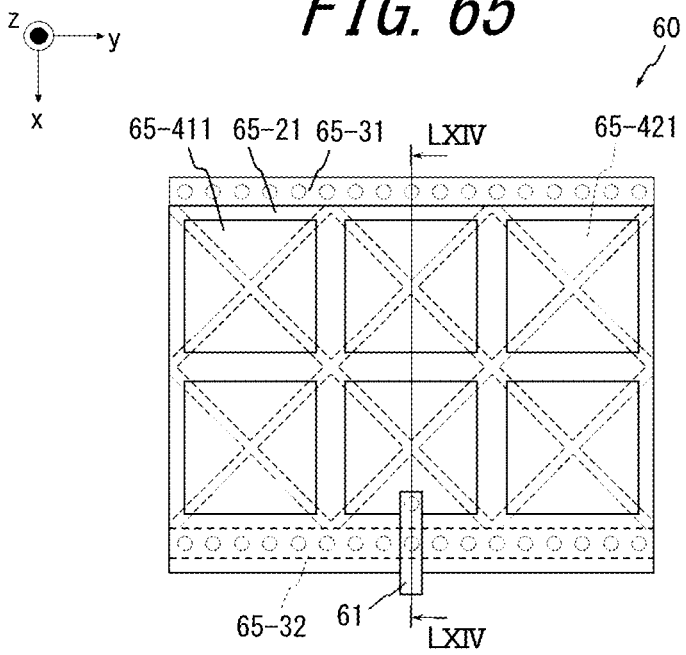
FIG. 65 is a plan view illustrating an embodiment of an antenna.
Figure 66:
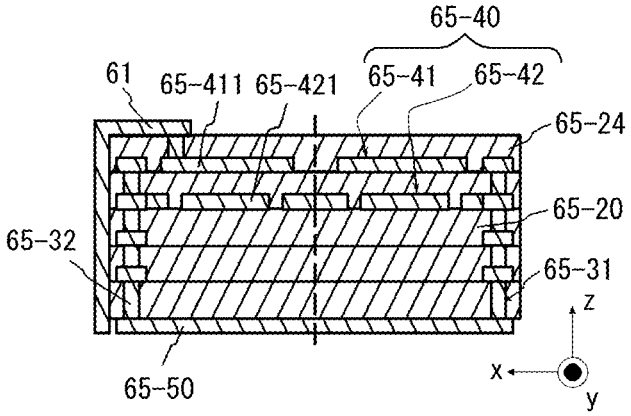
FIG. 66 is a cross-sectional diagram of the antenna illustrated in FIG. 65.

FIG. 65 is a plan view illustrating the xy plane of the first antenna 60 viewed from the z direction. FIG. 66 is a cross-sectional diagram taken from line LXIV-LXIV illustrated in FIG. 65. The first antenna 60 illustrated in FIG. 65 and FIG. 66 includes a third base 65-24 positioned on a third conductor 65-40. The third base 65-24 includes an opening on a first conductive layer 65-41. The first feeding line 61 is electrically connected to the first conductive layer 65-41 through the opening of the third base 65-24.

Figure 67:
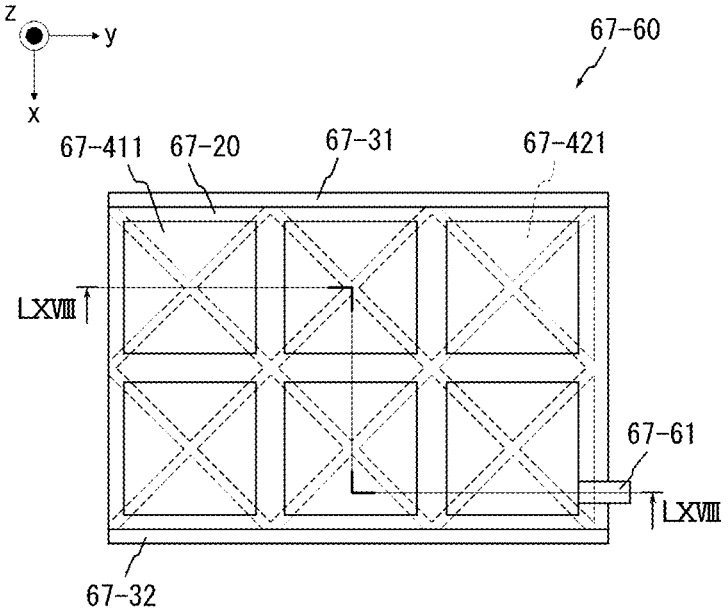
FIG. 67 is a plan view illustrating an embodiment of an antenna.

FIG. 67 is a plan view illustrating the xy plane of the first antenna 60 viewed from the z direction. FIG. 68 is a cross-sectional diagram taken from line LXVIII-LXVIII illustrated in FIG. 67. In a first antenna 67-60 illustrated in FIG. 67 and FIG. 68, a portion of a first feeding line 67-61 is positioned on a base 67-20. The first feeding line 67-61 may be connected to a third conductor 67-40 in the xy plane. The first feeding line 67-61 may be connected to a first conductive layer 67-41 in the xy plane. In an embodiment, the first feeding line 61 may be connected to the second conductive layer 42 in the xy plane.

FIG. 69 is a plan view illustrating the xy plane of the first antenna 60 viewed from the z direction. FIG. 70 is a cross-sectional diagram taken from line LXX-LXX illustrated in FIG. 69. In the first antenna 60 illustrated in FIG. 69 and FIG. 70, a first feeding line 69-61 is located within a base 69-20. The first feeding line 69-61 may be connected to a third conductor 69-40 from the opposite direction in the z direction. A fourth conductor 69-50 may have an opening. The fourth conductor 69-50 may have an opening at a position overlapping with the third conductor 69-40 in the z direction. The first feeding line 69-61 may be exposed to the outside of the base 20 through the opening.

Figure 71:
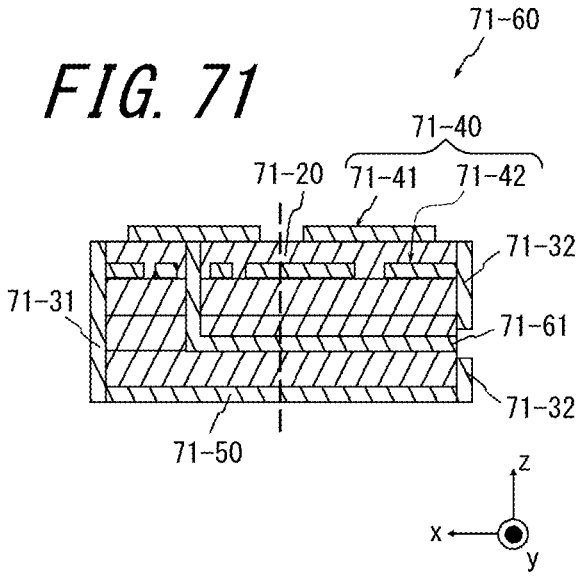
FIG. 71 is a cross-sectional diagram illustrating an embodiment of an antenna.

FIG. 71 is a cross-sectional diagram illustrating the yz plane of the first antenna 60 viewed from the x direction. Pair conductors 71-30 may have an opening. A first feeding line 71-61 can be exposed to the outside of a base 71-20 through the opening.

The electromagnetic waves radiated by the first antenna 60 include polarized wave components in the x direction more than polarized wave components in the y direction in the first plane. The polarized wave components in the x direction are less attenuated than horizontal polarization components when a metal plate approaches the fourth conductor 50 from the z direction. The first antenna 60 may maintain the radiation efficiency when the metal plate approaches from the outside.

Figure 72:
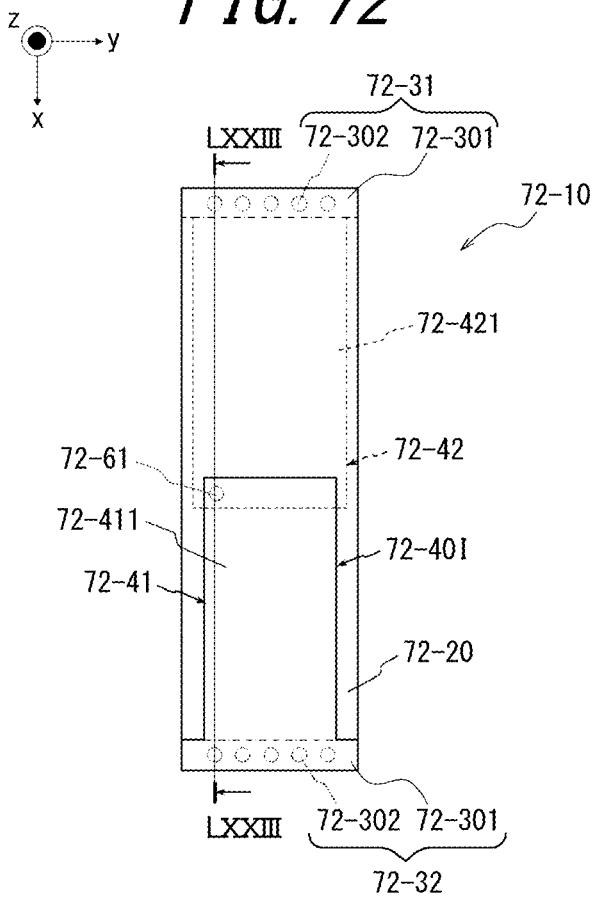
FIG. 72 is a plan view illustrating an embodiment of an antenna.
Figure 73:
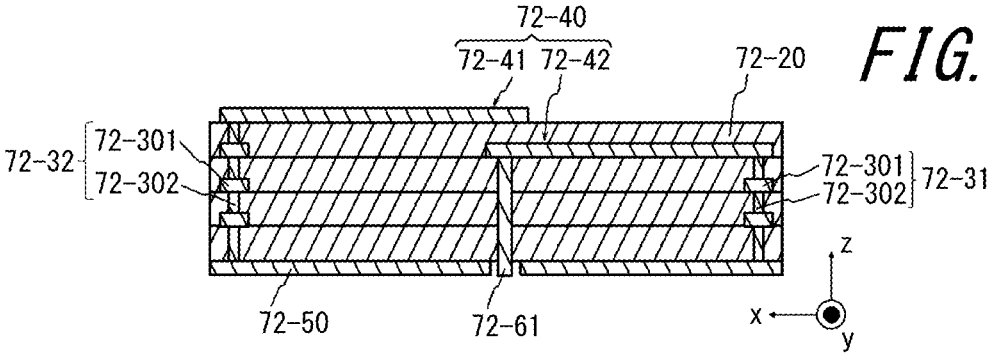
FIG. 73 is a cross-sectional diagram of the antenna illustrated in FIG. 72.
Figure 74:
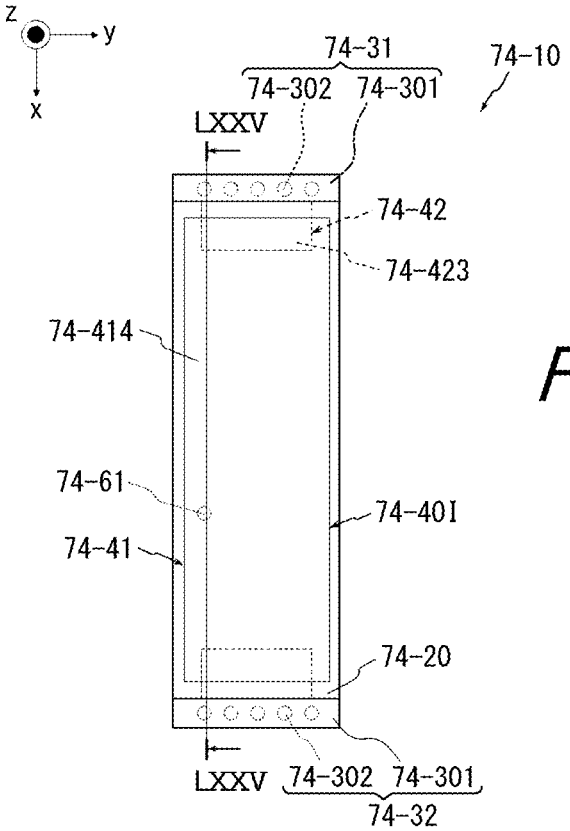
FIG. 74 is a plan view illustrating an embodiment of an antenna.
Figure 75:
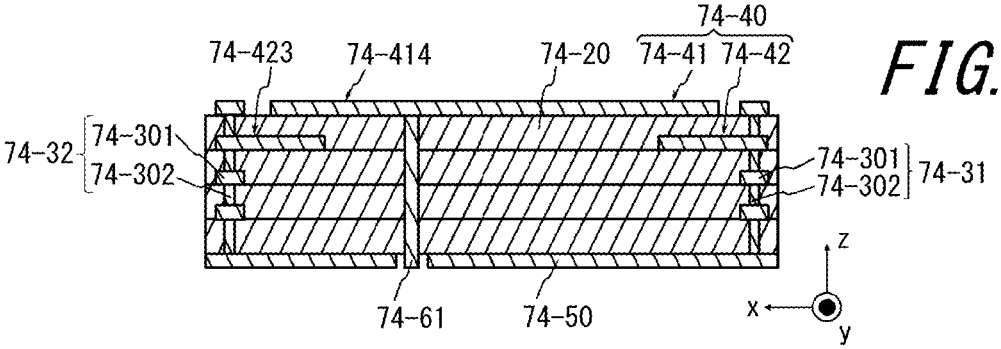
FIG. 75 is a cross-sectional diagram of the antenna illustrated in FIG. 74.
Figure 76:
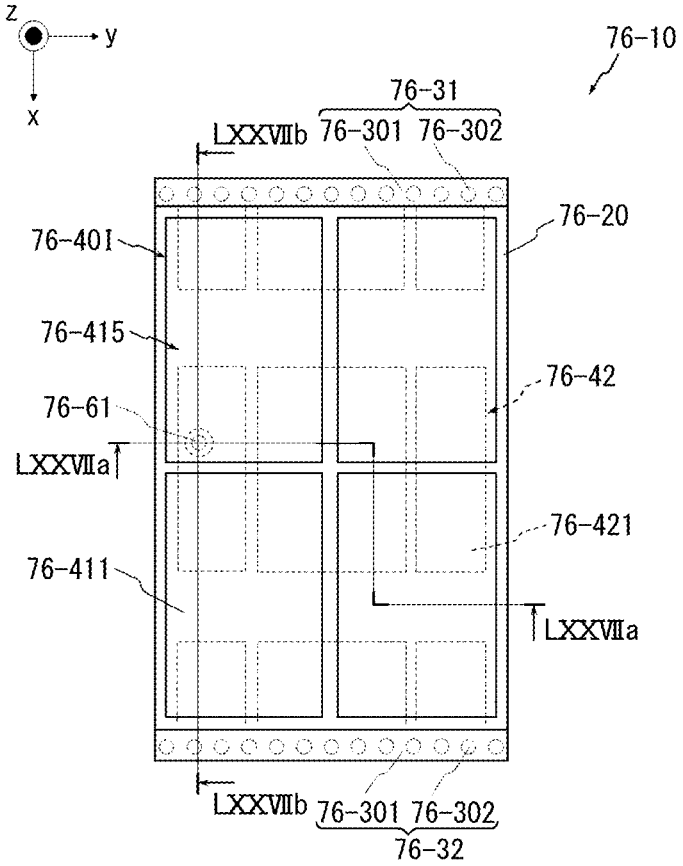
FIG. 76 is a plan view illustrating an embodiment of an antenna.
Figure 77A:
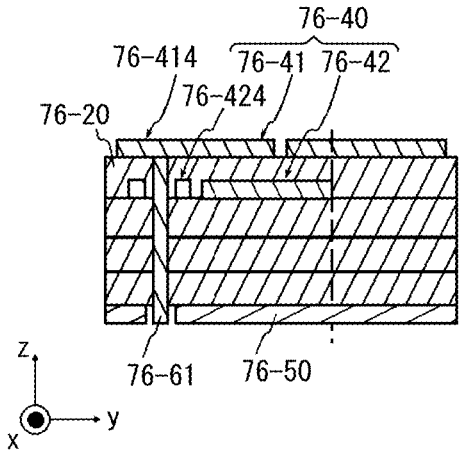
FIG. 77A is a cross-sectional diagram of the antenna illustrated in FIG. 76.
Figure 77B:
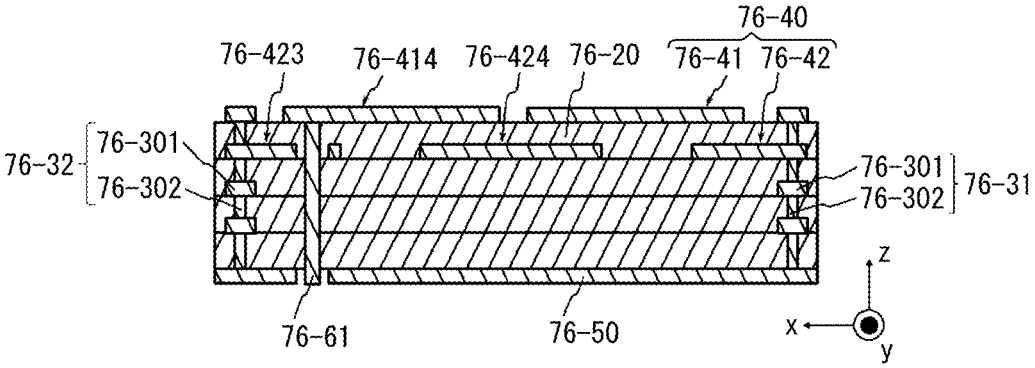
FIG. 77B is a cross-sectional diagram of the antenna illustrated in FIG. 76.
Figure 78:
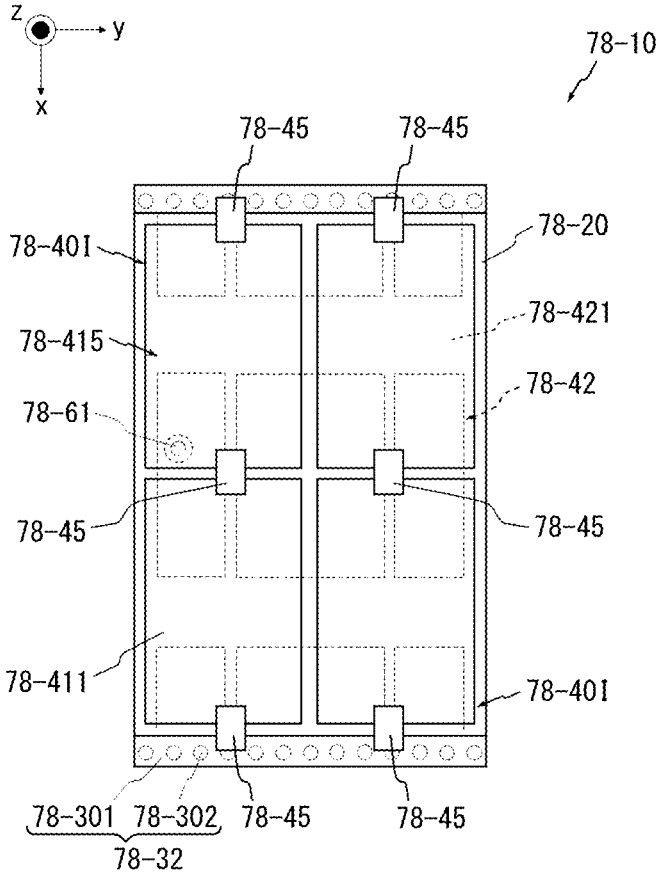
FIG. 78 is a plan view illustrating an embodiment of an antenna.

FIG. 72 illustrates another example of the first antenna 60. FIG. 73 is a cross-sectional diagram taken from line LXXIII-LXXIII illustrated in FIG. 72. FIG. 74 illustrates another example of the first antenna 60. FIG. 75 is a cross-sectional diagram taken from line LXXV-LXXV illustrated in FIG. 74. FIG. 76 illustrates another example of the first antenna 60. FIG. 77A is a cross-sectional diagram taken from line LXXVIIa-LXXVIIa illustrated in FIG. 76. FIG. 77B is a cross-sectional diagram taken from line LXXVIIb-LXXVIIb illustrated in FIG. 76. FIG. 78 illustrates another example of the first antenna 60. A first antenna 78-60 illustrated in FIG. 78 includes impedance elements 78-45.

The first antenna 60 can be configured to change the operating frequency using the impedance elements 45. The first antenna 60 includes a first feeding conductor 415 connected to the first feeding line 61 and a first unit conductor 411 that is not connected to the first feeding line 61. Impedance matching changes when the impedance element 45 is connected to the first feeding conductor 415 and another electrically conductive body. The first antenna 60 can adjust the impedance matching by connecting the first feeding conductor 415 and another electrically conductive body together by using the impedance element 45. In the first antenna 60, the impedance element 45 may be inserted between the first feeding conductor 415 and another electrically conductive body, in order to adjust the impedance matching. In the first antenna 60, the impedance element 45 may be inserted between two first unit conductors 411 that are not connected to the first feeding line 61, in order to adjust the operating frequency. In the first antenna 60, the impedance element 45 may be inserted between the first unit conductor 411 that is not connected to the first feeding line 61 and any one of the pair conductors 30, in order to adjust the operating frequency.

The second antenna 70 includes the base 20, the pair conductors 30, the third conductor 40, the fourth conductor 50, a second feeding layer 71, and a second feeding line 72. In one example, the third conductor 40 is positioned within the base 20. In one example, the second antenna 70 includes a third base 24 positioned on the base 20. The third base 24 may have a configuration different from that of the base 20. The third base 24 may be positioned on the third conductor 40. The third base 24 may be positioned on the second feeding layer 71.

The second feeding layer 71 is positioned above the third conductor 40 and spaced apart therefrom. Between the second feeding layer 71 and the third conductor 40, the base 20 or the third base 24 may be positioned. The second feeding layer 71 includes a line-type resonator, a patch-type resonator, or a slot-type resonator. The second feeding layer 71 may be called an antenna element. In an example, the second feeding layer 71 may be configured to electromagnetically couple to the third conductor 40. The resonance frequency of the second feeding layer 71 is changed from an independent resonance frequency by the electromagnetic coupling to the third conductor 40. In one example, the second feeding layer 71 is configured to receive electricity transmitted from the second feeding line 72 and is configured to resonate with the third conductor 40. In one example, the second feeding layer 71 is configured to receive power transmitted from the second feeding line 72 and configured to resonate with the third conductor 40 and the third conductor.

The second feeding line 72 is electrically connected to the second feeding layer 71. In an embodiment, the second feeding line 72 is configured to transmit electricity to the second feeding layer 71. In an embodiment, the second feeding line 72 is configured to transmit electricity from the second feeding layer 71 to the outside.

Figure 79:
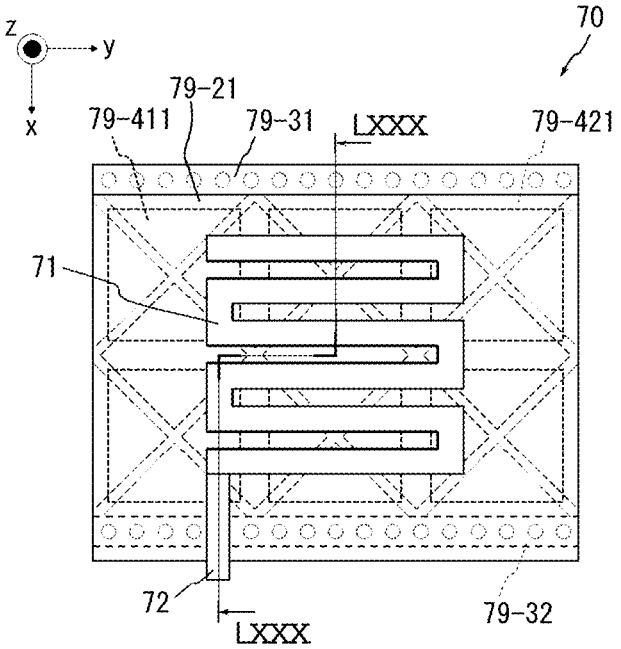
FIG. 79 is a plan view illustrating an embodiment of an antenna.
Figure 80:
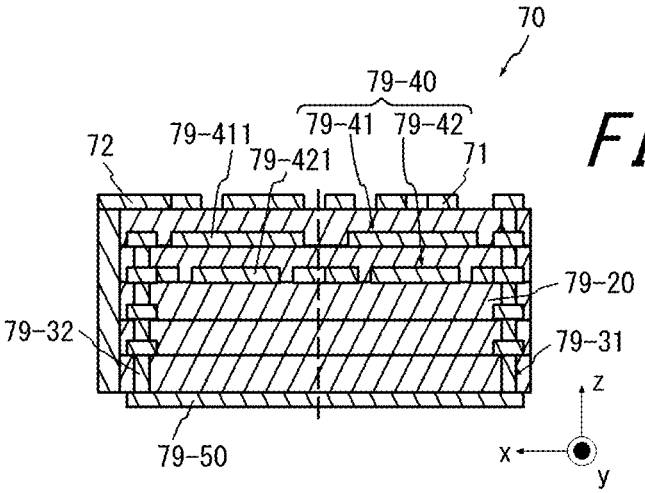
FIG. 80 is a cross-sectional diagram of the antenna illustrated in FIG. 79.

FIG. 79 is a plan view illustrating the xy plane of the second antenna 70 viewed from the z direction. FIG. 80 is a cross-sectional diagram taken from line LXXX-LXXX illustrated in FIG. 79. In the second antenna 70 illustrated in FIG. 79 and FIG. 80, a third conductor 79-40 is positioned within a base 79-20. The second feeding layer 71 is positioned on the base 79-20. The second feeding layer 71 is positioned overlapping with a unit structure 79-10X in the z direction. The second feeding line 72 is positioned on the base 79-20. The second feeding line 72 is configured to electromagnetically couple to the second feeding layer 71 in the xy plane.

Figure 81:
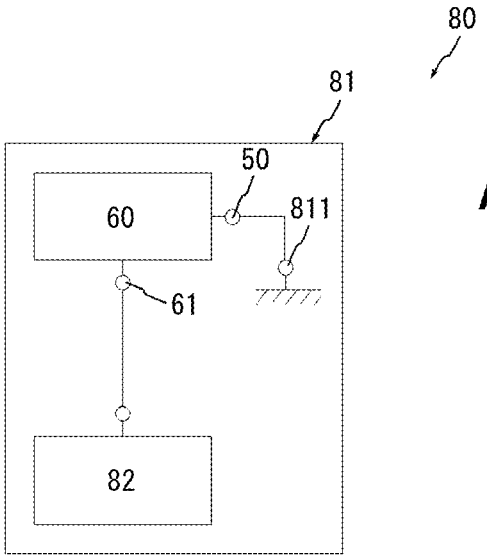
FIG. 81 is a block diagram illustrating an embodiment of a wireless communication module.
Figure 82:
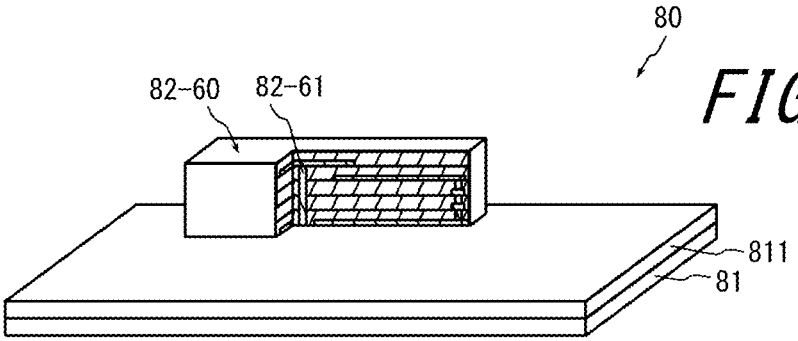
FIG. 82 is a partial cross-sectional perspective view illustrating an embodiment of a wireless communication module.

A wireless communication module according to the present disclosure includes a wireless communication module 80, as an example of embodiments. FIG. 81 is a block structural diagram illustrating the wireless communication module 80. FIG. 82 is a diagram illustrating a schematic configuration of the wireless communication module 80. The wireless communication module 80 includes a first antenna 60, a circuit board 81, and an RF module 82. The wireless communication module 80 may include a second antenna 70 in place of the first antenna 60.

The first antenna 60 is positioned on the circuit board 81. The first feeding line 61 of the first antenna 60 is configured to electromagnetically couple to the RF module 82 through the circuit board 81. The fourth conductor 50 of the first antenna 60 is configured to electromagnetically couple to a ground conductor 811 of the circuit board 81.

The ground conductor 811 may extend in the xy plane. The ground conductor 811 has a surface integral larger than that of the fourth conductor 50 in the xy plane. The ground conductor 811 is longer than the fourth conductor 50 in the y direction. The ground conductor 811 is longer than the fourth conductor 50 in the x direction. The first antenna 60 may be positioned offset from the center toward the edge of the ground conductor 811 in the y direction. The center of the first antenna 60 may be offset with the center of the ground conductor 811 in the xy plane. The center of the first antenna 60 may be offset with the centers of the first conductor 41 and second conductor 42. The point at which the first feeding line 61 is connected to the third conductor 40 may be offset with the center of the ground conductor 811 in the xy plane.

In the first antenna 60, the first current and the second current are configured to loop through the pair conductors 30. Because the first antenna 60 is positioned offset from the center of the ground conductor 811 toward the edge in the y direction, the second current flowing through the ground conductor 811 is configured to become asymmetric. When the second current flowing through the ground conductor 811 is configured to become asymmetric, in the antenna structure including the first antenna 60 and the ground conductor 811, the polarized component of the radiation waves in the x direction is configured to increase. By the increase of the polarized component of the radiation waves in the x direction, a total radiation efficiency of the radiation waves can be improved.

The RF module 82 can control the electricity to be fed to the first antenna 60. The RF module 82 is configured to modulate a baseband signal and configured to supply a modulated baseband signal to the first antenna 60. The RF module 82 can be is configured to modulate an electrical signal received by the first antenna 60 into the baseband signal.

In the first antenna 60, a change in the resonance frequency due to a conductor on the circuit board 81 side is small. By having the first antenna 60, the wireless communication module 80 can reduce the influence from the external environment.

The first antenna 60 may be integrally formed with the circuit board 81. When the first antenna 60 and the circuit board 81 are integrally formed together, the fourth conductor 50 and the ground conductor 811 are integrally formed together.

Figure 83:
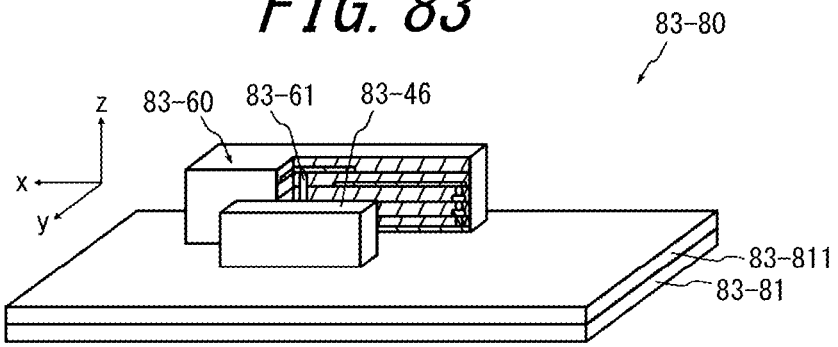
FIG. 83 is a partial cross-sectional diagram illustrating an embodiment of a wireless communication module.

FIG. 83 is a partial cross-sectional diagram illustrating another example of the wireless communication module 80. A wireless communication module 83-80 illustrated in FIG. 83 includes a conductive component 83-46. The conductive component 83-46 is positioned on a ground conductor 83-811 of a circuit board 83-81. The conductive component 83-46 is aligned with a first antenna 83-60 in the y direction. The number of the conductive components 83-46 is not limited to one, and conductive components 83-46 may be positioned on the ground conductor 83-811.

Figure 84:
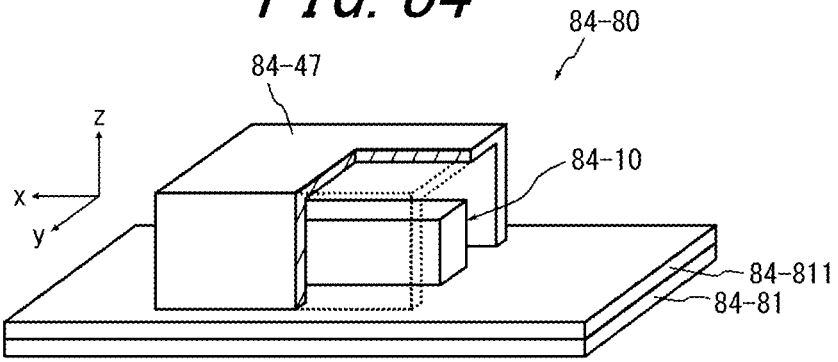
FIG. 84 is a partial cross-sectional diagram illustrating an embodiment of a wireless communication module.

FIG. 84 is a partial cross-sectional diagram illustrating another example of the wireless communication module 80. A wireless communication module 84-80 illustrated in FIG. 84 includes a dielectric component 84-47. The dielectric component 84-47 is positioned on a ground conductor 84-811 of a circuit board 84-81. A conductive component 84-46 is aligned with a first antenna 84-60 in the y direction.

Figure 85:
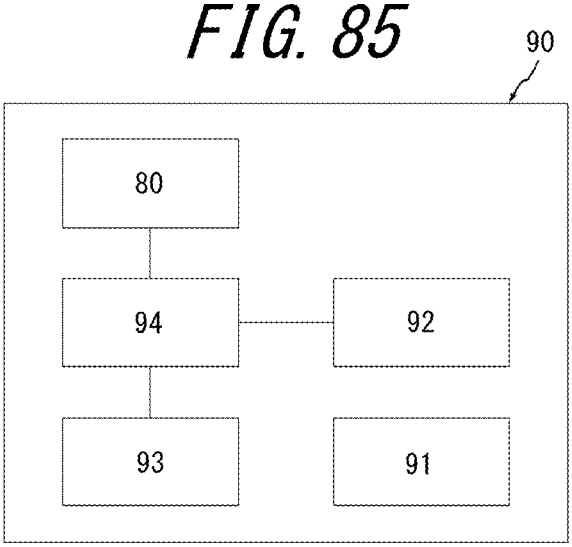
FIG. 85 is a block diagram illustrating an embodiment of a wireless communication device.
Figure 86:
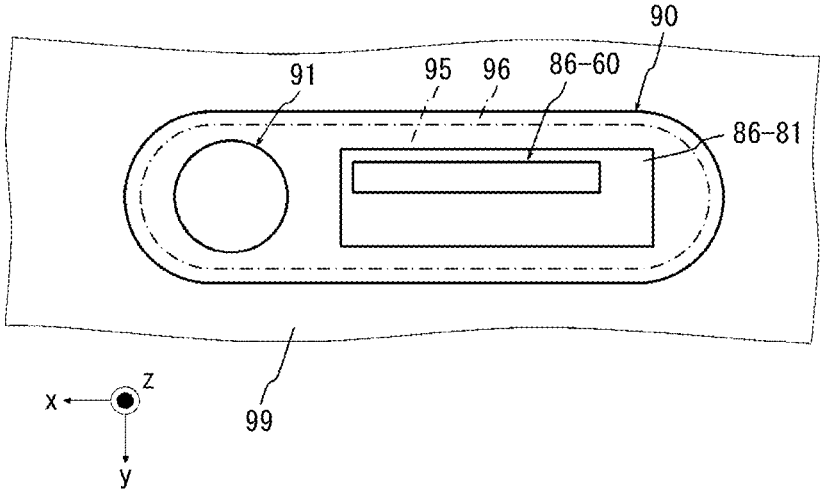
FIG. 86 is a plan view illustrating an embodiment of a wireless communication device.
Figure 87:
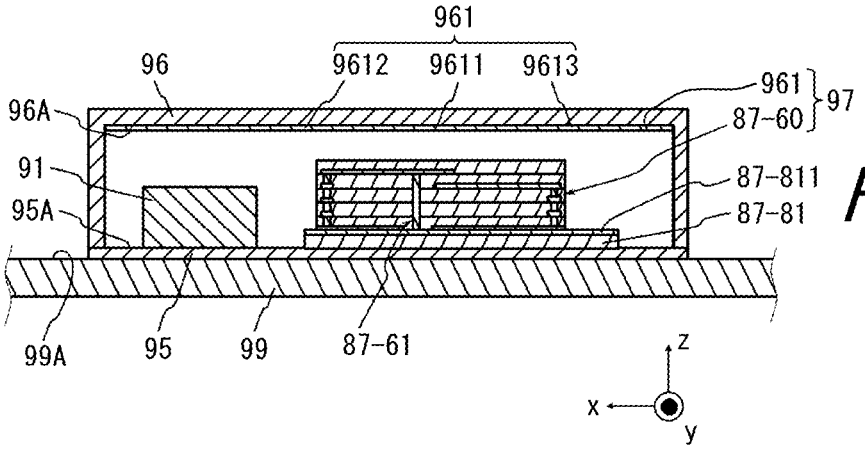
FIG. 87 is a cross-sectional diagram illustrating an embodiment of a wireless communication device.
Figure 88:
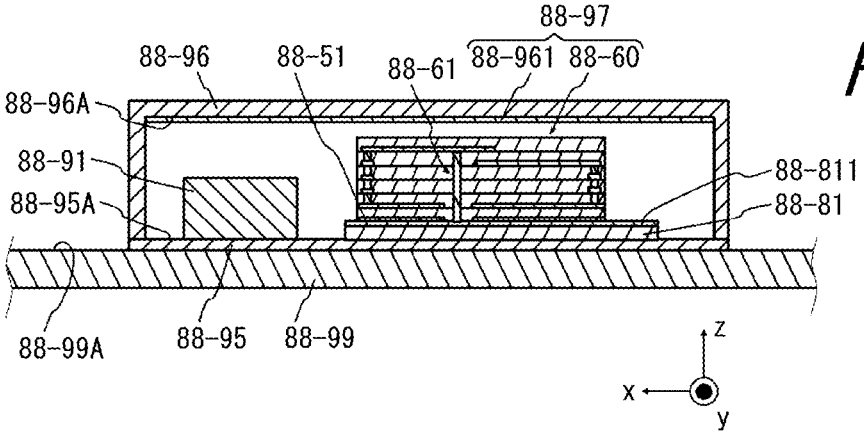
FIG. 88 is a plan view illustrating an embodiment of a wireless communication device.

A wireless communication device according to the present disclosure includes a wireless communication device 90, as an example of embodiments. FIG. 85 is a block structural diagram illustrating the wireless communication device 90. FIG. 86 is a plan view illustrating the wireless communication device 90. A part of the configuration of the wireless communication device 90 is omitted in FIG. 86. FIG. 87 is a cross-sectional diagram illustrating the wireless communication device 90. A part of the configuration of the wireless communication device 90 is omitted in FIG. 87. The wireless communication device 90 includes the wireless communication module 80, a battery 91, a sensor 92, a memory 93, a controller 94, a first case 95, and a second case 96. The wireless communication module 80 of the wireless communication device 90 includes the first antenna 60 but may include the second antenna 70. FIG. 88 illustrates one of other embodiments of the wireless communication device 90. A first antenna 88-60 of a wireless communication device 88-90 may include a reference potential layer 88-51.

The battery 91 is configured to feed electricity to the wireless communication module 80. The battery 91 can be configured to feed electricity to at least one of the sensor 92, the memory 93, and the controller 94. The battery 91 may comprise at least one of a primary battery and a secondary battery. The negative pole of the battery 91 is electrically connected to the ground terminal of the circuit board 81. The negative pole of the battery 91 is electrically connected to the fourth conductor 50 of the first antenna 60.

The sensor 92 may include, for example, a velocity sensor, a vibration sensor, an acceleration sensor, a gyro sensor, a rotational angle sensor, an angular velocity sensor, a geomagnetic sensor, a magnet sensor, a temperature sensor, humidity sensor, an atmospheric pressure sensor, an optical sensor, an illuminance sensor, a UV sensor, a gas sensor, a gas concentration sensor, an atmosphere sensor, a level sensor, an odor sensor, a pressure sensor, an air pressure sensor, a contact sensor, a wind sensor, an infrared sensor, a motion sensor, a displacement sensor, an image sensor, a weight sensor, a smoke sensor, a leakage sensor, a vital sensor, a battery remaining amount sensor, an ultrasonic sensor, or a receiver configured to receive a GPS (Global Positioning System) signal.

The memory 93 may include, for example, a semiconductor memory or the like. The memory 93 may be configured to function as a work memory of the controller 94. The memory 93 may be included in the controller 94. The memory 93 is configured to store a program describing processing contents for realizing each function of the wireless communication device 90, information used for the processing of the wireless communication device 90, and the like.

The controller 94 may include, for example, a processor. The controller 94 may include one or more processors. The processor may include a general-purpose processor is configured to read a specific program and executing a specific function, or a specialized processor is configured to dedicate for a specific process. The specialized processor may include an application-specific IC. The application-specific IC is also referred to as an ASIC. The processor may include a programmable logic device. The programmable logic device is also referred to as a PLD. The PLD may include an FPGA (Field-Programmable Gate Array). The controller 94 may be one of a SoC (System-on-a-Chip) in which one or more processors cooperate and SiP (System In a Package). The controller 94 may be configured to store various information and a program configured to operate each component of the wireless communication device 90 in the memory 93.

The controller 94 is configured to generate a transmission signal to be transmitted from the wireless communication device 90. The controller 94 may acquire, for example, measurement data from the sensor 92. The controller 94 may be configured to generate a transmission signal corresponding to the measurement data. The controller 94 can be configured to transmit a baseband signal to the RF module 82 of the wireless communication module 80.

The first case 95 and the second case 96 protect the other devices of the wireless communication device 90. The first case 95 may extend in the xy plane. The first case 95 supports the other devices. The first case 95 may support the wireless communication module 80. The wireless communication module 80 is positioned on an upper surface 95A of the first case 95. The first case 95 may support the battery 91. The battery 91 is positioned on the upper surface 95A of the first case 95. In an example of embodiments, the wireless communication module 80 and the battery 91 are arranged in the x direction on the upper surface 95A of the first case 95. The first conductor 31 is positioned between the battery 91 and the third conductor 40. The battery 91 is positioned on the other side of the pair conductors 30 as viewed from the third conductor 40.

The second case 96 may cover the other devices. The second case 96 includes an under surface 96A positioned on the z direction side of the first antenna 60. The under surface 96A extends in the xy plane. The under surface 96A is not limited to a flat surface and may include an uneven surface. The second case 96 may include an eighth conductor 961. The eighth conductor 961 is positioned at least one of the inside of, the outer side of, and the inner side of the second case 96. The eighth conductor 961 is positioned on at least one of the upper surface and a side surface of the second case 96.

The eighth conductor 961 is separated from the first antenna 60. A first body 9611 of the eighth conductor 961 is separated from the first antenna 60 in the z direction. The eighth conductor 961 may include, in addition to the first body 9611, at least one of a second body being separated from the first antenna in the x direction and a third body being separated from the first antenna 60 in the y direction. The eight conductor 961 partially is separated from the battery 91.

The eighth conductor 961 may include a first extra-body 9612 that extends to the outside in the x direction from the first conductor 31. The eighth conductor 961 may include a second extra-body 9613 that extends to the outside in the x direction from the second conductor 32. The first extra-body 9612 may be electrically connected to the first body 9611. The second extra-body 9613 may be electrically connected to the first body 9611. The first extra-body 9612 of the eighth conductor 961 is separated from the battery 91 in the z direction. The eighth conductor 961 may be configured to capacitively couple to the battery 91. The eighth conductor 961 may form a capacitance between the battery 91 and the eighth conductor 961.

The eighth conductor 961 is positioned remote from the third conductor 40 of the first antenna 60. The eighth conductor 961 is not electrically connected to each conductor of the first antenna 60. The eighth conductor 961 may be remote from the first antenna 60. The eighth conductor 961 may be electromagnetically coupled to one of the conductors of the first antenna 60. The first body of the eighth conductor 961 may be electromagnetically coupled to the first antenna 60. The first body 9611 may overlap with the third conductor 40 in the plan view from the z direction. The first body 9611 may be configured to increase transmission by electromagnetic coupling when overlapping with the third conductor 40. The eighth conductor 961 may be configured to cause a mutual inductance by its electromagnetic coupling to the third conductor 40.

The eighth conductor 961 extends in the x direction. The eighth conductor 961 extends in the xy plane. The length of the eighth conductor 961 is greater than the length of the first antenna 60 in the x direction. The length of the eighth conductor 961 in the x direction is greater than the length of the first antenna 60 in the x direction. The length of the eighth conductor 961 may be greater than ½ of the operating wavelength λ of the wireless communication device 90. The eighth conductor 961 may include a body extending in the y direction. The eighth conductor 961 may curve in the xy plane. The eighth conductor 961 may include a body extending in the z-direction. The eighth conductor 961 may curve from the xy plane to the yz plane or the zx plane.

Figure 89:
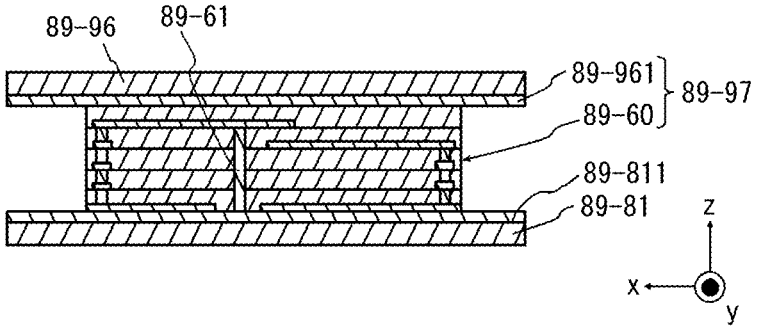
FIG. 89 is a cross-sectional diagram illustrating an embodiment of a third antenna.

In the wireless communication device 90 that includes the eighth conductor 961, the first antenna 60 and the eighth conductor 961 may be configured to electromagnetically couple to each other and may be configured to function as a third antenna 97. An operating frequency $f_c$ of the third antenna 97 may be different from the resonance frequency of the first antenna 60 alone. The operating frequency $f_c$ of the third antenna 97 may be closer to the resonance frequency of the first antenna 60 than to the resonance frequency of the eighth conductor 961 alone. The operating frequency $f_c$ of the third antenna 97 may be within the resonance frequency band of the first antenna 60. The operating frequency $f_c$ of the third antenna 97 may not be included in the resonance frequency band of the eighth conductor 961 alone. FIG. 89 illustrates another embodiment of the third antenna 97. An eighth conductor 89-961 may be integrally formed with a first antenna 89-60. A portion of the configuration of the wireless communication device 90 is omitted in FIG. 89. In the example of FIG. 89, a second case 89-96 does not need to provide the eighth conductor 961.

In the wireless communication device 90, the eighth conductor 961 is configured to capacitively couple to the third conductor 40. The eighth conductor 961 is configured to electromagnetically couple to the fourth conductor 50. The third antenna 97 improves the gain as compared to the first antenna 60 by including the first extra-body 9612 and the second extra-body 9613 of the eighth conductor in the air.

Figure 90:
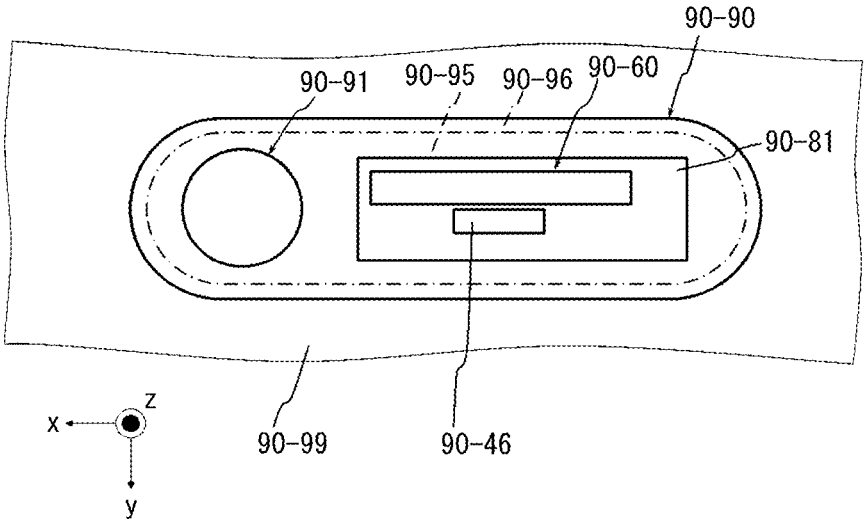
FIG. 90 is a plan view illustrating an embodiment of a wireless communication device.

FIG. 90 is a plan view illustrating another example of the wireless communication device 90. A wireless communication device 90-90 illustrated in FIG. 90 includes a conductive component 90-46. The conductive component 90-46 is positioned on a ground conductor 90-811 of a circuit board 90-81. The conductive component 90-46 is aligned with a first antenna 90-60 in the y direction. The number of the conductive components 90-46 is not limited to one, and conductive components 90-46 may be positioned on the ground conductor 90-811.

Figure 91:
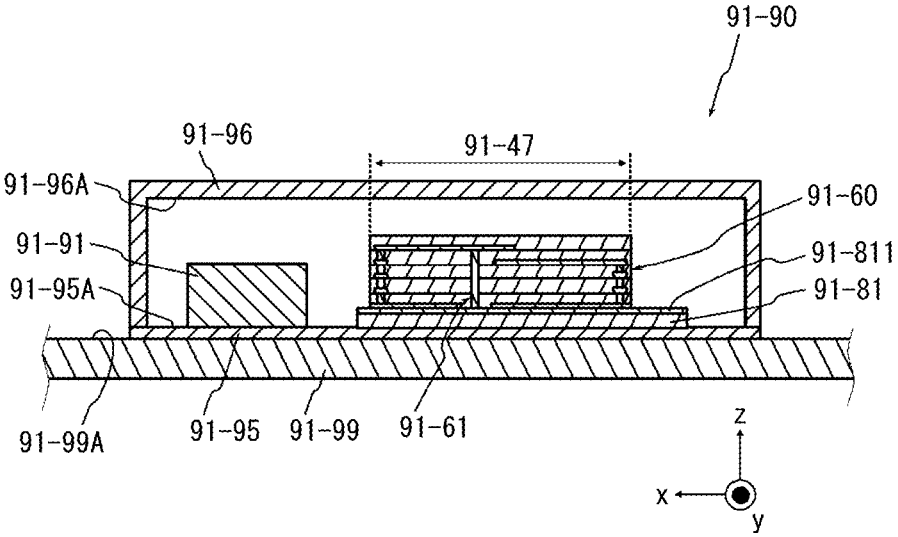
FIG. 91 is a cross-sectional diagram illustrating an embodiment of a wireless communication device.

FIG. 91 is a cross-sectional diagram illustrating another example of the wireless communication device 90. A wireless communication device 91-90 illustrated in FIG. 91 includes a dielectric component 91-47. The dielectric component 91-47 is positioned on a ground conductor 91-811 of a circuit board 91-81. The dielectric component 91-47 is aligned with a first antenna 91-60 in the y-direction. As illustrated in FIG. 91, a portion of a second case 91-96 can be configured to function as the dielectric component 91-47. The wireless communication device 91-90 may be configured to use the second case 91-96 as the dielectric component 91-47.

Figure 92:
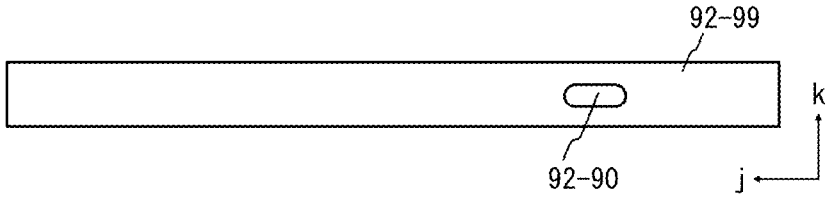
FIG. 92 is a cross-sectional diagram illustrating an embodiment of a wireless communication device.

The wireless communication device 90 may be positioned on a variety of objects. The wireless communication device 90 may be positioned on an electrically conductive body 99. FIG. 92 is a plan view illustrating an embodiment of a wireless communication device 92-90. An electrically conductive body 92-99 is a conductor configured to transmit electricity. A material of the electrically conductive body 92-99 may include a metal, a highly doped semiconductor, a conductive plastic, or liquid containing ions. The electrically conductive body 92-99 may include a non-conductive layer which does not convey electricity to the surface. A portion configured to transmit the electricity and the non-conductive layer may include a common element. For example, the electrically conductive body 92-99 containing aluminum may include non-conductive layer of aluminum oxide on the surface. The portion configured to transmit the electricity and the nonconductive layer may include different elements.

The shape of the electrically conductive body 99 is not limited to a flat plate and may include a three-dimensional shape such as a box-shape. The three-dimensional shape of the electrically conductive body 99 includes a rectangular or cylindrical shape. The three-dimensional shape may include a partially recessed shape, a partially penetrated shape, or a partially protruding shape. For example, the electrically conductive body 99 may be of a ring (torus) type. The electrically conductive body 99 may have a cavity therein. The electrically conductive body 99 may include a box having a space therein. The electrically conductive body 99 includes a cylindrical object having a space therein. The electrically conductive body 99 includes a tube having a space therein. The electrically conductive body 99 may include a pipe, a tube, or a hose.

The electrically conductive body 99 includes an upper surface 99A for mounting the wireless communication device 90 thereon. The upper surface 99A may extend over the entire surface of the electrically conductive body 99. The upper surface 99A may be a part of the electrically conductive body 99. The upper surface 99A may have a surface integral larger than that of the wireless communication device 90. The wireless communication device 90 may be positioned on the upper surface 99A of the electrically conductive body 99. The upper surface 99A may have a surface integral smaller than that of the wireless communication device 90. The wireless communication device 90 may be partially positioned on the upper surface 99A of the electrically conductive body 99. The wireless communication device 90 may be positioned in different orientations on the upper surface 99A of the electrically conductive body 99. The wireless communication device 90 may be oriented in any appropriate direction. The wireless communication device 90 may be appropriately fixed to the upper surface 99A of the electrically conductive body 99 by using a fixture. The fixture includes those for surface-fixing, such as double-sided tapes or adhesive. The fixture includes those for point-fixing, such as a screw or a nail.

The upper surface 99A of the electrically conductive body 99 may include a portion extending in a j direction. The portion extending in the j direction is longer than the length in a k direction. The j direction and the k direction are orthogonal to each other. The j direction is the direction in which the electrically conductive body 99 extends. The k direction is the direction in which the length of the electrically conductive body 99 is less than the length thereof in the j direction.

The wireless communication device 90 is placed on the upper surface 99A of the electrically conductive body 99. The first antenna 60 induces a current in the electrically conductive body 99 by being electromagnetically coupled to the electrically conductive body 99. The electrically conductive body 99 is configured to radiate electromagnetic waves due to the induced current. The electrically conductive body 99 that is configured to function as a portion of the antenna when the wireless communication device 90 is placed thereon. A transmission direction of the wireless communication device 90 is changed by the electrically conductive body 99.

The wireless communication device 90 may be positioned on the upper surface 99A in such a manner that the x direction extends in the j direction. The wireless communication device 90 may be positioned on the upper surface 99A of the electrically conductive body 99 in such a manner as to be aligned with the x-direction in which the first conductor 31 and the second conductor 32 are arranged. When the wireless communication device 90 is positioned on the electrically conductive body 99, the first antenna 60 may be configured to electromagnetically couple to the electrically conductive body 99. The fourth conductor 50 of the first antenna 60 is configured to generate a second current in the x direction. In the electrically conductive body 99 configured to electromagnetically couple to the first antenna 60, a current is induced by the second current. When the x direction of the first antenna 60 and the j direction of the electrically conductive body 99 are aligned with each other, the current flowing in the j direction is configured to increase in the electrically conductive body 99. When the x direction of the first antenna 60 and the j direction of the electrically conductive body 99 are aligned with each other, the radiation by the induced current is configured to increase in the electrically conductive body 99. An angle of the x direction with respect to the j direction may be 45 degrees or less.

The ground conductor 811 of the wireless communication device 90 is separated from the electrically conductive body 99. The wireless communication device 90 may be positioned on the upper surface 99A in such a manner that the direction in the long sides of the upper surface 99A is aligned with the x direction in which the first conductor 31 and the second conductor 32 are arranged. The upper surface 99A may include a rhombus shape or a circular shape, other than a rectangular shape. The electrically conductive body 99 may include a rhombus-shaped surface. The rhombus-shaped surface may be configured to function as the upper surface 99A for mounting the wireless communication device 90 thereon. The wireless communication device 90 may be positioned on the upper surface 99A in such a manner that the direction in the long diagonal of the upper surface 99A is aligned with the x direction in which the first conductor 31 and the second conductor 32 are arranged. The upper surface 99A is not limited to a flat surface. The upper surface 99A may include an uneven surface. The upper surface 99A may include a curved surface. The curved surface includes a ruled surface. The curved surface includes a cylindrical surface.

The electrically conductive body 99 extends in the xy plane. The length of the electrically conductive body 99 in the x direction may be greater than the length in the y-direction. The length of the electrically conductive body 99 in the y direction may be less than ½ of the wavelength $\lambda_c$ at the operating frequency $f_c$ of the third antenna 97. The wireless communication device 90 may be positioned on the electrically conductive body 99. The electrically conductive body 99 is separated from the fourth conductor 50 in the z-direction. The length of the electrically conductive body 99 in the x direction is longer than the fourth conductor 50. The surface integral of the electrically conductive body 99 in the xy plane is larger than that of the fourth conductor 50. The electrically conductive body 99 is separated from the ground conductor 811 in the z-direction. The length of the electrically conductive body 99 in the x direction is longer than the ground conductor 811. The surface integral of the electrically conductive body 99 in the xy plane is larger than that of the ground conductor 811.

The wireless communication device 90 may be positioned on the electrically conductive body 90 in an orientation in which the direction x in which the first conductor 31 and the second conductor 32 are arranged is aligned with the extending direction of the electrically conductive body 99. In other words, the wireless communication device 90 may be positioned on the electrically conductive body 99 in an orientation in which the direction of the current flowing in the first antenna 60 in the xy plane and the extending direction of the electrically conductive body 99 are aligned with each other.

A change of the resonant frequency is small in the first antenna 60 due to the conductor of the circuit board 81. By having of the first antenna 60, the wireless communication device 90 may be configured to reduce the influence from the external environment.

In the wireless communication device 90, the ground conductor 811 is configured to capacitively couple to the electrically conductive body 99. Because the electrically conductive body 99 includes a portion extending to the outside from the third antenna 97, the wireless communication device 90 is configured to improve the gain as compared to the first antenna 60.

The wireless communication device 90 may be attached to a position corresponding to $(2n-1)\times\lambda/4$ (an odd multiple of a quarter of the operating wavelength $\lambda$) from the top end of the electrically conductive body 99, where n is an integer. At this position, a standing wave of a current is induced in the electrically conductive body 99. Because of the induced standing wave, the electrically conductive body 99 is configured as an electromagnetic radiation source. The wireless communication device 90 attached in this manner improves a communication performance.

Figure 93:
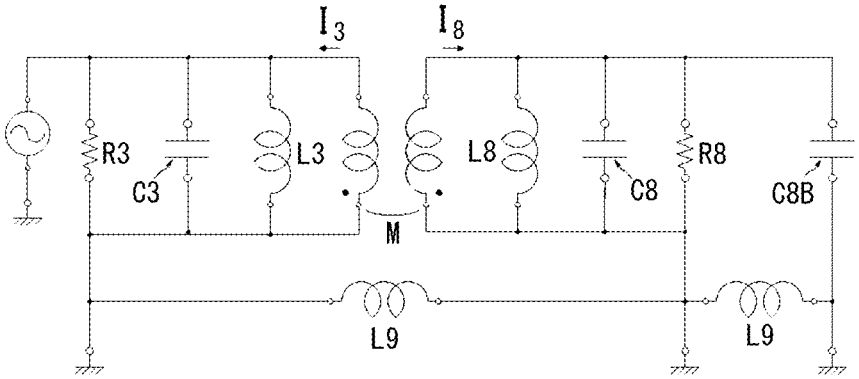
FIG. 93 is a diagram illustrating a schematic circuit of a wireless communication device.
Figure 94:
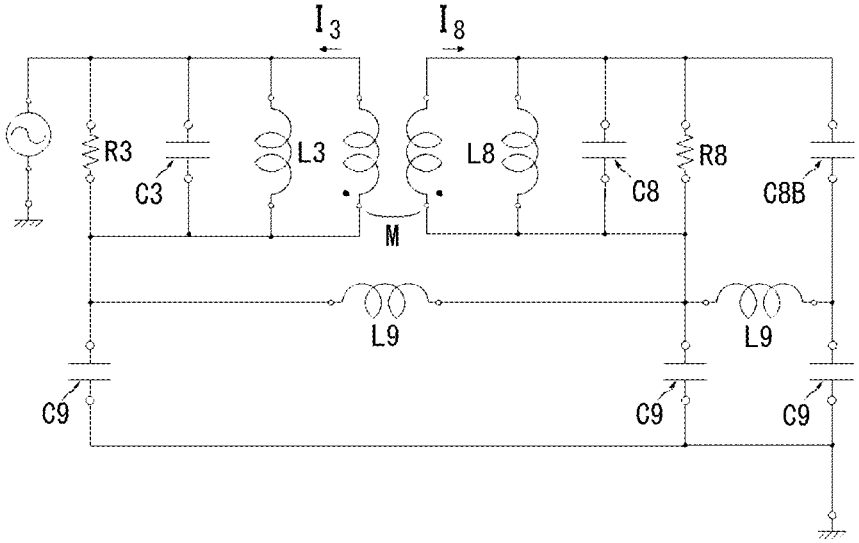
FIG. 94 is a diagram illustrating a schematic circuit of a wireless communication device.

In the wireless communication device 90, a resonant circuit in the air and a resonant circuit on the electrically conductive body 99 may be different from each other. FIG. 93 illustrates a schematic circuit of the resonance structure formed in the air. FIG. 94 illustrates a schematic circuit of the resonance structure formed on the electrically conductive body 99. L3 represents an inductance of the resonator 10, L8 represents an inductance of the eighth conductor 961, L9 represents an inductance of the electrically conductive body 99, and M represents a mutual inductance of L3 and L8. C3 represents a capacitance of the third conductor 40, C4 represents a capacitance of the fourth conductor 50, C8 represents a capacitance of the eighth conductor 961, C8B represents a capacitance of the eighth conductor 961 and the battery 91, and C9 represents a capacitance of the electrically conductive body 99 and the ground conductor 811. R3 represents a radiation resistance of the resonator 10, and R8 represents a radiation resistance of the eighth conductor 961. The operating frequency of the resonator 10 is lower than the resonance frequency of the eighth conductor. In the wireless communication device 90, the ground conductor 811 is configured as a chassis ground in the air. In the wireless communication device 90, the fourth conductor 50 is configured to capacitively couple to the electrically conductive body 99. In the wireless communication device 90 on the electrically conductive body 99, the electrically conductive body 99 is configured to virtually function as the chassis ground.

In embodiments, the wireless communication device 90 includes the eighth conductor 961. The eighth conductor 961 is configured to electromagnetically couple to the first antenna 60 and capacitively couple to the fourth conductor 50. The wireless communication device 90 can be configured to increase the operating frequency when placed onto the electrically conductive body 99 from the air, by increasing the capacitance C8B caused by the capacitive coupling. The wireless communication device 90 can be configured to lower the operating frequency when placed onto the electrically conductive body 99 from the air, by increasing the mutual inductance M caused by the electromagnetic coupling. The wireless communication device 90 can be configured to adjust a change in the operating frequency caused when the wireless communication device 90 is placed onto the electrically conductive body 99 from the air, by changing the balance between the capacitance C8B and the mutual inductance M. The wireless communication device 90 may be configured to reduce the change in the operating frequency that occurs when the wireless communication device 90 is placed onto the electrically conductive body 99 from the air, by changing the balance between the capacitance C8B and the mutual inductance M.

The wireless communication device 90 includes the eight conductor 961 that is configured to electromagnetically couple to the third conductor 40 and capacitively couple to the fourth conductor 50. By having the eighth conductor 961, the wireless communication device 90 can be configured to adjust a change in the operating frequency that occurs when the wireless communication device 90 is placed onto the electrically conductive body 99 from the air. By having the eighth conductor 961, the wireless communication device 90 can be configured to reduce a change in the operating frequency that occurs when the wireless communication device 90 is placed onto the electrically conductive body 99 from the air.

Similarly, in the wireless communication device 90 that does not include the eighth conductor 961, the ground conductor 811 is configured as the chassis ground in the air. Similarly, in the wireless communication device 90 that does not include the eighth conductor 961, the electrically conductive body 99 is configured to virtually function as the chassis ground on the electrically conductive body 99. The resonance structure that includes the resonator 10 can oscillate even when the chassis ground is changed. It corresponds to that the resonator 10 including the reference potential layer 51 and the resonator 10 without including the reference potential layer 551 can oscillate.

Figure 95:
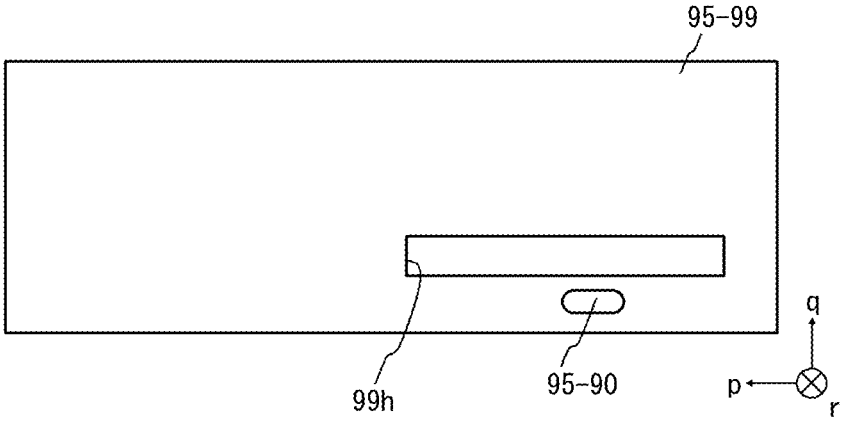
FIG. 95 is a plan view illustrating an embodiment of a wireless communication device.

FIG. 95 is a plan view illustrating an embodiment of the wireless communication device 90. An electrically conductive body 95-99 may have a through hole 99*h*. The through hole 99*h* may include a portion that extends in a p direction. A length of the through-hole 99*h* in the p direction is greater than a length in a q direction. The p direction and the q direction are orthogonal to each other. The p direction is the direction in which the electrically conductive body 95-99 extends. The q direction is the direction in which the length of the electrically conductive body 99 is less than the length in the p direction. An r direction is a direction orthogonal to the p direction and the q direction.

The wireless communication device 90 may be positioned in the vicinity of the through-hole 99*h* of the electrically conductive body 99 in such a manner that the x direction extends in the p direction. The wireless communication device 90 may be positioned in the vicinity of the through-hole 99*h* of the electrically conductive body 99 in such a manner as to be aligned with the x-direction in which the first conductor 31 and the second conductor 32 are arranged. When the wireless communication device 90 is positioned on the electrically conductive body 99, the first antenna 60 may be configured to electromagnetically couple to the electrically conductive body 99. In the fourth conductor 50 of the first antenna 60, a second current that is configured to flow in the x direction is generated. In the electrically conductive body 99 electromagnetically coupled to the first antenna 60, a current in the p direction is induced by the second current. The induced current may be configured to flow around a periphery of the through-hole 99*h*. The electrically conductive body 99 is configured to radiate the electromagnetic waves from the through hole 99*h* as a slot. The electromagnetic waves from the through hole 99*h* as the slot are radiated to the second surface paired with the first surface having the wireless communication device 90 mounted thereon.

When the x direction of the first antenna 60 and the p direction of the electrically conductive body 99 are aligned with each other, the current flowing in the p direction is configured to increase in the electrically conductive body 99. When the x direction of the first antenna 60 and the p direction of the electrically conductive body 99 are aligned with each other, the radiation is increased by the induced current in the through hole 99*h* of the electrically conductive body 99. The angle of the x direction with respect to the p direction may be 45 degrees or less. In the through hole 99*h*, the electromagnetic radiation is configured to increase when the length in the p direction is equal to the operating wavelength of the operating frequency. The through hole 99*h* is configured to function as a slot antenna when the length in the p direction satisfies $(n\times\lambda)/2$, where $\lambda$ represents the operating wavelength and n is an integer. The radiation of the electromagnetic waves is increased by standing waves induced by the through hole 99*h*. The wireless communication device 90 may be positioned at a position expressed by $(m\times\lambda)/2$ from the p-direction edge of the through hole 99*h*. Here, m is an integer equal to or greater than 0 and equal to or smaller than n. The wireless communication device 90 may be positioned at a position closer to the through hole 99*h* than a position expressed by $(m\times\lambda)/2$ from the through hole 99*h*.

Figure 96:
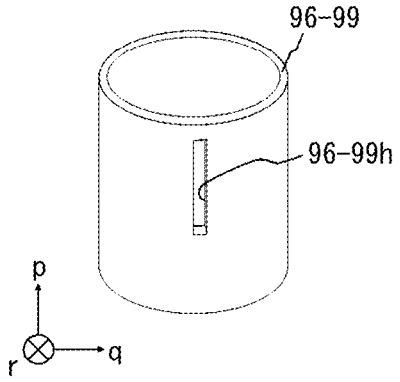
Figure 97A:
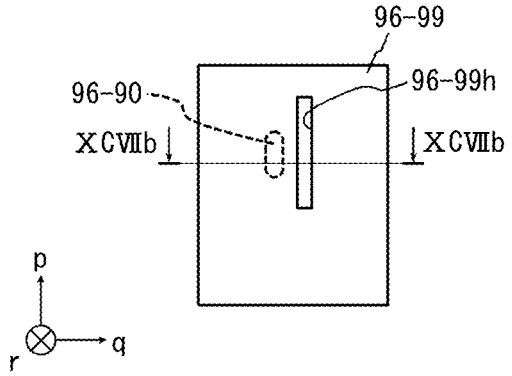
Figure 97B:
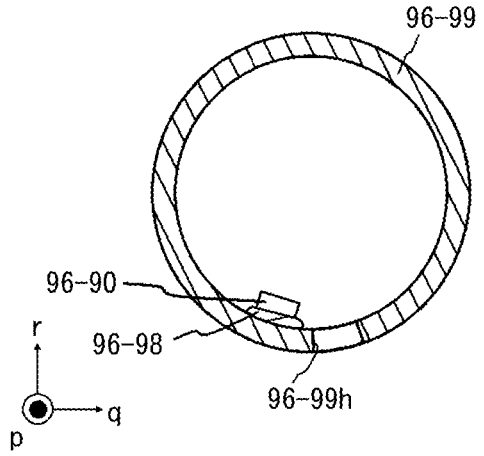

FIG. 96 is a perspective view illustrating an embodiment of a wireless communication device 96-90. FIG. 97A is a side view of the perspective view illustrated in FIG. 96. FIG. 97B is a cross-sectional diagram taken from line XCVIIb-XCVIIb illustrated in FIG. 97A. The wireless communication device 96-90 is positioned on the inner surface of the electrically conductive body 96-99 having a cylindrical shape. The electrically conductive body 96-99 includes a through hole 96-99*h* that extends in the r direction. In the wireless communication device 96-90, the r direction and the x direction are aligned with each other in the vicinity of the through hole 96-99*h*.

Figure 98:
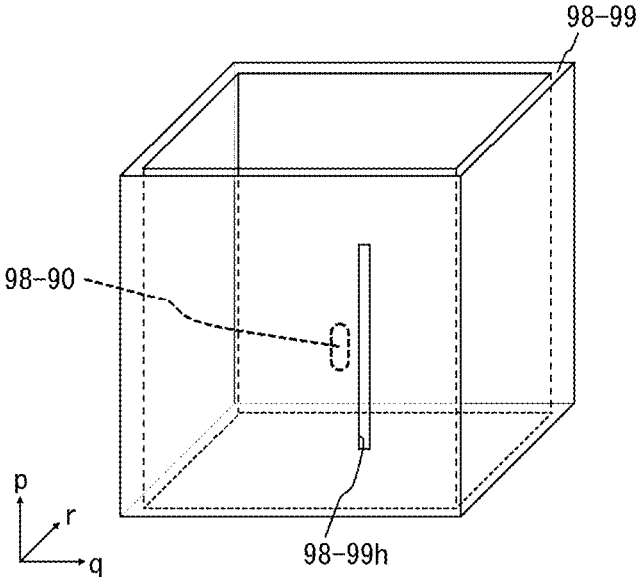
Figure 99:
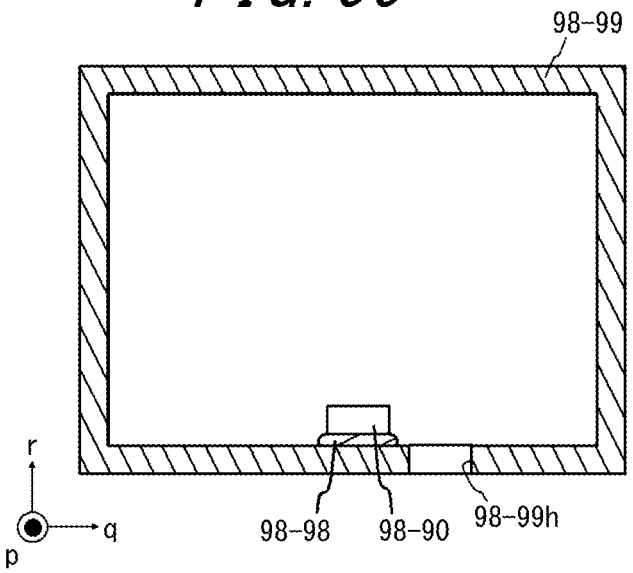

FIG. 98 is a perspective view illustrating an embodiment of a wireless communication device 98-90. FIG. 99 is a cross-sectional view in the vicinity of the wireless communication device 98-90 in the perspective view illustrated in FIG. 98. The wireless communication device 98-90 is positioned on the inner surface of an electrically conductive body 98-99 having a rectangular-tube shape. The electrically conductive body 98-99 includes a through hole 98-99*h* that extends in the r direction. In the wireless communication device 98-90, the r direction and the x direction are aligned with each other in the vicinity of the through hole 98-99*h*.

Figure 100:
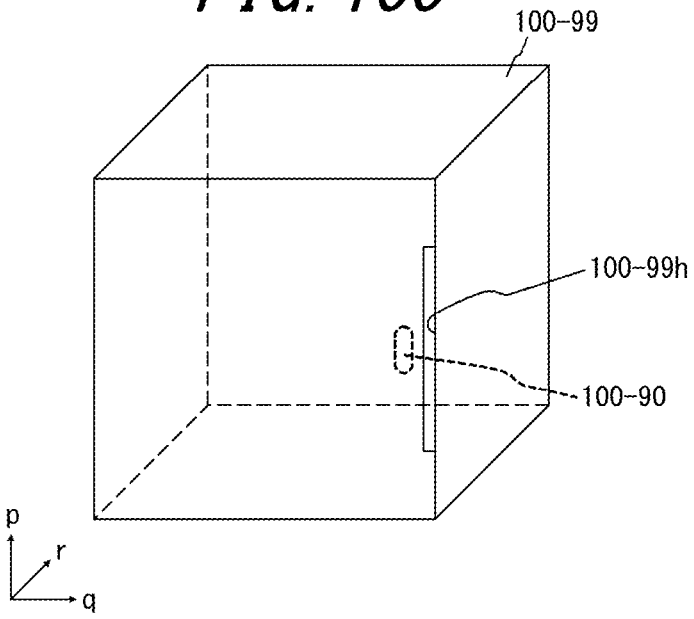

FIG. 100 is a perspective view illustrating an embodiment of a wireless communication device 100-90. The wireless communication device 100-90 is positioned on the inner surface of the electrically conductive body 100-99 having a rectangular parallelepiped shape. The electrically conductive body 100-99 has a through hole 100-99*h* that extends in the r direction. In the wireless communication device 100-90, the r direction and the x direction are aligned with each other in the vicinity of the through-hole 100-99*h*.

Figure 101:
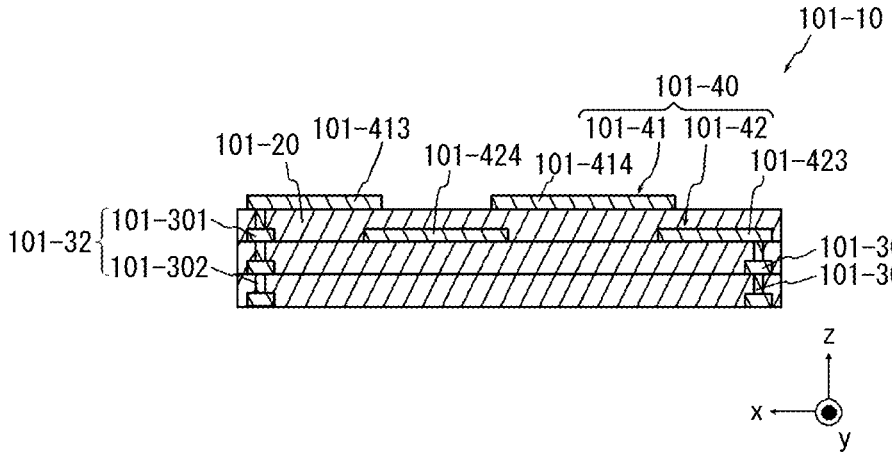
Figure 102:
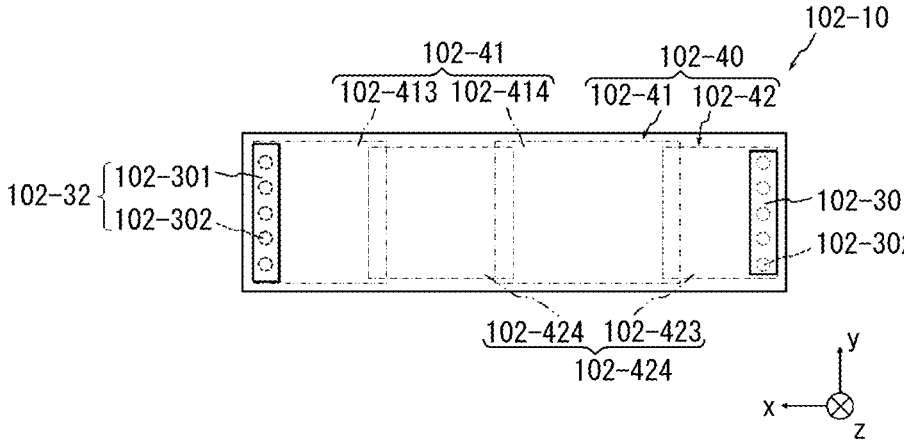
Figure 103:
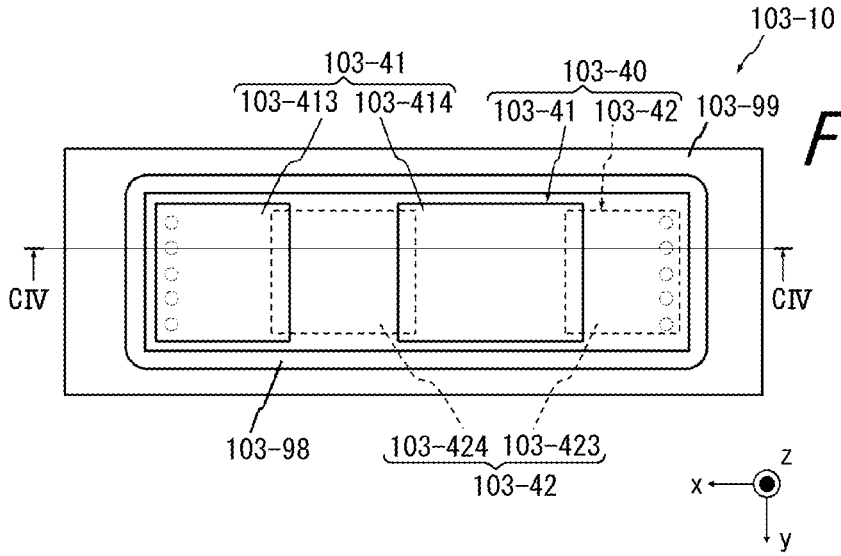
Figure 104:
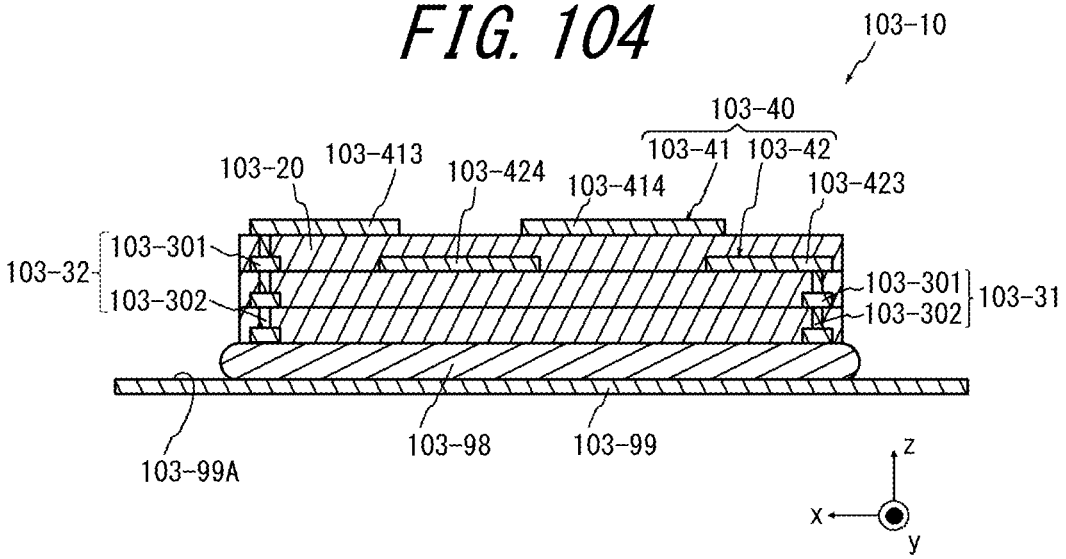

The resonator 10 positioned on the electrically conductive body 99 for use may be configured to omit at least a portion of the fourth conductor 50. The resonator 10 includes the base 20 and the pair conductors 30. FIG. 101 illustrates an example of a resonator 101-10 that does not include the fourth conductor 50. FIG. 102 illustrates a plan view in which the resonator 10 is oriented such that the +z-direction directs rearward in the figure. FIG. 103 illustrates an example of a resonance structure in which a resonator 103-10 is mounted on an electrically conductive body 103-99. FIG. 104 is a cross-sectional diagram taken from line CIV-CIV illustrated in FIG. 103. The resonator 103-10 is mounted on the electrically conductive body 103-99 by an attachment member 103-98. The resonator 10 that does not include the fourth conductor 50 is not limited to those illustrated in FIG. 101 to FIG. 104. The resonator 10 that does not include the fourth conductor 50 is not limited to the resonator 18-10 from which the fourth conductor 18-50 is removed. The resonator 10 that does not include the fourth conductor 50 may be obtained by removing the fourth conductor 50 from the resonator 10 illustrated in FIG. 1 to FIG. 64 by way of example.

Figure 105:
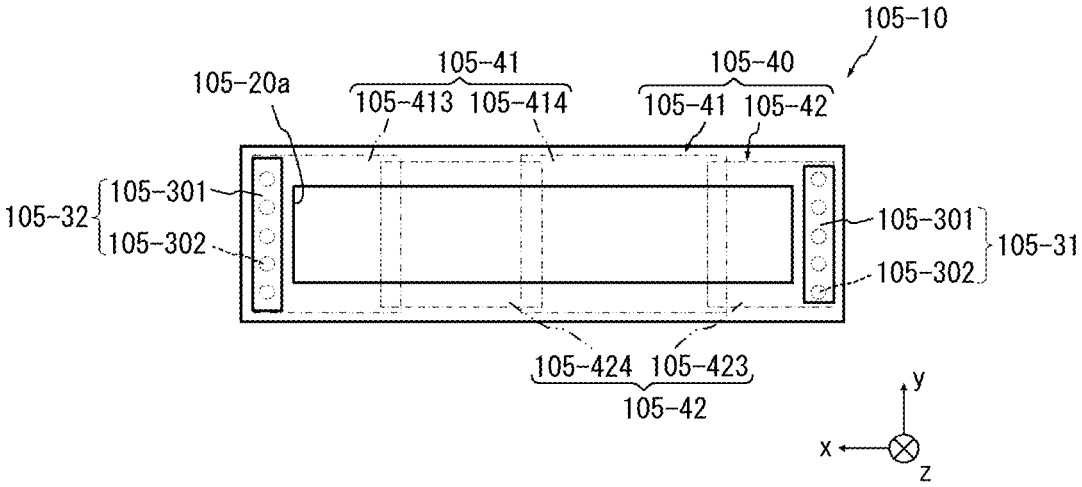

The base 20 may include a cavity 20*a*. FIG. 105 is an example of a resonator 105-10 in which a base 105-20 includes a cavity 105-20*a*. FIG. 105 is a plan view in which the resonator 105-10 is oriented such that the +z-direction directs rearward in the figure. FIG. 106 illustrates an example of the resonance structure in which a resonator 106-10 having a cavity 106-20*a* is mounted on an electrically conductive body 106-99. FIG. 107 is a cross-sectional diagram taken from line CVII-CVII illustrated in FIG. 106. In the z direction, the cavity 106-20*a* is positioned between a third conductor 106-40 and an electrically conductive body 106-99. A dielectric constant in the cavity 106-20*a* is lower than that of a base 106-20. By having the cavity 20*a*, the base 106-20 may reduce the electromagnetic distance between the third conductor 106-40 and the electrically conductive body 106-99. The resonator 10 having the cavity 20*a* is not limited to the configurations illustrated in FIG. 105 to FIG. 107. The resonator having the cavity 20*a* has a configuration of the resonator illustrated in FIG. 19 from which the fourth conductor is removed and including the base 20 having the cavity 20*a*. The resonator 10 having the cavity 20*a* may be obtained by removing the fourth conductor 50 from the resonator 10 illustrated in FIG. 1 to FIG. 64 and providing the cavity 20*a* to the base 20.

The base 20 may include the cavity 20*a*. FIG. 108 illustrates an example of a wireless communication module 108-80 in which a base 108-20 has a cavity 108-20*a*. FIG. 108 is a plan view in which the wireless communication module 108-80 is oriented such that the +z-direction directs rearward in the figure. FIG. 109 illustrates an example of a resonance structure in which a wireless communication module 109-80 having a cavity 109-20*a* is mounted on an electrically conductive body 109-99. FIG. 110 is a cross-sectional diagram taken from line CX-CX illustrated in FIG. 109. The wireless communication module 80 may be configured to accommodate the electronic device within the cavity 20*a*. The electronic device includes a processor or a sensor. The electronic device includes the RF module 82. The wireless communication module 80 may be configured to accommodate the RF module 82 within the cavity 20*a*. The RF module 82 may be positioned within the cavity 20*a*. The RF module 82 is connected to the third conductor 40 through the first feeding line 61. The base 20 may include a ninth conductor 62 that leads the reference potential of the RF module toward the electrically conductive body 99.

The wireless communication module 80 may be configured to omit a portion of the fourth conductor 50. The cavity 20*a* may be exposed to the outside from a portion where the fourth conductor 50 is omitted. FIG. 111 illustrates an example of a wireless communication module 111-80 in which a portion of the fourth conductor 50 is omitted. FIG. 111 is a plan view in which the resonator 10 is oriented such that the +z direction directs rearward in the figure. FIG. 112 illustrates an example of a resonance structure in which a wireless communication module 112-80 having a cavity 112-20*a* is mounted on an electrically conductive body 112-99. FIG. 113 is a cross-sectional diagram taken from line CXIII-CXIII illustrated in FIG. 112.

The wireless communication module 80 may have the cavity 20*a* within a fourth base 25. The fourth base 25 may include a resin material as a composition. The resin material includes epoxy resins, polyester resins, polyimide resins, polyamideimide resins, polyetherimide resins, or those obtained by curing an uncured material such as a liquid crystal polymer. FIG. 114 illustrates an example of a structure in which a fourth base 114-25 is positioned within a cavity 114-20*a*.

An attachment member 98 includes a substrate having viscous materials on both sides thereof, a cured or semi-cured organic material, a solder material, or a biasing means. The substrate having viscous materials on both sides thereof may be referred to as, for example, a double-sided tape. The cured or semi-cured organic material may be referred to as, for example, adhesive. The biasing means include, for example, screws, bands and the like. The attachment member 98 includes conductive or non-conductive members. The attachment member 98 of a conductive type includes members made of a conductive material or members containing a large amount of a conductive material.

When the attachment member 98 is non-conductive, the pair conductors 30 of the resonator 10 is configured to capacitively couple to the electrically conductive body 99. In this case, the pair conductors 30, the third conductor 40, and the electrically conductive body 99 form the resonant circuit in the resonator 10. In this case, the unit structure of the resonator 10 may include the base 20, the third conductor 40, the attachment member 98, and the electrically conductive body 99.

When the attachment member 98 is conductive, the pair conductors 30 of the resonator 10 is electrically connected through the attachment member 98. The attachment member 98 is configured to reduce the resistance value when attached to the electrically conductive body 99. In this case, when pair conductors 115-30 face to the outside in the x direction as illustrated in FIG. 115, the resistance value between the pair conductors 115-30 through an electrically conductive body 115-99 is configured to decrease. In this case, the pair conductors 115-30, a third conductor 115-40, and an attachment member 115-98 is configured to form a resonance circuit in a resonator 115-10. In this case, the unit structure of the resonator 115-10 may include a base 115-20, the third conductor 115-40, and the attachment member 115-98.

When the attachment member 98 is a biasing means, the resonator 10 is pressed from the side of the third conductor 40 and contacts the electrically conductive body 99. In this case, in one example, the pair conductors 30 of the resonator 10 contact with and are electrically connected to the electrically conductive body 99. In this case, in one example, the pair conductors 30 of the resonator 10 are configured to capacitively couple to the electrically conductive body 99. In this case, the pair conductors 30, the third conductor 40, and the electrically conductive body 99 form the resonant circuit in the resonator 10. In this case, the unit structure of the resonator 10 may include the base 20, the third conductor 40, and the electrically conductive body 99.

Generally, the resonance frequency of an antenna changes when approached by an electrically conductive body or a dielectric. When the resonance frequency is changed greatly, the operating gain at the operating frequency is changed in the antenna. When the antenna is used in the air or in the vicinity of an electrically conductive body or a dielectric, it is preferable to reduce the change in the operating gain caused by a change in the resonance frequency.

In the resonator 10, the y-direction length of the third conductor 40 and the y-direction length of the fourth conductor 50 are different from each other. Here, when unit conductors is arranged in the y direction, the y-direction length of the third conductor 40 corresponds to a distance between the outer edges of two unit conductors positioned at both ends in the y direction.

As illustrated in FIG. 116, a length of a fourth conductor 116-50 may be greater than a length of a third conductor 40. The fourth conductor 116-50 includes a first extra-body 50*a* and a second extra-body 50*b* that extend to the outside from the y-direction edge of the third conductor 40. The first extra-body 50*a* and the second extra-body 50*b* are positioned outside of the third conductor 40 in a plan view in the z-direction. A base 116-20 may extend to the edge of the third conductor 40 in the y-direction. The base 116-20 may extend to the edge of the fourth conductor 116-50 in the y-direction. The base 116-20 may extend to a portion between the edge of the third conductor 40 and the edge of the fourth conductor 116-50 in the y-direction.

In a case that the length of the fourth conductor 116-50 is greater than the length of the third conductor 40, the change in the resonance frequency of the resonator 116-10 is configured to decrease when an electrically conductive body approaches the exterior of the fourth conductor 116-50. In a case that the length of the fourth conductor 116-50 is greater than the length of the third conductor 40 by $0.075\lambda_1$ or more, where $\lambda_1$ represents the operating wavelength, the change in the resonance frequency in the operating frequency band of the resonator 116-10 is configured to decrease. In a case that the length of the fourth conductor 116-50 is greater than the length of the third conductor 40 by $0.075\lambda_1$ or more, where $\lambda_1$ represents the operating wavelength, the change in the operating gain at the operating frequency $f_1$ of the resonator 116-10 is configured to decrease. In a case that a total length of the first extra-body 50*a* and the second extra-body 50*b* in the y direction is greater than the length of the third conductor 40 by $0.075\lambda_1$ or more, the change in the operating gain at the operating frequency $f_1$ of the resonator 116-10 is configured to decrease. The total length of the first extra-body 50*a* and the second extra-body 50*b* in the y direction corresponds to a difference between the length of the third conductor 40 and the length of the fourth conductor 116-50.

In a plan view of the resonator 116-10 in a direction opposite to the z direction, the fourth conductor 116-50 extends on both sides wider than the third conductor 40 in the y direction. In a case that the fourth conductor 116-50 extends on both sides wider than the third conductor 40 in the y direction, the change in the resonance frequency of the resonator 116-10 is configured to decrease, this change is caused by an electrically conductive body approaching the exterior of the fourth conductor 116-50. In the resonator 116-10, where $\lambda_1$ represents the operating wavelength, in a case that the fourth conductor 116-50 expands to the outside of the third conductor 40 by $0.025\lambda_1$ or more, the change in the resonance frequency in the operating frequency band decreases. In the resonator 116-10, where $\lambda_1$ represents the operating wavelength, when the fourth conductor 116-50 extends to the outside of the third conductor 40 by $0.025\lambda_1$ or more, the change in the operating gain at the operating frequency $f_1$ is configured to decrease. In a case that each length of the first extra-body 50*a* and the length of the second extra-body 50*b* in the y direction is equal to or greater than $0.025\lambda_1$, the change in the operating gain at the operating frequency $f_1$ of the resonator 116-10 is configured to decrease.

In the resonator 116-10, where $\lambda_1$ represents the operating wavelength, when the fourth conductor 116-50 extends to the outside of the third conductor 40 by $0.025\lambda_1$ or more and the length of the fourth conductor 116-50 is longer than the length of the third conductor 40 by $0.075\lambda_1$ or more, the change in the resonance frequency in the operating frequency band is configured to decrease. In the resonator 116-10, where $\lambda_1$ represents the operating wavelength, when the fourth conductor 116-50 extends to the outside of the third conductor 40 by $0.025\lambda_1$ or more and the length of the fourth conductor 116-50 is longer than the length of the third conductor 40 by $0.075\lambda_1$ or more, the change in the operating gain in the operating frequency band is configured to decreases. In a case that the total length of the first extra-body 50*a* and the second extra-body 50*b* in the y direction is greater than length of the third conductor 40 by $0.075\lambda_1$ or more and each the length of the first extra-body 50*a* and the length of the second extra-body 50*b* in the y direction is equal to or greater than $0.025\lambda_1$, the change in the operating gain at the operating frequency $f_1$ of the resonator 116-10 is configured to decrease.

In a first antenna 116-60, the length of the fourth conductor 116-50 may be greater than the length of the third conductor 40. In a case that the length of the fourth conductor 116-50 is greater than the length of the third conductor 40, the change in the resonance frequency of the first antenna 116-60 is configured to decrease, this change is caused by an electrically conductive body approaching the exterior of the fourth conductor 116-50. In the first antenna 116-60,where $\lambda_1$ represents the operating wavelength, when the length of the fourth conductor 116-50 is greater than the length of the third conductor 40 by $0.750\lambda_1$ or more, the change in the resonance frequency in the operating frequency band is configured to decrease. In the first antenna 116-60, where $\lambda_1$ represents the operating wavelength, when the length of the fourth conductor 116-50 is greater than the length of the third conductor 40 by $0.075\lambda_1$ or more, the change in the operating gain at the operating frequency $f_1$ is configured to decrease. In the first antenna 116-60, when a total length of the first extra-body 50*a* and the second extra-body 50*b* in the y direction is greater than the length of the third conductor 40 by $0.075\lambda_1$ or more, the change in the operating gain at the operating frequency $f_1$ is configured to decrease. The total length of the first extra-body 50*a* and the second extra-body 50*b* in the y direction corresponds to the difference between the length of the fourth conductor 116-50 and the length of the third conductor 40.

In a plan view of the first antenna 116-60 in the direction opposite to the z direction, the fourth conductor 116-50 extends on both sides protruding from the third conductor 40 in the y-direction. In the resonator 116-10, when the fourth conductor 116-50 extends on both sides in the y direction protruding from the third conductor 40, the change in the resonance frequency is configured to decrease, this change is caused by an electrically conductive body approaching the exterior of the fourth conductor 116-50. In the resonator 116-10, where $\lambda_1$ represents the operating wavelength, when the fourth conductor 116-50 extends to the outside of the third conductor 40 by $0.025\lambda_1$ or more, the change in the resonance frequency in the operating frequency band is configured to decrease. In the resonator 116-10,where $\lambda_1$ represents the operating wavelength, when the fourth conductor 116-50 extends to the outside of the third conductor 40 by $0.025\lambda_1$ or more, the change in the operating gain at the operating frequency $f_1$ is configured to decrease. In the first antenna 116-60, when each of the length of the first extra-body 50*a* and the length of the second extra-body 50*b* in the y direction is $0.025\lambda_1$ or more, the change in the operating gain at the operating frequency $f_1$ is configured to decrease.

In the first antenna 60,where $\lambda_1$ represents the operating wavelength, when the fourth conductor 116-50 extends to the outside of the third conductor 40 by $0.025\lambda_1$ or more and the length of the fourth conductor 116-50 is greater than the length of the third conductor 40 by $0.075\lambda_1$ or more, the change in the resonance frequency is configured to decrease. In the first antenna 60,where $\lambda_1$ represents the operating wavelength, when the fourth conductor 116-50 extends to the outside of the third conductor 40 by $0.025\lambda_1$ or more and the length of the fourth conductor 116-50 is greater than the length of the third conductor 40 by $0.075\lambda_1$ or more, the change in the operating gain in the operating frequency band is configured to decrease. In the first antenna 60, where $\lambda_1$ represents the operating wavelength, when the fourth conductor 116-50 extends to the outside of the third conductor 40 by $0.025\lambda_1$ or more and the length of the fourth conductor 116-50 is greater than the length of the third conductor 40 by $0.075\lambda_1$ or more, the change in the operating gain at the operating frequency $f_1$ is configured to decrease. In the first antenna 116-60, when the total length of the first extra-body 50*a* and the second extra-body 50*b* in the y direction is longer than the third conductor 40 by $0.075\lambda_1$ or more and each of the length of the first extra-body 50*a* and the length of the second extra-body 50*b* in the y direction is greater than $0.025\lambda_1$ or more, the change in the operating gain at the operating frequency $f_1$ is configured to decrease.

As illustrated in FIG. 117, in a wireless communication module 117-80, a first antenna 117-60 is positioned on a ground conductor 117-811 of a circuit board 117-81. A fourth conductor 117-50 of the first antenna 117-60 is electrically connected to the ground conductor 117-811. The length of the ground conductor 117-811 may be greater than the length of a third conductor 40. The ground conductor 117-811 includes a third wider part 811*a* and a fourth wider part 811*b* that extend to the outside from the y-direction edge of the resonator 117-10. In a plan view in the z direction, the third wider part 811*a* and the fourth wider part 811*b* are positioned outside of the third conductor 40. In the wireless communication module 117-80, the y-direction length of the first antenna 117-60 and the y-direction length of the ground conductor 117-811 may be different from each other. In the wireless communication module 117-80, the y-direction length of the third conductor 40 of the first antenna 117-60 and the y-direction length of the ground conductor 117-811 may be different from each other.

In the wireless communication module 117-80, the length of the ground conductor 117-811 may be greater than the length of the third conductor 40. In the wireless communication module 117-80, when the length of the ground conductor 117-811 is greater than the length of the third conductor 40, the change in the resonance frequency is configured to decrease, this change is caused by an electrically conductive body approaching the exterior of the ground conductor 117-811. In the wireless communication module 117-80,where $\lambda_1$ represents the operating wavelength, when the length of the ground conductor 117-811 is greater than the length of the third conductor 40 by $0.075\lambda_1$ or more, the change in the operating gain in the operating frequency band is configured to decrease. In the wireless communication module 117-80,where $\lambda_1$ represents the operating wavelength, when the length of the ground conductor 117-811 is greater than the length of the third conductor 40 by $0.075\lambda_1$ or more, the change in the operating gain at the operating frequency $f_1$ is configured to decrease. In the wireless communication module 117-80, when the total length of the third wider part 811*a* and the fourth wider part 811*b* in the y direction is greater than the length of the third conductor 40 by $0.075\lambda_1$ or more, the change in the operating gain at the operating frequency $f_1$ is configured to decrease. The total length of the third wider part 811*a* and the fourth wider part 811*b* in the y direction corresponds to the difference between the length of the ground conductor 117-811 and the length of the third conductor 40.

In the plan view of the wireless communication module 117-80 from the direction opposite to the z direction, the ground conductor 117-811 extends on both sides in the y direction protruding from the third conductor 40. In the wireless communication module 117-80, when the ground conductor 117-811 extends on both sides in the y direction protruding from the third conductor 40, the change in the resonance frequency is configured to decrease, this change is caused by an electrically conductive body approaching the exterior of the ground conductor 117-811. In the wireless communication module 117-80, where $\lambda_1$ represents the operating wavelength, when the ground conductor 117-811 extends protruding from the third conductor 40 by $0.025\lambda_1$ or more, the change in the operating gain in the operating frequency band is configured to decrease. In the wireless communication module 117-80, where $\lambda_1$ represents the operating wavelength, when the ground conductor 117-811 extends protruding from the third conductor 40 by $0.025\lambda_1$ or more, the change in the operating gain at the operating frequency $f_1$ is configured to decrease. In the wireless communication module 117-80, when each of the length of the third wider part 811*a* and the length of the fourth wider part 811*b* in the y direction is $0.025\lambda_1$ or more, the change in the operating gain at the operating frequency $f_1$ is configured to decrease.

In the wireless communication module 117-80,where $\lambda_1$ represents the operating wavelength, when the ground conductor 117-811 extends to the outside of the third conductor 40 by $0.025\lambda_1$ or more and the length of the ground conductor 117-811 is greater than the length of the third conductor 40 by $0.075\lambda_1$ or more, the change in the resonance frequency in the operating frequency band is configured to decrease. In the wireless communication module 117-80, where $\lambda_1$ represents the operating wavelength, when the ground conductor 117-811 extends to the outside of the third conductor 40 by $0.025\lambda_1$ or more and the length of the ground conductor 117-811 is greater than the length of the third conductor 40 by $0.075\lambda_1$ or more, the change in the operating gain in the operating frequency band is configured to decrease. In the wireless communication module 117-80, where $\lambda_1$ represents the operating wavelength, when the ground conductor 117-811 extends to the outside of the third conductor 40 by $0.025\lambda_1$ or more and the length of the ground conductor 117-811 is greater than the length of the third conductor 40 by $0.075\lambda_1$ or more, the change in the operating gain at the operating frequency $f_1$ is configured to decrease. In the wireless communication module 117-80, when the total length of the third wider part 811*a* and the fourth wider part 811*b* in the y direction is greater than the length of the third conductor 40 by $0.075\lambda_1$ or more and each of the length of the third wider part 811*a* and the length of the fourth wider part 811*b* in the y direction is $0.025\lambda_1$ or more, the change in the operating gain at the operating frequency $f_1$ is configured to decrease.

The change in the resonance frequency in the operating frequency band of the first antenna have been examined by simulation. As a simulation model, a resonance structure was employed, the structure is having a first antenna positioned on a first surface of a circuit board, the circuit board is having a ground conductor on the first surface. FIG. 118 illustrates a perspective view of a conductor shape of the first antenna employed in the simulation described below. The first antenna has an x-direction length of 13.6 [mm], a y-direction length of 7 [mm], and a z-direction length of 1.5 [mm]. The resonance frequency of the resonance structure in free space and the resonance frequency of the resonance structure placed on a metal plate of 100 [millimeters square ($mm^2$)] were obtained.

In a first simulation model, the first antenna was placed at the center of the ground conductor and, while the y-direction length of the ground conductor was sequentially changed, the resonance frequency in the free space and the resonance frequency on the metal plate were compared. In the first simulation model, the x-direction length of the ground conductor was fixed to 0.13λs. Although the resonance frequency in the free space varied depending on the y-direction length of the ground conductor, the resonance frequency in the operating frequency band of the resonance structure was approximately 2.5 [gigahertz (GHz)]. The wavelength at 2.5 [(GHz)] is represented by λs. The results of a first simulation are shown in Table 1.

TABLE 1

| [mm] | [GHz] |
|---|---|
| 9 | 0.041 |
| 11 | 0.028 |
| 13 | 0.018 |
| 15 | 0.011 |
| 17 | 0.010 |
| 19 | 0.009 |
| 21 | 0.010 |
| 23 | 0.006 |
| 25 | 0.006 |
| 30 | 0.008 |
| 60 | 0.007 |

FIG. 119 illustrates a graph corresponding to the results shown in Table 1. In FIG. 119, the horizontal axis indicates the difference between the length of the ground conductor and the length of the first antenna, and the vertical axis indicates the difference between the resonance frequency in the free space and the resonance frequency on the metal plate. From FIG. 119, it was assumed that the change in the resonance frequency falls within a first linear region expressed by $y=a_1x+b_1$ and a second linear region expressed by $y=c_1$. Next, from the results shown in Table 1, $a_1$, $b_1$, and $c_1$ were calculated by employing the least square method. As a result, $a_1=-0.600$, $b_1=0.052$, and $c_1=0.008$ were obtained. An intersection of the first linear region and the second linear region was 0.0733λs. From the above, it was demonstrated that the change in the resonance frequency decreases when the ground conductor is longer than the first antenna by 0.0733λs or more.

In a second simulation model, while the position of the first antenna with respect to the edge of the ground conductor in the y direction was sequentially changed, the resonance frequency in the free space and the resonance frequency on the metal plate were compared. In the second simulation model, the y-direction length of the ground conductor was fixed at 25 [mm]. Although the resonance frequency varied depending on the position on the ground conductor, the resonance frequency in the operating frequency band of the resonance structure was approximately 2.5 [GHz]. The wavelength at 2.5 [GHz] is represented by λs. The results of a second simulation are shown in Table 2.

TABLE 2

| [λ] | [GHz] |
|---|---|
| 0.004 | 0.033 |
| 0.013 | 0.019 |
| 0.021 | 0.013 |
| 0.029 | 0.012 |
| 0.038 | 0.010 |
| 0.046 | 0.008 |
| 0.054 | 0.010 |
| 0.071 | 0.006 |

FIG. 120 illustrates a graph corresponding to the results shown in Table 2. In FIG. 120, the horizontal axis indicates a position of the first antenna with respect to the edge of the ground conductor, and the vertical axis indicates the difference between the resonance frequency in the free space and the resonance frequency on the metal plate. From FIG. 120, it was assumed that the change in the resonance frequency falls within a first linear region expressed by $y=a_2x+b_2$ and a second linear region expressed by $y=c_2$. Next, $a_2=-1.200$, $b_2=0.034$, and $c_2=0.009$ were obtained by employing the least square method. The intersection of the first linear region and the second linear region was 0.0227λs. From the above, it was demonstrated that the change in the resonance frequency decreases when the first antenna is positioned on the inner side by 0.0227λs or more from the edge of the ground conductor.

In a third simulation model, while the position of the first antenna with respect to the ground conductor in the y direction was sequentially changed, the resonance frequency in the free space and the resonance frequency on the metal plate were compared. In the third simulation model, the y-direction length of the ground conductor was fixed to 15 [mm]. In the third simulation model, a total length of the ground conductor extending to the outside of the resonator in the y direction was set to 0.075λs. In the third simulation, the ground conductor is shorter than that of the second simulation and prone to variation in the resonance frequency. Although the resonance frequency varied depending on the position on the ground conductor, the resonance frequency in the operating frequency band of the resonance structure was approximately 2.5 [GHz]. The wavelength at 2.5 [GHz] is represented by λs. The results of a third simulation are shown in Table 3.

TABLE 3

| [λ] | [GHz] |
|---|---|
| 0.004 | 0.032 |
| 0.014 | 0.023 |
| 0.025 | 0.014 |
| 0.035 | 0.014 |
| 0.041 | 0.014 |

FIG. 121 illustrates a graph corresponding to the results shown in Table 3. In FIG. 121, the horizontal axis indicates a position of the first antenna with respect to the edge of the ground conductor, and the vertical axis indicates the difference between the resonance frequency in the free space and the resonance frequency on the metal plate. From FIG. 121, it was assumed that the change in the resonance frequency falls within a first linear region expressed by $y=a_3x+b_3$ and a second linear region expressed by $y=c_3$. Next, $a_3=-0.878$, $b_3=0.036$, and $c_3=0.014$ were obtained by employing the least square method. The intersection of the first linear region and the second linear region was 0.0247λs. From the above, it was demonstrated that the change in the resonance frequency decreases when the first antenna is positioned on the inner side by 0.0247λs or more from the edge of the ground conductor.

From the results of the third simulation, which is under more severe conditions than the second simulation, it was demonstrated that the change in the resonance frequency decreases when the first antenna is positioned on the inner side by 0.025λs or more from the edge of the ground conductor.

In the first simulation, the second simulation, and the third simulation, the length of the ground conductor in the y direction is greater than the length of the third conductor in the y direction. In the resonator 10, even when the length of the fourth conductor in the y direction is greater than the length of the third conductor in the y direction, the change in the resonance frequency caused by an electrically conductive body approaching the resonator from the fourth conductor side can be reduced. When the length of the fourth conductor in the y direction is greater than the length of the third conductor in the y direction, the resonator can reduce the change in the resonance frequency even when the ground conductor or the circuit board was omitted.

(Note 1-1)

A resonator comprising:

a first conductor and a second conductor that extend in a second plane and are separated from each other in a first direction intersecting with the second plane;

a third conductor that extends in the first plane including the first direction, and is connected to the first conductor and the second conductor;

a fourth conductor that extends in the first plane, is connected to the first conductor and the second conductor, and is separated from the third conductor in a second direction, which intersects with the first plane and includes the second plane; and a reference potential layer that extends in the first plane, is separated from the fourth conductor in the second direction, the fourth conductor is between the third conductor and the reference potential layer, and is configured to become a reference potential.

(Note 1-2)

The resonator according to Note 1-1, wherein a distance between the reference potential layer and the fourth conductor is less than a distance between the third conductor and the fourth conductor.

(Note 1-3)

The resonator according to Note 1-1 or Note 1-2, wherein the third conductor includes:

a first conductive layer that extends in the first plane; and a second conductive layer that extends in the first plane and is configured to capacitively couple to the first conductive layer.

(Note 1-4)

The resonator according to Note 1-1 or Note 1-2, wherein the third conductor includes:

a first conductive layer that extends in the first plane; and a second conductive layer that extends in the first plane and is configured to capacitively couple to the first conductive layer.

(Note 1-5)

The resonator according to Note 1-4, wherein the first conductive layer is separated from the second conductive layer in the first plane and is configured to capacitively couple to the second conductive layer, wherein the first conductive layer being separated from the second conductive layer in the first direction, and is configured to capacitively couple to the second conductive layer.

(Note 1-6)

The resonator according to Note 1-4, wherein a portion of the first conductive layer overlaps with a portion of the second conductive layer in the second direction and is configured to capacitively couple to the portion of the second conductive layer.

(Note 1-7)

The resonator according to any one of Note 1-3 to Note 1-6, wherein the first conductive layer is connected to the first conductor.

(Note 1-8)

The resonator according to any one of Note 1-3 to Note 1-7, wherein the second conductive layer is connected to the second conductor.

(Note 1-9)

The resonator according to any one of Note 1-1 to Note 1-8, wherein, a first current configured to flow from the first conductor to the second conductor in the third conductor and having a first frequency, a second current configured to flow from the second conductor to the first conductor in the fourth conductor and having a first frequency, a third current configured to flow in a direction opposite to the second current in the fifth conductor, and a portion of an electromagnetic field generated by the second current is cancelled by an electromagnetic field generated by the third current.

(Note 1-10)

The resonator according to Note 1-9, wherein the first current, the second current, and the third current are in different magnitudes, wherein a magnitude of the first current, the second current, and the third current is different from another magnitude of the first current, the second current, and the third current.

(Note 1-11)

The resonator according to any one of Note 1-1 to Note 1-10, wherein the third direction is included in the first plane and the second plane, and a length of the third conductor in the first direction is greater than a length of the third conductor in the third direction.

(Note 1-12)

The resonator according to any one of Note 1-1 to Note 1-10, wherein a length of the third conductor in the first direction is greater than a distance between the third conductor and the fourth conductor.

(Note 1-13)

An antenna comprising:

the resonator according to any one of Note 1-1 to Note 1-12; and a feeding line configured to electromagnetically couple to any one of the first conductor, the second conductor, the third conductor, and the fourth conductor, a feeding line configured to electromagnetically couple to at least one the first conductor, the second conductor, the third conductor, or the fourth conductor.

(Note 1-14)

A wireless communication module comprising:

the antenna according to Note 1-13; and an RF module electrically connected to the antenna.

(Note 1-15)

A wireless communication device comprising:

the wireless communication module according to Note 1-14; and a battery configured to feed electricity to the wireless communication module.

(Note 1-16)

The wireless communication device according to Note 1-15, wherein the battery overlaps by the fourth conductor in the second direction.

(Note 1-17)

The wireless communication device according to Note 1-15 or Note 1-16, wherein an electrode terminal of the battery is electrically connected to the fourth conductor.

(Note 1-18)

The resonator according to any one of Note 1-1 to Note 1-12, wherein the third conductor capacitively connects the first conductor and the second conductor.

(Note 2-1)

A resonator comprising:

a first conductor and a second conductor that extend in a second plane and are separated from each other in a first direction intersecting with the second plane;

a third conductor that extends in the first plane including the first direction and is connected to the first conductor and the second conductor; and a fourth conductor that extends in the first plane, is connected to the first conductor and the second conductor, is separated from the third conductor in a second direction, which intersects with the first plane and includes the second plane, and is configured to become a reference potential, wherein the third conductor includes:

a first conductive layer that extends in the first plane and is connected to the first conductor; and a second conductive layer that extends in the first plane, and a portion of the second conductive layer overlaps with a portion of the first conductive layer in the second direction, and is configured to capacitively couple to the first conductive layer, wherein the second conductive layer is positioned closer to the first conductive layer than to the first conductor.

(Note 2-2)

The resonator according to Note 2-1, wherein the second conductive layer is connected to the second conductor.

(Note 2-3)

The resonator according to Note 2-2, wherein the first conductive layer is positioned closer to the second conductive layer than to the second conductor.

(Note 2-4)

The resonator according to any one of Note 2-1 to Note 2-3, wherein a distance between the first conductive layer and the second conductive layer is less than a distance between the first conductive layer and the fourth conductor and a distance between the second conductive layer and the fourth conductor.

(Note 2-5)

A resonator comprising:

a first conductor and a second conductor that extend in a second plane and are separated from each other in a first direction intersecting with the second plane;

a third conductor that extends in a first plane including the first direction and is connected to the first conductor and the second conductor; and a fourth conductor that extends in the first plane, is connected to the first conductor and the second conductor, intersects with the first plane, is separated from the third conductor in a second direction included in the second plane, and serves as a reference potential, wherein the third conductor includes:

a first conductive layer that extends in the first plane and is connected to the first conductor; and a second conductive layer that extends in the first plane, being separated from the first conductive layer in the second direction, and is configured to capacitively couple to the first conductive layer.

(Note 2-6)

The resonator according to any one of Note 2-1 to Note 2-5, wherein in the third conductor, a first current of a first frequency configured to flow from the first conductor to the second conductor, and in the fourth conductor, a second current of the first frequency configured to flow from the second conductor to the first conductor.

(Note 2-7)

The resonator according to Note 2-6, wherein a magnitude of the first current is different from a magnitude of the second current.

(Note 2-8)

The resonator according to any one of Note 2-1 to Note 2-7, wherein a third direction is included in the first plane and the second plane, and a length of the third conductor in the first direction is greater than a length of the third conductor in the third direction.

(Note 2-9)

The resonator according to any one of Note 2-1 to Note 2-8, wherein a length of the third conductor in the first direction is greater than a distance between the third conductor and the fourth conductor.

(Note 2-10)

An antenna comprising:

the resonator according to any one of Note 2-1 to Note 2-9; and a feeding line electromagnetically configured to couple to any one of the first conductor, the second conductor, and the third conductor.

(Note 2-11)

A wireless communication module comprising:

the antenna according to Note 2-10; and an RF module electrically connected to the antenna.

(Note 2-12)

A wireless communication device comprising:

the wireless communication module according to Note 2-11; and a battery configured to feed electricity to the wireless communication module.

(Note 2-13)

The wireless communication device according to Note 2-12, wherein the battery overlaps by the fourth conductor in the second direction.

(Note 2-14)

The wireless communication device according to Note 2-12 or Note 2-13, wherein an electrode terminal of the battery is electrically connected to the fourth conductor.

(Note 3-1)

A resonance structure comprising:

a first conductor;

a second conductor being separated from the first conductor in a first direction;

third conductors that are positioned between the first conductor and the second conductor and extend in the first direction;

a fourth conductor that is connected to the first conductor and the second conductor and extends in the first direction; and a fifth conductor configured to electromagnetically couple to the fourth conductor, wherein the third conductors have a capacitance, the fourth conductor configured as a ground, and a length of the fifth conductor is longer in the first direction than a length of the fourth conductor.

(Note 3-2)

The resonance structure according to Note 3-1, wherein the first conductor extends in a second direction, the second direction intersects with the first direction, the second conductor extends in the second direction, and each of the third conductors is separated from the fourth conductor in the second direction.

(Note 3-3)

A resonance structure comprising:

a first conductor that extends in a second plane;

a second conductor that is separated from the first conductor in a first direction intersecting with the second plane and extends in the second plane;

third conductors that extend in a first plane including the first direction;

a fourth conductor that extends in the first plane and is connected to the first conductor and the second conductor; and a fifth conductor configured to electromagnetically couple to the fourth conductor, wherein at least one of the third conductors is connected to the first conductor, at least one of the third conductors is connected to the second conductor, the third conductors have a capacity between the first conductor and the second conductor, the fourth conductor configured as a ground, the third conductors and the fourth conductor are separated from each other in a second direction, the second direction is included in the second plane and intersects with the first plane, and a length of the fifth conductor is greater in the first direction than a length of the fourth conductor.

(Note 3-4)

The resonance structure according to Note 3-3, wherein the fifth conductor extends in the first plane and has a surface integral in the first plane greater than a surface integral in the first plane of the fourth conductor.

(Note 3-5)

The resonance structure according to Note 3-3 or Note 3-4, wherein a center of the fourth conductor is offset with a center of the fifth conductor in the first direction.

(Note 3-6)

The resonance structure according to Note 3-5, wherein a length of the fifth conductor in the first direction is greater than ¼ of a length of an operating wavelength.

(Note 3-7)

The resonance structure according to any one of Note 3-3 to Note 3-6, wherein the third conductor has a capacitive component at a top end.

(Note 3-8)

The resonance structure according to any one of Note 3-3 to Note 3-7, wherein the fifth conductor includes a first extra-body that extends to an outside of the first conductor in the first direction.

(Note 3-9)

The resonance structure according to any one of Note 3-3 to Note 3-8, wherein the fifth conductor includes a second extra-body that extends to an outside of the second conductor in the first direction.

(Note 3-10)

The resonance structure according to any one of Note 3-3 to Note 3-9, further comprising an antenna, the antenna includes:

the first conductor, the second conductor, the third conductors, the fourth conductor, and a feeding line, wherein the feeding line is configured to feed electricity to any one of the first conductor, the second conductor, and the third conductors.

(Note 3-11)

The resonance structure according to Note 3-10, wherein a length of the third conductor in the first direction is greater than lengths of the first conductor and the second conductor in the second direction, and the feeding line is connected to the third conductor.

(Note 3-12)

The resonance structure according to Note 3-10 or Note 3-11, further comprising:

a dielectric layer between the fourth conductor and the fifth conductor.

(Note 3-13)

The resonance structure according to Note 3-10 or Note 3-11, further comprising an antenna element, the antenna element includes:

the first conductor, the second conductor, the third conductor, the fourth conductor, and the feeding line; and a case, the antenna element is within the case, wherein the fifth conductor is outside of the case.

(Note 3-14)

The resonance structure according to any one of Note 3-10 to Note 3-13, further comprising:

a wireless communication module that includes the antenna element and an RF module, wherein the RF module is electrically connected to the antenna element.

(Note 3-15)

The resonance structure according to Note 3-14, further comprising:

a wireless communication device that includes the wireless communication module and a battery, wherein the battery is configured to feed electricity to the wireless communication module.

(Note 3-16)

The resonance structure according to Note 3-14, wherein the battery is overlapped by the fifth conductor in the second direction.

(Note 3-17)

A resonance structure comprising:

a first conductor that extends in a second plane;

a second conductor that is separated from the first conductor in a first direction intersecting with the second plane and extends in the second plane;

a third conductor that extends in a first plane including the first direction;

a fourth conductor that extends in the first plane; and a fifth conductor configured to electromagnetically couple to the fourth conductor, wherein the third conductors include a first body connected to the first conductor and a second body connected to the second conductor, the third conductors include a capacitance between the first body and the second body, the fourth conductor is connected to the first conductor and the second conductor, the third conductor and the fourth conductor are separated from each other in a second direction, the second direction intersects with the first plane and is included in the second plane, and the fifth conductor is longer in the first direction than the fourth conductor.

(Note 3-18)

A resonance structure comprising:

a first conductor that extends in a second plane;

a second conductor that is separated from the first conductor in a first direction intersecting with the second plane and extends in the second plane;

a third conductor that extends in a first plane including the first direction;

a fourth conductor that extends in the first plane;

a reference potential layer that extends in the first plane and is configured as a reference potential; and a fifth conductor configured to electromagnetically couple to the reference potential layer, wherein at least one of the third conductor and the second conductor includes a first body connected to the first conductor and a second body connected to the second conductor and includes a capacitance between the first body and the second body, the third conductor and the fourth conductor are separated from each other in a second direction, the second direction intersects with the first plane and is included in the second plane, the reference potential layer is separated from the fourth conductor in the second direction, the reference potential layer is configured to electromagnetically couple to the fourth conductor, and a length of the fifth conductor is greater than a length of the reference potential layer in the first direction.

(Note 3-19)

The resonance structure according to Note 3-1 or Note 3-2, wherein at least one of the third conductors has a capacitance with at least another of the third conductors.

(Note 3-20)

The resonance structure according to any one of Note 3-3 to Note 3-9, wherein an edge of one of the third conductors has a capacitive component with an edge of another of the third conductors.

(Note 3-21)

The resonance structure according to any one of Note 3-3 to Note 3-9, the first body has a electrostatic capacitance with the second body through the third conductors.

(Note 4-1)

A resonance structure comprising:

a first conductor;

a second conductor being separated from the first conductor in a first direction;

third conductors that are positioned between the first conductor and the second conductor and extend in the first direction;

a fourth conductor that is connected to the first conductor and the second conductor and extends in the first direction; and a fifth conductor configured to electromagnetically couple to the third conductors, wherein the third conductors include a capacitance, the fourth conductor serves as a ground, and a length of the fifth conductor is greater than a length of the fourth conductor in the first direction.

(Note 4-2)

The resonance structure according to Note 4-1, wherein the first conductor extends in a second direction, the second direction intersects with the first direction, the second conductor extends in the second direction, and each of the third conductors is separated from the fourth conductor in the second direction.

(Note 4-3)

A resonance structure comprising:

a first conductor extending in a second plane;

a second conductor that is separated from the first conductor in a first direction intersecting with the second plane and extends in the second plane;

third conductors that extend in a first plane including the first direction;

a fourth conductor that extends in the first plane and serves as a ground; and a fifth conductor configured to electromagnetically couple to the third conductors, wherein the third conductors include a capacitance between the first conductor and the second conductor, at least one of the third conductors is connected to the first conductor, at least one of the third conductors is connected to the second conductor, the fourth conductor is connected to the first conductor and the second conductor, the fourth conductor is separated from the third conductor in a second direction, the second direction intersects with the first plane and is included in the second plane, and a length of the fifth conductor is greater than a length of the third conductors in the first direction.

(Note 4-4)

The resonance structure according to Note 4-3, wherein the third conductors include a capacitive component at a top end.

(Note 4-5)

The resonance structure according to Note 4-3 or Note 4-4, wherein the fifth conductor is separated from the third conductors in the second direction.

(Note 4-6)

The resonance structure according to any one of Note 4-3 or Note 4-5, wherein the fifth conductor includes a first extra-body that extends outside of the first conductor in the first direction.

(Note 4-7)

The resonance structure according to any one of Note 4-3 or Note 4-6, wherein the fifth conductor includes a second extra-body that extends outside of the second conductor in the first direction.

(Note 4-8)

The resonance structure according to any one of Note 4-3 or Note 4-7, wherein a length of the fifth conductor in a third direction is greater than a total length of the third conductors in the third direction.

(Note 4-9)

An antenna comprising:

the resonance structure according to Note 4-3 to Note 4-8; and an antenna including a feeding line configured to feed electricity to any one of the first conductor, the second conductor, and the third conductors.

(Note 4-10)

The antenna according to Note 4-9, wherein a total length of the third conductors in the first direction is greater than lengths of the first conductor and the second conductor in the second direction, and the feeding line is connected to the third conductor.

(Note 4-11)

The antenna according to Note 4-9 or Note 4-10, further comprising:

a dielectric layer between the third conductors and the fifth conductor.

(Note 4-12)

The antenna according to Note 4-9 or Note 4-10, further comprising:

an antenna element that includes the first conductor, the second conductor, the third conductors, the fourth conductor, and the feeding line; and a case, the antenna element is within the case, wherein the case includes the fifth conductor.

(Note 4-13)

The antenna according to Note 4-12, wherein the fifth conductor is positioned on an outer surface, inner surface, or an inner side of the case.

(Note 4-14)

The antenna according to Note 4-9 or Note 4-10, further comprising:

an antenna element that includes the first conductor, the second conductor, the third conductors, the fourth conductor, and the feeding line; and a case having an inner space in which the antenna element is accommodated, wherein the fifth conductor is positioned on an outer surface, an inner surface, or an inner side of the case.

(Note 4-15)

The antenna according to any one of Note 4-12 or Note 4-14, further comprising:

a battery positioned in the inner space, wherein the fifth conductor partially overlaps with the battery in the second direction.

(Note 4-16)

A wireless communication device comprising:

the antenna according to Note 4-9 to Note 4-15; and an RF module electrically connected to the feeding line.

(Note 4-17)

The wireless communication device according to Note 4-16, wherein the battery overlaps by the fourth conductor in the second direction.

(Note 4-18)

The wireless communication device according to Note 4-15 or Note 4-17, wherein an electrode terminal of the battery is electrically connected to the fourth conductor.

(Note 4-19)

A resonance structure comprising:

a first conductor extending in a second plane;

a second conductor that is separated from the first conductor in a first direction intersecting with the second plane and extends in the second plane;

third conductors that extend in a first plane including the first direction;

a fourth conductor that extends in the first plane and serves as a ground; and a fifth conductor configured to electromagnetically couple to at least one of the third conductors, wherein the third conductors include a first body connected to the first conductor, the third conductors include a second body connected to the second conductor, the third conductors include a capacitance between the first conductor and the second conductor, the fourth conductor is connected to the first conductor and the second conductor, the fourth conductor is separated from the third conductor in a second direction that intersects with the first plane and is included in the second plane, and a length of the fifth conductor is greater than a length of the third conductor in the first direction.

(Note 4-20)

A resonance structure comprising:

a first conductor extending in a second plane;

a second conductor that is separated from the first conductor in a first direction intersecting with the second plane and extends in the second plane;

a third conductor that extends in a first plane including the first direction;

a fourth conductor that extends in the first plane;

a fifth conductor configured to electromagnetically couple to the third conductor; and a reference potential layer that extends in the first plane and serves as a reference potential, wherein at least one of the third conductor and the fourth conductor includes a first body connected to the first conductor, at least one of the third conductor and the fourth conductor includes a second body connected to the second conductor, at least one of the third conductor and the fourth conductor includes a capacitance between the first body and the second body, the third conductor and the second conductor are separated from each other in a second direction, the second direction intersects with the first plane and is included in the second plane, the reference potential layer is configured to electromagnetically couple to the fourth conductor, and a length of the fifth conductor is greater than a length of the third conductor in the first direction.

(Note 4-21)

The resonance structure according to any one of Note 4-3 or Note 4-7, wherein at least one of third conductors has an electrostatic capacitance with the first conductor, at least another of third conductors has an electrostatic capacitance with the second conductor.

(Note 5-1)

A resonance structure comprising:

a resonator and a circuit board, wherein the resonator includes:

a first conductor;

a second conductor being separated from the first conductor in a first direction;

third conductors that are positioned between the first conductor and the second conductor and extend in the first direction; and a fourth conductor that is connected to the first conductor and the second conductor and extends in the first direction, wherein the third conductors include a capacitance, the fourth conductor configured as a ground, the circuit board includes a ground conductor connected to the fourth conductor, and a center of the ground conductor is offset with centers of the first conductor and the second conductor.

(Note 5-2)

The resonance structure according to Note 5-1, wherein the first conductor extends in a second direction, the second direction intersects with the first direction, the second conductor extends in the second direction, and each of the third conductors is separated from the fourth conductor in the second direction.

(Note 5-3)

A resonance structure comprising:

a resonator and a circuit board, wherein the resonator includes:

a first conductor extending in a second plane;

a second conductor that is separated from the first conductor in a first direction intersecting with the second plane and extends in the second plane;

third conductors that extend in a first plane including the first direction and has a capacitance between the first conductor and the second conductor; and a fourth conductor that extends in the first plane and is connected to the first conductor and the second conductor, wherein at least one of the third conductors is connected to the first conductor and at least one of the third conductors is connected to the second conductor, the third conductor and the fourth conductor are separated from each other in a second direction that intersects with the first plane and is included in the second plane, the circuit board includes a ground conductor connected to the fourth conductor, and a center of the ground conductor is offset with centers of the first conductor and the second conductor in a third direction.

(Note 5-4)

The resonance structure according to Note 5-3, wherein the ground conductor has a surface integral in a first plane larger than a surface integral of the fourth conductor.

(Note 5-5)

The resonance structure according to Note 5-3 or Note 5-4, wherein the third conductors includes a capacitive component at a top end.

(Note 5-6)

The resonance structure according to any one of Note 5-3 to Note 5-5, wherein the resonator includes a feeding conductor configured to feed electricity to any one of the first conductor, the second conductor, and the third conductors, and the resonator is an antenna.

(Note 5-7)

The resonance structure according to Note 5-6, wherein the feeding conductor is connected to the third conductor at a position offset with a center of the third conductor in the third direction.

(Note 5-8)

The resonance structure according to Note 5-6 or Note 5-7, wherein the feeding conductor is connected to the third conductor at a position offset with a center of the fourth conductor in the third direction.

(Note 5-9)

A wireless communication module comprising:

the resonance structure according to any one of Note 5-6 to Note 5-8; and an RF module electrically connected to the feeding conductor.

(Note 5-10)

A wireless communication device comprising:

the wireless communication module according to Note 5-9; and a battery configured to feed electricity to the wireless communication module.

(Note 5-11)

The wireless communication device according to Note 5-10, wherein the battery overlaps by the fourth conductor in the second direction.

(Note 5-12)

The wireless communication device according to Note 5-10 or Note 5-11, wherein an electrode terminal of the battery is electrically connected to the fourth conductor.

(Note 5-13)

A resonance structure comprising:

a resonator and a circuit board, wherein the resonator includes:

a first conductor and a second conductor that extend in a second plane and are separated from each other in a first direction intersecting with the second plane;

third conductors that extend in a first plane including the first direction and are connected to the first conductor and the second conductor; and a fourth conductor that extends in the first plane and is connected to the first conductor and the second conductor, wherein the third conductors include a first body connected to the first conductor and a second body connected to the second conductor, the third conductors include a capacitance between the first body and the second body, the circuit board includes a ground conductor connected to the fourth conductor, and a center of the ground conductor is offset with centers of the first conductor and the second conductor in a third direction.

(Note 5-14)

A resonance structure comprising:

a resonator and a circuit board, wherein the resonator includes:

a first conductor and a second conductor that extend in a second plane and are separated from each other in a first direction intersecting with the second plane;

third conductors that extend in a first plane including the first direction;

a fourth conductor that extends in the first plane; and a reference potential layer that extends in the first plane, is configured to electromagnetically couple to the fourth conductor, and is configured as a reference potential, wherein the circuit board includes a ground conductor connected to the reference potential layer, and a center of the ground conductor is offset with centers of the first conductor and the second conductor in a third direction.

(Note 5-15)

The resonance structure according to any one of Note 4-3 or Note 4-7, wherein at least one of third conductors has an electrostatic capacitance with the first conductor, at least another of third conductors has an electrostatic capacitance with the second conductor.

(Note 6-1)

A resonance structure comprising:

a first conductor;

a second conductor being separated from the first conductor in a first direction;

third conductors that are positioned between the first conductor and the second conductor and extend in the first direction;

a fourth conductor that is connected to the first conductor and the second conductor and extends in the first direction; and a fifth conductor that is electromagnetically connected to the third conductors and configured to capacitively couple to the fourth conductor, wherein the third conductors has a capacitance.

(Note 6-2)

The resonance structure according to Note 6-1, wherein a capacitance positioned between the fifth conductor and the fourth conductor is larger than a capacitance between the fifth conductor and the third conductors.

(Note 6-3)

A resonance structure comprising:

a first conductor;

a second conductor being separated from the first conductor in a first direction;

a third conductor that is positioned between the first conductor and the second conductor and extends in the first direction;

a fourth conductor that is connected to the first conductor and the second conductor and extends in the first direction; and a fifth conductor that is electromagnetically connected to the third conductor and is configured to capacitively couple to the fourth conductor, wherein the first conductor is configured to capacitively couple to the second conductor through the third conductor.

(Note 6-4)

The resonance structure according to Note 6-3, wherein a capacitance between the fifth conductor and the fourth conductor is larger than a capacitance between the fifth conductor and the third conductor.

(Note 6-5)

The resonance structure according to any one of Note 6-1 to Note 6-4, wherein a portion of the fifth conductor is separated from the third conductors in the second direction.

(Note 6-6)

The resonance structure according to Note 6-5, wherein a portion of the fifth conductor is separated from the fourth conductor in the second direction without passing through the third conductors.

(Note 6-7)

An antenna comprising:

the resonance structure according to any one of Note 6-1 to Note 6-6; and a feeding line configured to feed electricity to one of the third conductors.

(Note 6-8)

A wireless communication module comprising:

the antenna according to Note 6-7; and an RF module electrically connected to the feeding conductor.

(Note 6-9)

A wireless communication device comprising:

the wireless communication module according to Note 6-8; and a battery configured to feed electricity to the wireless communication module.

(Note 6-10)

The wireless communication device according to Note 6-9, wherein the battery overlaps by the fourth conductor in a second direction.

(Note 6-11)

The wireless communication device according to Note 6-9 or Note 6-10, wherein an electrode terminal of the battery is electrically connected to the fourth conductor.

(Note 7-1)

A resonance structure comprising:

a first conductor;

a second conductor being separated from the first conductor in a first direction;

a third conductor that is positioned between the first conductor and the second conductor in a manner being separated from the first conductor and the second conductor and extends in the first direction;

a fourth conductor that is connected to the first conductor and the second conductor and extends in the first direction; and an impedance element connected to the first conductor and the third conductor.

(Note 7-2)

The resonance structure according to Note 7-1, comprising:

at least one fifth conductor configured to capacitively couple to one or more third conductors.

(Note 7-3)

The resonance structure according to Note 7-2, comprising:

fifth conductors, wherein one or more of the fifth conductors are connected to the first conductor.

(Note 7-4)

The resonance structure according to Note 7-2 or Note 7-3, comprising:

fifth conductors, wherein one or more of the fifth conductors are connected to the second connector.

(Note 7-5)

The resonance structure according to any one of Note 7-2 to Note 7-4, comprising:

at least one sixth conductor that is positioned between the first conductor and the second conductor and configured to capacitively couple to the fifth conductor.

(Note 7-6)

The resonance structure according to Note 7-5, wherein at least one of the fifth conductors is configured to capacitively couple to the third conductors through the at least one sixth conductor.

(Note 7-7)

The resonance structure according to any one of Note 7-1 to Note 7-6, wherein the impedance element is a variable element configured to change an impedance.

(Note 7-8)

The resonance structure according to Note 7-7, wherein the variable element is configured to change the impedance by performing electric control.

(Note 7-9)

The resonance structure according to Note 7-7, wherein the variable element is configured to change the impedance by using a physical mechanism.

(Note 7-10)

The resonance structure according to any one of Note 7-1 to Note 7-9, wherein the third conductor has a capacitance between the third conductor and the second conductor.

(Note 7-11)

The resonance structure according to any one of Note 7-1 to Note 7-10, comprising:

a second impedance element connected to the second conductor and the third conductor.

(Note 7-12)

The resonance structure according to Note 7-11, wherein an impedance of the second impedance element is different from an impedance of the impedance element.

(Note 7-13)

The resonance structure according to any one of Note 7-1 to Note 7-12, wherein at least one of the impedance element and the second impedance element is a capacitive reactance element.

(Note 7-14)

The resonance structure according to any one of Note 7-1 to Note 7-13, wherein the impedance element is positioned at a center of the third conductor in a third direction orthogonal to the first direction and a second direction.

(Note 7-15)

An antenna comprising:

the resonance structure according to Note 7-14; and a feeding conductor configured to electromagnetically couple to the third conductor.

(Note 7-16)

The antenna according to Note 7-15, wherein some of the third conductors are arranged in a third direction, and the feeding conductor is connected to one of the third conductors arranged in the third direction.

(Note 7-17)

The antenna according to Note 7-15 or Note 7-16, wherein the feeding conductor is connected to the third conductor at a position offset from a center in the first direction toward an edge.

(Note 7-18)

A wireless communication module comprising:

the antenna according to any one of Note 7-15 to Note 7-17; and an RF module electromagnetically connected to the feeding conductor.

(Note 7-19)

A wireless communication device comprising:

the wireless communication module according to Note 7-18; and a battery configured to feed electricity to the wireless communication module.

(Note 7-20)

The wireless communication device according to Note 7-19, wherein the battery overlaps by the fourth conductor in the second direction.

(Note 7-21)

The wireless communication device according to Note 7-19 or Note 7-20, wherein an electrode terminal of the battery is electrically connected to the fourth conductor.

(Note 8-1)

A resonance structure comprising:

a first conductor;

a second conductor being separated from the first conductor in a first direction;

third conductors that are positioned between the first conductor and the second conductor in a manner being separated from the first conductor and the second conductor and extend in the first direction;

a fourth conductor that is connected to the first conductor and the second conductor and extends in the first direction; and an impedance element connected to the first conductor and the third conductor, wherein the third conductors have a capacitance between the third conductors.

(Note 8-2)

The resonance structure according to Note 8-1, comprising:

at least one fifth conductor configured to capacitively couple to one or more of the third conductors.

(Note 8-3)

The resonance structure according to Note 8-1 or Note 8-2, comprising:

fifth conductors, wherein one or more of the fifth conductors are connected to the first conductor.

(Note 8-4)

The resonance structure according to any one of Note 8-1 to Note 8-3, comprising:

fifth conductors, wherein one or more of the fifth conductor are connected to the second conductor.

(Note 8-5)

The resonance structure according to any one of Note 8-2 to Note 8-4, comprising:

at least one sixth conductor that is positioned between the first conductor and the second conductor and is configured to capacitively couple to the fifth conductor.

(Note 8-6)

The resonance structure according to Note 8-5, wherein at least one of the fifth conductors is configured to capacitively couple to the third conductors through the at least one sixth conductor.

(Note 8-7)

The resonance structure according to any one of Note 8-1 to Note 8-6, wherein the impedance element is a variable element capable of changing an impedance.

(Note 8-8)

The resonance structure according to Note 8-7, wherein the variable element is configured to change the impedance by performing electric control.

(Note 8-9)

The resonance structure according to Note 8-7, wherein the variable element is configured to change the impedance by using a physical mechanism (Note 8-10)

The resonance structure according to any one of Note 8-1 to Note 8-9, wherein the third conductors have a capacitance between the third conductors and the second conductor.

(Note 8-11)

The resonance structure according to any one of Note 8-1 to Note 8-9, comprising:

a second impedance element connected to the second conductor and the third conductors.

(Note 8-12)

The resonance structure according to Note 8-11, wherein an impedance of the second impedance element is different from an impedance of the impedance element.

(Note 8-13)

The resonance structure according to any one of Note 8-1 to Note 8-12, wherein at least one of the impedance element and the second impedance element is a capacitive reactance element.

(Note 8-14)

The resonance structure according to any one of Note 8-1 to Note 8-13, comprising at least one third impedance element connected to two of the third conductors adjacent to each other in the first direction.

(Note 8-15)

The resonance structure according to Note 8-14, wherein an impedance of the impedance element and an impedance of the at least one third impedance element are different from each other.

(Note 8-16)

The resonance structure according to any one of Note 8-14 or Note 8-15, wherein one of the impedance element and the at least one third impedance element is a capacitive reactance element.

(Note 8-17)

The resonance structure according to any one of Note 8-14 to Note 8-16, comprising:

third impedance elements, wherein at least one of the third impedance elements has a different impedance.

(Note 8-18)

The resonance structure according to any one of Note 8-14 to Note 8-17, comprising:

third impedance elements, wherein at least one of the third impedance elements is a capacitive reactance element.

(Note 8-19)

The resonance structure according to any one of Note 8-1 to Note 8-18, wherein the impedance element is positioned at a center of the third conductor in a third direction orthogonal to the first direction and a second direction.

(Note 8-20)

An antenna comprising:

the resonance structure according to note 8-19; and a feeding line electromagnetically connected to the third conductor.

(Note 8-21)

The antenna according to Note 8-20, wherein some of the third conductors are arranged in the third direction, and a feeding line is connected to one of the some of the third conductors arranged in the third direction.

(Note 8-22)

The antenna according to Note 8-20 or Note 8-21, wherein the feeding line is connected to the third conductor at a portion offset from a center in the first direction toward an edge.

(Note 8-23)

A wireless communication module comprising:

the antenna according to any one of Note 8-20 to Note 8-22: and an RF module electromagnetically connected to the feeding conductor.

(Note 8-24)

A wireless communication device comprising:

the wireless communication module according to Note 8-23; and a battery configured to feed electricity to the wireless communication module.

(Note 8-25)

The wireless communication device according to Note 8-24, wherein the battery overlaps by the fourth conductor in the second direction.

(Note 8-26)

The wireless communication device according to Note 8-24 or Note 8-25, wherein an electrode terminal of the battery is electrically connected to the fourth conductor.

(Note 9-1)

A resonance structure comprising:

a first conductor;

a second conductor being separated from the first conductor in a first direction;

third conductors that are arranged in the first direction between the first conductor and the second conductor;

a fourth conductor that is connected to the first conductor and the second conductor and extends in the first direction; and at least one impedance element connected between the third conductors, wherein one or more of the third conductors are connected to the first conductor, and one or more of the third conductors are connected to the second conductor.

(Note 9-2)

The resonance structure according to Note 9-1, wherein the number of the third conductors is two, and the resonance structure includes one impedance element.

(Note 9-3)

The resonance structure according to Note 9-1, wherein the number of the third conductors is three or more, and the impedance element is positioned in a portion between two of the third conductors adjacent to each other in the first direction.

(Note 9-4)

The resonance structure according to any one of Note 9-1 to Note 9-4, wherein the at least one impedance element is plural, and at least one of the impedance elements is a capacitive reactance element.

(Note 9-5)

The resonance structure according to any one of Note 9-1 to Note 9-4, wherein the at least one impedance element is plural, and at least one of the impedance elements have a different impedance with others of the impedance elements.

(Note 9-6)

The resonance structure according to any one of Note 9-1 to Note 9-5, wherein the at least one impedance element is plural, and each the impedance elements has a different impedance with others.

(Note 9-7)

The resonance structure according to any one of Note 9-1 to Note 9-6, wherein the impedance element is positioned in a portion between two of the third conductors adjacent to each other in a first direction.

(Note 9-8)

The resonance structure according to any one of Note 9-1 to Note 9-7, wherein the impedance element is a variable element configured to change an impedance.

(Note 9-9)

The resonance structure according to Note 9-8, wherein the variable element is configured to change the impedance by performing electric control.

(Note 9-10)

The resonance structure according to Note 9-8, wherein the variable element is configured to change the impedance by using a physical mechanism (Note 9-11)

The resonance structure according to any one of Note 9-1 to Note 9-10, further comprising:

at least one fifth conductor configured to capacitively couple to one or more of the third conductors.

(Note 9-12)

The resonance structure according to Note 9-11, further comprising:

at least one sixth conductor that is positioned between the first conductor and the second conductor and configured to capacitively couple to the fifth conductor.

(Note 9-13)

The resonance structure according to Note 9-12, wherein at least one of the fifth conductors is configured to capacitively couple to the third conductors through at least one sixth conductor.

(Note 9-14)

The resonance structure according to any one of Note 9-1 to Note 9-13, wherein the impedance element is positioned at a center of the third conductors in a third direction orthogonal to the first direction and the second direction.

(Note 9-15)

An antenna comprising:

the resonance structure according to Note 9-14; and a feeding line configured to electromagnetically connect to one of the third conductors.

(Note 9-16)

The antenna according to Note 9-15, wherein some of the third conductors are arranged in the third direction, and the feeding line is connected to one of the third conductors arranged in the third direction.

(Note 9-17)

The antenna according to Note 9-15 or Note 9-16, wherein the feeding line is connected to the third conductors at a position offset from a center in the first direction toward an edge.

(Note 9-18)

A wireless communication module comprising:

the antenna according to any one of Note 9-15 to Note 9-17; and an RF module electrically connected to the feeding conductor.

(Note 9-29)

A wireless communication device comprising:

the wireless communication module according to Note 9-18; and a battery configured to feed electricity to the wireless communication module.

(Note 9-20)

The wireless communication device according to Note 9-19, wherein the battery overlaps by the fourth conductor in the second direction.

(Note 9-21)

The wireless communication device according to Note 9-19 or Note 9-20, wherein an electrode terminal of the battery is electrically connected to the fourth conductor.

(Note 10-1)

A resonance structure comprising:

a resonator and an electrically conductive body, wherein the resonator includes:

a first conductor;

a second conductor being separated from the first conductor in a first direction;

third conductors that are positioned between the first conductor and the second conductor and extend in the first direction; and a fourth conductor that is connected to the first conductor and the second conductor and extends in the first direction, wherein the electrically conductive body includes a slot extending in the first direction, and the resonator is positioned in the vicinity of a long side of the slot.

(Note 10-2)

The resonance structure according to Note 10-1, wherein the fourth conductor of the resonator is separated from the electrically conductive body.

(Note 10-3)

The resonance structure according to Note 10-1, wherein the third conductors of the resonator are separated from the electrically conductive body.

(Note 10-4)

The resonance structure according to any one of Note 10-1 to Note 10-3, wherein the third conductors have a capacitance.

(Note 10-5)

A resonance structure comprising:

a first conductor;

a second conductor being separated from the first conductor in a first direction;

a third conductor that is positioned between the first conductor and the second conductor and extends in the first direction; and a fourth conductor that is connected to the first conductor and the second conductor and extends in the first direction, wherein the fourth conductor includes:

an extra body that extends in a third direction from the third conductor in a plan view in a second direction; and a slot that is formed on the extra body and extends in the first direction.

(Note 10-6)

The resonance structure according to Note 10-5, wherein the first conductor is configured to capacitively connect to the second conductor through the third conductor.

(Note 10-7)

The resonance structure according to any one of Note 10-1 to Note 10-6, wherein the slot has a length obtained by dividing an integral multiple of an operating wavelength of the resonance structure by 2.

(Note 10-8)

An antenna comprising:

the resonance structure according to any one of Note 10-1 to Note 10-7; and a feeding line configured to feed electricity to any one of the third conductors.

(Note 10-9)

A wireless communication module comprising:

the antenna according to Note 10-8; and an RF module electrically connected to the feeding conductor.

(Note 10-10)

A wireless communication device comprising:

the wireless communication module according to Note 10-9; and a battery configured to feed electricity to the wireless communication module.

(Note 11-1)

A resonance structure comprising:

a first conductor;

a second conductor being separated from the first conductor in a first direction;

third conductors that are positioned between the first conductor and the second conductor and extend in the first direction;

a fourth conductor that is connected to the first conductor and the second conductor and extends in the first direction; and at least one conductive component aligned with at least one or more of the third conductors in a first plane including the first direction.

(Note 11-2)

The resonance structure according to Note 11-1, wherein the conductive component is conductive components, and at least one or more of the third conductors are positioned between the conductive components.

(Note 11-3)

The resonance structure according to Note 11-1 or Note 11-2, wherein the conductive component is one of a processor, a memory, and a sensor.

(Note 11-4)

The resonance structure according to any one of Note 11-1 to Note 11-3, comprising:

a dielectric component that overlaps with the third conductors in a second direction.

(Note 11-5)

A resonance structure comprising:

a first conductor;

a second conductor being separated from the first conductor in a first direction;

third conductors that are positioned between the first conductor and the second conductor and extend in the first direction;

a fourth conductor that is connected to the first conductor and the second conductor and extends in the first direction; and a dielectric component overlapping by the third conductors in a second direction.

(Note 11-6)

An antenna comprising:

the resonance structure according to any one of Note 11-1 to Note 11-5; and a feeding line configured to feed electricity to any one of the third conductors.

(Note 11-7)

A wireless communication module comprising:

the antenna according to Note 11-6; and an RF module electrically connected to the feeding conductor.

(Note 11-8)

A wireless communication device comprising:

the wireless communication module according to Note 11-7; and a battery configured to feed electricity to the wireless communication module.

(Note 12-1)

A resonator comprising:

a first conductor;

a second conductor that is separated from the first conductor in a first direction; and third conductors that are positioned between the first conductor and the second conductor and extend in the first direction;

wherein the first conductor and the second conductor are electrically or capacitively connected to an electrically conductive body, and the resonator configured to resonate including the electrically conductive body.

(Note 12-2)

The resonator according to Note 12-1, comprising:

a base that has the first conductor, the second conductor, and the third conductor.

(Note 12-3)

The resonator according to Note 12-2, wherein the base includes a first surface and a second surface, the third conductor is positioned on a first surface side, and the first conductor and the second conductor extend from the first surface to the second surface.

(Note 12-4)

The resonator according to Note 12-3, wherein the base includes a recess that is recessed from the second surface toward the first surface.

(Note 12-5)

A resonance structure comprising:

the resonator according to any one of Note 12-1 to Note 12-4; and the electrically conductive body electrically connected or configured to capacitively connect to the first conductor and the second conductor.

(Note 12-6)

An antenna comprising:

the resonator according to Note 12-4; and a feeding line connected to one of the third conductors from a bottom of the recess.

(Note 12-7)

The antenna according to Note 12-6, comprising:

a ground line extending to a second surface from the bottom of the recess.

(Note 12-8)

A wireless communication module comprising:

the antenna according to Note 12-6 or Note 12-7; and an RF module connected to the feeding line.

(Note 12-9)

The wireless communication module according to Note 12-8, wherein the RF module is accommodated in the recess.

(Note 12-10)

The wireless communication module according to Note 12-8 or Note 12-9, comprising:

at least one functional component accommodated in the recess.

(Note 12-11)

The wireless communication module according to Note 12-10, wherein the functional component includes at least one of a processor, a memory, and a sensor.

(Note 12-12)

A wireless communication device comprising:

the wireless communication module according to any one of Note 12-8 to Note 12-11; and a battery configured to feed electricity to the RF module.

(Note 12-13)

A wireless communication device comprising:

the wireless communication module according to Note 12-10 or Note 12-11; and a battery configured to feed electricity to the functional component.

(Note 13-1)

A resonance structure comprising:

a first conductor;

a second conductor being separated from the first conductor in a first direction;

one or more third conductors that are positioned between the first conductor and the second conductor and extend in a first plane including the first direction; and a fourth conductor that is connected to the first conductor and the second conductor and extends in the first plane, wherein the first conductor and the second conductor extend in a second direction intersecting with the first plane, the one or more third conductors include a capacitance between the first conductor and the second conductor, the fourth conductor includes two extra-bodies that extend to an outside of both edges of the third conductor in a third direction intersecting with the first direction in the first plane in a plan view, and each length of the two extra-bodies in the third direction is $0.025\lambda$ or more, where $\lambda$ represents an operating wavelength.

(Note 13-2)

The resonance structure according to Note 13-1, wherein a total length of the two extra bodies in the third direction is $0.075\lambda$ or more.

(Note 13-3)

A resonance structure comprising:

a resonator and a circuit board, wherein the resonator comprising:

a first conductor;

a second conductor being separated from the first conductor in a first direction;

one or more of third conductors that are positioned between the first conductor and the second conductor and extend in a first plane including the first direction; and a fourth conductor that is connected to the first conductor and the second conductor and extends in the first plane, wherein the first conductor and the second conductor extend in a second direction intersecting with the first plane, the one or more of third conductors include a capacitance between the first conductor and the second conductor, the circuit board includes a conductive layer that is electrically connected to the fourth conductor and extends in the first plane, the conductive layer includes two extra-bodies that extend to an outside of both edges of the third conductor in a third direction intersecting with the first direction in the first plane in a plan view, and each length of the two extra-bodies in the third direction is 0.025λ or more, where λ represents an operating wavelength.

(Note 13-4)

The resonance structure according to Note 13-3, wherein a total length of the two extra-bodies in the third direction is 0.075λ or more.

(Note 13-5)

An antenna comprising:

the resonance structure according to Note 13-1 or Note 13-2; and a feeding line configured to electromagnetically feed one of the one or more of the third conductors.

(Note 13-6)

The antenna according to Note 13-5, wherein the fourth conductor is a signal round of the feeding line.

(Note 13-7)

An antenna comprising:

the resonance structure according to Note 13-3 or Note 13-4; and a feeding line configured to electromagnetically feed one of the one or more of the third conductors.

(Note 13-8)

The antenna according to Note 13-7, wherein the conductive layer is a signal round of the feeding line.

(Note 13-9)

A wireless communication module comprising:

the antenna according to any one of Note 13-5 to Note 13-8; and an RF module electrically connected to the feeding conductor.

(Note 13-10)

A wireless communication device comprising:

the wireless communication module according to Note 13-9; and a battery configured to feed electricity to the wireless communication module.

The configurations according to the present disclosure are not limited to the embodiments which have been described above and may be varied or altered in a variety of manners. For example, functions and the like included in each constituent element and the like may be rearranged without a logically inconsistency, so as to combine constituent elements or to subdivide a constituent element.

In the present disclosure, a constituent element in a figure that has already been illustrated in a prior figure is denoted with a common code common to the constituent element illustrated in the prior figure. A constituent element illustrated in a posterior figure is denoted with a figure number as a prefix followed by a common code. Even when denoted with a figure number as a prefix, each constituent element may have the same configuration as another constituent element denoted with the same common code. Each constituent element may employ a configuration of another constituent element denoted with the same common code, as long as it is logically consistent. Each constituent element may combine one or all of two or more constituent elements denoted with the same common code. In the present disclosure, the prefix attached as a prefix in front of the common code may be removed. In the present disclosure, the prefix attached as a prefix in front of the common code may be changed to any number. In the present disclosure, the prefix attached as a prefix in front of the common code may be changed to the same number of another constituent element denoted with the same common code, as long as it is logically consistent.

The drawings illustrating the configurations of the present disclosure are merely schematic. Dimensional ratios and the like of the drawings may not be drawn to scale.

In the present disclosure, descriptions such as "first", "second", and "third" are example identifiers for distinguishing the configurations. In the present disclosure, the configurations distinguished by "first", "second" and the like may interchange their numbers in the configurations. For example, "first" and "second" as the identifiers of a first frequency and a second frequency may be interchanged. Such interchange is simultaneously performed. The configurations remain distinguished from one another after the interchange of the identifiers. The identifiers may be removed. In a configuration in which the identifiers are removed, the configurations are distinguished by codes. For example, the first conductor 31 may be a conductor 31. In the present disclosure, the identifiers such as "first" and "second" should not be used alone as a basis for the interpretation that there is a sequence of constituent elements, for the presence of an identifier with a smaller number, or for the presence of an identifier with a larger number. In the present disclosure, the second conductive layer 42 includes the second unit slot 422. However, the present disclosure also includes a configuration in which the first conductive layer 41 does not include the first unit slot.

The invention claimed is:

1. An antenna comprising:

a first conductor and a second conductor separated in a first direction;

a resonator between the first conductor and the second conductor, extending in the first direction, and including at least one structure; and a feeding line, wherein the at least one structure includes:

at least a part of a third conductor, the third conductor extending in a first plane, the first plane includes the first direction, and at least a part of a fourth conductor, the fourth conductor extending in the first plane, is connected to the first conductor and the second conductor, and is configured as an electric potential standard, the third conductor overlaps the fourth conductor in a second direction, the second direction intersects the first plane and is different from the first direction, the third conductor includes a first connecting conductor and is configured as an electrically floating conductor, the first connecting conductor is connected with the first conductor, and the floating conductor is not connected with the first conductor, the second conductor, and the fourth conductor, the first connecting conductor is capacitively connected with the second conductor by the floating conductor, the resonator is configured to be electrically opened at both edges in a third direction, the third direction intersects the first direction and the second direction, the feeding line is electrically connected with the third conductor;

the at least the part of the fourth conductor is directly connected to the first conductor and the second conductor, and the third conductor further includes another electrically floating conductor overlapped by at least the electrically floating conductor, the electrically floating conductor and the another electrically floating conductor are arranged in the third direction, the electrically floating conductor and the another electrically floating conductor are configured to capacitively connect between the first conductor and the second conductor.

2. The antenna according to claim 1, wherein
the at least one structure is arranged along the first direction.

3. The antenna according to claim 1, wherein
the at least one structure is configured to resonate with an electrical field component along the first direction.

4. The antenna according to claim 1, wherein
the resonator directly contacts the first conductor and the second conductor in the first direction.

5. The antenna according to claim 1, wherein
the first conductor includes a set of fifth conductors,
each conductor of the set of fifth conductors extends in the second direction, and
the first connecting conductor is connected to the set of fifth conductors.

6. The antenna according to claim 5, wherein
the set of fifth conductors includes a single conductor.

7. The antenna according to claim 5, wherein
the set of fifth conductors includes multiple conductors.

8. The antenna according to claim 1, wherein
the third conductor includes a second connecting conductor, the second connecting conductor is connected with the second conductor.

9. The antenna according to claim 8, wherein
the second conductor includes another set of fifth conductors, each conductor of the another set of fifth conductors extends in the second direction.

10. The antenna according to claim 9, wherein
the another set of fifth conductors includes multiple conductors.

11. The antenna according to claim 8, wherein
the second connecting conductor is capacitively connected with the first connecting conductor by the floating conductor.

12. The antenna according to claim 8, wherein
a length of the floating conductor in the first direction is shorter than a length of the second connecting conductor in the first direction.

13. The antenna according to claim 1, wherein the third conductor includes:
a first conductive layer, and
a second conductive layer, the second conductive layer is overlapped by the first conductive layer in the second direction and is capacitively connected with the first conductive layer.

14. The antenna according to claim 1, wherein
the floating conductor is overlapped with the first connecting conductor in the second direction and is capacitively connected with the first connecting conductor.

15. The antenna according to claim 1, wherein
a current is configured to flow in the third conductor and the fourth conductor in an opposite direction of the first direction, when the at least one unit structure resonates.

16. The antenna according to claim 1, wherein
the antenna is an artificial magnetic conductor at an electro-magnetic wave over a first frequency band.

17. The antenna according to claim 1, wherein
the feeding line is directly connected to the third conductor.

18. A wireless communication module comprising;
an antenna; and
an RF module electrically connected to the antenna, wherein
the antenna comprises:
a first conductor and a second conductor separated in a first direction;
a resonator
between the first conductor and the second conductor, extending in the first direction, and
including at least one structure; and
a feeding line, wherein
the at least one structure includes:
at least a part of a third conductor, the third conductor extending in a first plane, the first plane includes the first direction, and
at least a part of a fourth conductor, the fourth conductor extending in the first plane, is connected to the first conductor and the second conductor, and is configured as an electric potential standard,
the third conductor overlaps the fourth conductor in a second direction, the second direction intersects the first plane and is different from the first direction,
the third conductor includes a first connecting conductor, a first electrically floating conductor and a second electrically floating conductor, the second electrically floating conductor is overlapped by the first electrically floating conductor, the first connecting conductor is connected with the first conductor, and
the first electrically floating conductor is not connected with the first conductor, the second conductor, and the fourth conductor,
the first connecting conductor is capacitively connected with the second conductor by the first electrically floating conductor,
the resonator is configured to be electrically opened at both edges in a third direction, the third direction intersects the first direction and the second direction, and
the feeding line is electrically connected with the third conductor.

19. A wireless communication device comprising;
a wireless communication module; and
a battery, wherein
the wireless communication module includes
an antenna and
an RF module electrically connected to the antenna, and
the battery configured to supply electrical power to the wireless communication module, wherein
the antenna comprises
a first conductor and a second conductor separated in a first direction;
a resonator
between the first conductor and the second conductor,
extending in the first direction, and
including at least one structure; and
a feeding line, wherein the at least one structure includes:
at least a part of a third conductor, the third conductor extending in a first plane, the first plane includes the first direction, and
at least a part of a fourth conductor, the fourth conductor extending in the first plane, is connected to the first conductor and the second conductor, and is configured as an electric potential standard, the third conductor overlaps the fourth conductor in a second direction, the second direction intersects the first plane and is different from the first direction, the third conductor includes a first connecting conductor and is configured as an electrically floating conductor, the first connecting conductor is connected with the first conductor, and the floating conductor is not connected with the first conductor, the second conductor, and the fourth conductor, the first connecting conductor is capacitively connected with the second conductor by the floating conductor, the resonator is configured to be electrically opened at both edges in a third direction, the third direction intersects the first direction and the second direction, the feeding line is electrically connected with the third conductor, and the third conductor further includes another electrically floating conductor overlapped by at least the electrically floating conductor, the electrically floating conductor and the another electrically floating conductor are arranged in the third direction, the electrically floating conductor and the another electrically floating conductor are configured to capacitively connect between the first conductor and the second conductor.

20. The wireless communication device according to claim 19, wherein the fourth conductor electrically connects a negative terminal of the battery.

* * * * *